US005884124A

United States Patent [19]

Karakama et al.

[11] Patent Number: 5,884,124

[45] Date of Patent: Mar. 16, 1999

[54] DIP SHEET ADHERING METHOD, CLEANING DEVICE, PROCESS AND IMAGE FORMING APPARATUS

[75] Inventors: Toshiyuki Karakama, Tokyo; Kazushi Watanabe; Takeo Shoji, both of Yokohama, all of Japan

[73] Assignee: Canon Kabushiki Kaisha, Tokyo, Japan

[21] Appl. No.: 952,913

[22] Filed: Sep. 28, 1992

[30] Foreign Application Priority Data

| | | | |
|---|---|---|---|
| Nov. 20, 1991 | [JP] | Japan | 3-304709 |
| Jun. 30, 1992 | [JP] | Japan | 4-194665 |
| Jul. 24, 1992 | [JP] | Japan | 4-217422 |

[51] Int. Cl.[6] ..... G03G 15/20; G03G 21/16; G03G 21/00

[52] U.S. Cl. ..... 399/123; 399/111; 399/350

[58] Field of Search ..... 355/298, 210, 355/296, 260, 299, 200, 309, 211, 283; 15/256.5, 1.51; 254/133 R; 156/160; 399/343, 350, 351, 358, 111, 123

[56] References Cited

U.S. PATENT DOCUMENTS

| | | | |
|---|---|---|---|
| 3,820,889 | 6/1974 | Nitanda et al. | 355/309 |
| 3,985,436 | 10/1976 | Tanaka et al. | 355/200 |
| 4,127,083 | 11/1978 | Sesoko | 118/653 |
| 4,211,484 | 7/1980 | Iwai et al. | 15/256.51 X |
| 4,334,766 | 6/1982 | Sugiyama et al. | 355/299 |
| 4,400,081 | 8/1983 | Yamashita et al. | 355/299 |
| 4,451,139 | 5/1984 | Yanagawa et al. | 355/297 |
| 4,500,195 | 2/1985 | Hosono | 355/245 X |
| 4,530,594 | 7/1985 | Adachi | 15/256.5 X |
| 4,540,268 | 9/1985 | Toyono et al. | 355/210 |
| 4,561,766 | 12/1985 | Fox | 355/299 X |
| 4,591,258 | 5/1986 | Nishino et al. | 355/200 |
| 4,609,276 | 9/1986 | Mitzutani | 355/210 |
| 4,627,701 | 12/1986 | Onoda et al. | 355/221 |
| 4,660,960 | 4/1987 | Fukunaga et al. | 355/260 |
| 4,708,455 | 11/1987 | Kubota et al. | 355/260 X |
| 4,730,205 | 3/1988 | Ogiri et al. | 355/298 |
| 4,839,690 | 6/1989 | Onoda et al. | 355/211 |
| 4,870,449 | 9/1989 | Brown | 355/298 |
| 4,888,620 | 12/1989 | Fujino et al. | 355/211 |
| 4,947,216 | 8/1990 | Surti | 355/299 |
| 4,972,227 | 11/1990 | Onoda et al. | 355/210 |
| 5,021,830 | 6/1991 | Koiso | 355/215 |
| 5,028,966 | 7/1991 | Kozuka et al. | 355/260 |
| 5,038,181 | 8/1991 | Yoshida et al. | 355/299 |
| 5,099,280 | 3/1992 | Takemoto et al. | 355/210 |
| 5,107,305 | 4/1992 | Charland et al. | 355/298 |
| 5,138,394 | 8/1992 | Watanabe et al. | 355/299 X |
| 5,155,527 | 10/1992 | Gokita et al. | 355/210 X |

FOREIGN PATENT DOCUMENTS

| | | |
|---|---|---|
| 0314175 | 3/1989 | European Pat. Off. . |
| 3522296 | 1/1986 | Germany . |
| 55-036851 | 3/1980 | Japan . |
| 56-122071 | 9/1981 | Japan . |
| 57-46274 | 3/1982 | Japan . |
| 60-244987 | 12/1985 | Japan . |
| 63-149669 | 6/1988 | Japan . |
| 2-012183 | 1/1990 | Japan . |

*Primary Examiner*—S. Lee

*Attorney, Agent, or Firm*—Fitzpatrick, Cella, Harper & Scinto

[57] ABSTRACT

A method is disclosed for attaching a sheet for receiving toner removed from an image bearing member to a frame. The method includes the steps of adhering the sheet to the frame, using an adhesive, while bending the frame and releasing the frame after the sheet is adhered to the frame. A toner-guiding sheet for guiding toner removed from an image bearing member to a toner-receiving unit is also disclosed. The sheet is widened near a central portion in a longitudinal direction so that the sheet edge will conform to the bent shape of an attachment surface. A cleaning device is also disclosed. The cleaning device may include a frame and a sheet attached to the frame by an adhesive in a condition that a tension force is applied to the sheet. Further, the cleaning device may include a cleaning container having a wall that is thinner at a position near an attachment surface for a sheet than at a position away from the attachment surface, to facilitate bending of the attachment surface during application of a sheet to the attachment surface.

104 Claims, 64 Drawing Sheets

DIP SHEET ADHERING METHOD, CLEANING DEVICE, PROCESS AND IMAGE FORMING APPARATUS

BACKGROUND OF THE INVENTION

1. Field of the Invention

The present invention relates to a cleaning device for cleaning a body to be cleaned, such as a photosensitive body, a dip sheet used with such a cleaning device, a method for adhering such a dip sheet, a process cartridge and an image forming system.

2. Description of the Related Art

Generally, a known image forming system, or image forming apparatus, includes an image bearing member of a rotating drum type having a photo-conductive photosensitive layer at its outer peripheral surface is used, an electrostatic latent image is formed on the photosensitive layer while rotating the image bearing member, the electrostatic latent image is developed (visualized) with toner as a toner image, and then the toner image is transferred onto a transfer sheet. In such an image forming system, after a cycle of the image formation is finished, the residual toner (and other foreign matters) adhered to the surface of the image bearing member is removed from the image bearing member by a cleaning device.

As an example, the cleaning device comprises a cleaning blade for removing the residual toner remaining on the image bearing member while slidingly contacting with the image bearing member, a squeegee or dip sheet disposed below the cleaning blade and contacted with the image bearing member to receive the removed toner, and a waste toner reservoir for collecting the waste toner received by the squeegee sheet.

The cleaning blade and the squeegee sheet are arranged to contact the surface of the image bearing member, and, in particular, the squeegee sheet is attached to a predetermined position (referred to as "attachment surface" hereinafter) of the waste toner reservoir by a both-sided adhesive tape.

However, the waste toner reservoir is made of resin material and, thus, has an uneven and/or slightly deformed surface. Accordingly, if the squeegee sheet is merely stuck to the toner reservoir by the both-sided adhesive tape, undulation or sinuosity is generated at a free edge portion of the squeegee sheet which is contacted with the image bearing member, with the result that the free edge portion of the squeegee sheet does not closely contact with the surface of the image bearing member, thus causing a problem that the toner removed by the cleaning blade is received by the squeegee sheet less than perfectly that is, with reduced efficiency.

Further, when a charger roller (charger device of contact type) is used to charge the image bearing member, the contacting pressure between the charger roller and the image bearing member becomes great at both ends of the roller, and a small amount of toner which has escaped from the cleaning blade is compressed by the urging force of the charger roller, thus adhering to the surface of the image bearing member. Further, when the overlapped DC and AC voltages are applied to the charger roller, since the charger roller is vibrated, the toner which has escaped from the cleaning blade is compressed by the roller with stronger force, thus considerably contaminating the surface of the image bearing member with toner.

In order to eliminate the above drawback, the inventors conducted various tests and found that the above drawback was caused not only by the urging force of the charger roller against the image bearing member, but also by the urging force of the squeegee sheet against the image bearing member. Further, if the urging force of the squeegee sheet against the image bearing member is too great, the surface of the image bearing member will easily be damaged, with the result that the adhesion of the toner to the image bearing member (particularly, to both end portions of the image bearing member) is promoted.

SUMMARY OF THE INVENTION

An object of the present invention is to provide a squeegee or dip sheet, a method for sticking or adhering such a squeegee sheet, a cleaning device, a process cartridge and an image forming system, which can obtain a high quality image.

Another object of the present invention is to provide a squeegee sheet, a method for sticking such a squeegee sheet, a cleaning device, a process cartridge and an image forming system, which can remarkably improve the cleaning ability.

The other object of the present invention is to provide a squeegee sheet sticking method which prevents poor attachment of a squeegee sheet, a squeegee sheet formed to avoid poor attachment, a cleaning device having such a squeegee sheet, a process cartridge having such a squeegee sheet, and an image forming system having such a squeegee sheet.

DETAILED DESCRIPTION OF THE PREFERRED EMBODIMENTS

First of all, a process cartridge according to a first embodiment of the present invention, and an image forming system utilizing such a process cartridge will be explained with reference to the accompanying drawings.

Figure 2:
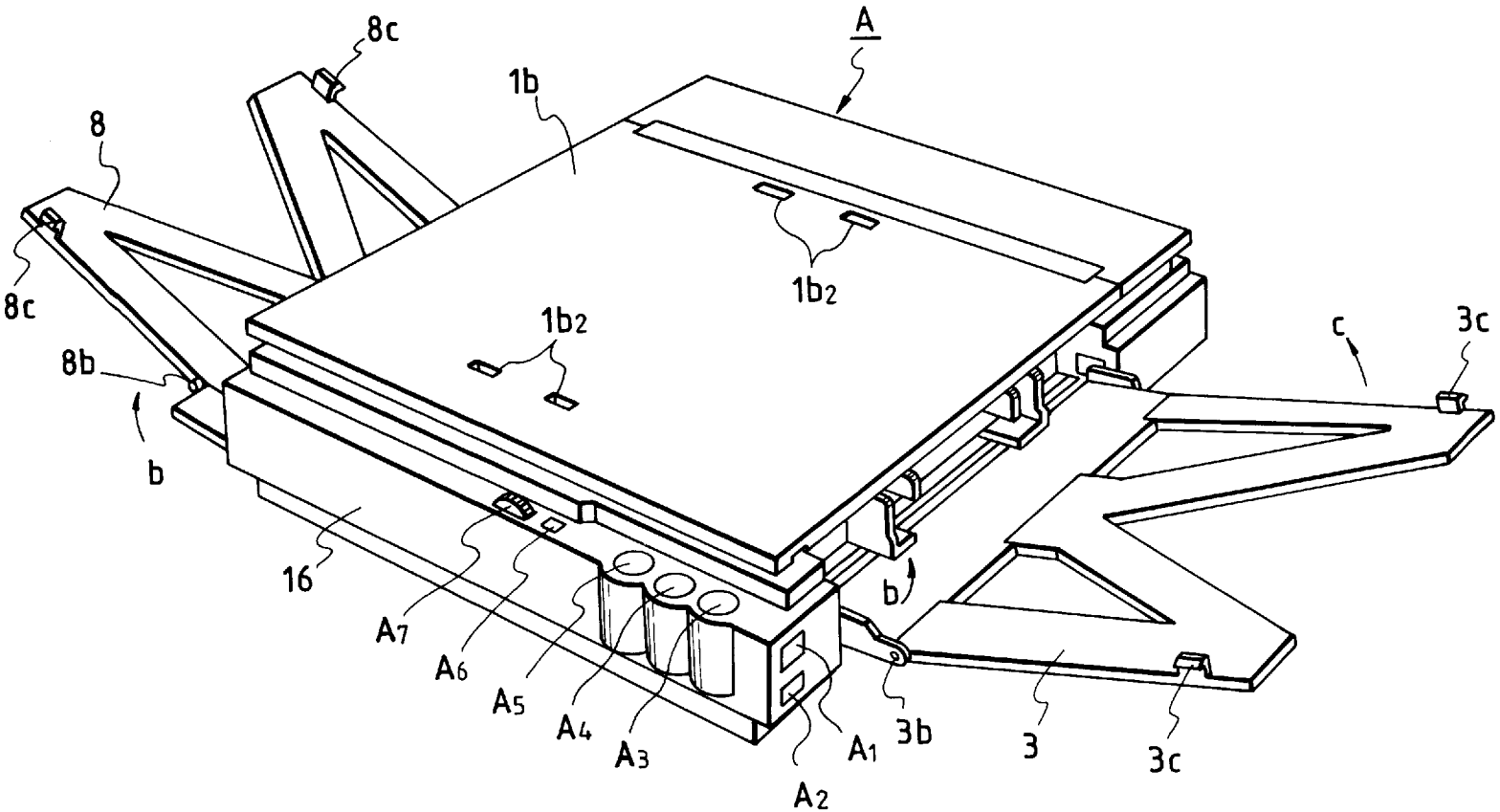
FIG. 2 is a perspective view of the copying machine in a condition that a tray is opened.
Figure 3:
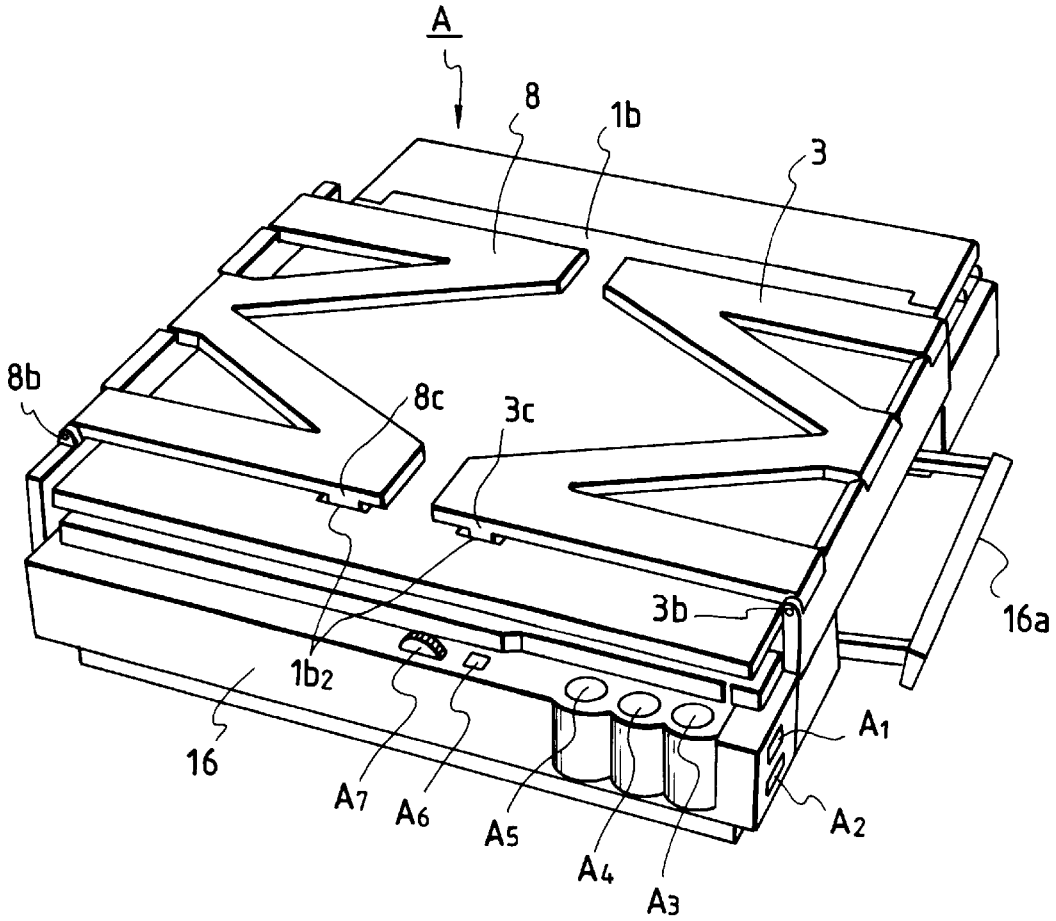
FIG. 3 is a perspective view of the copying machine in a condition that a tray is closed.
Figure 4:
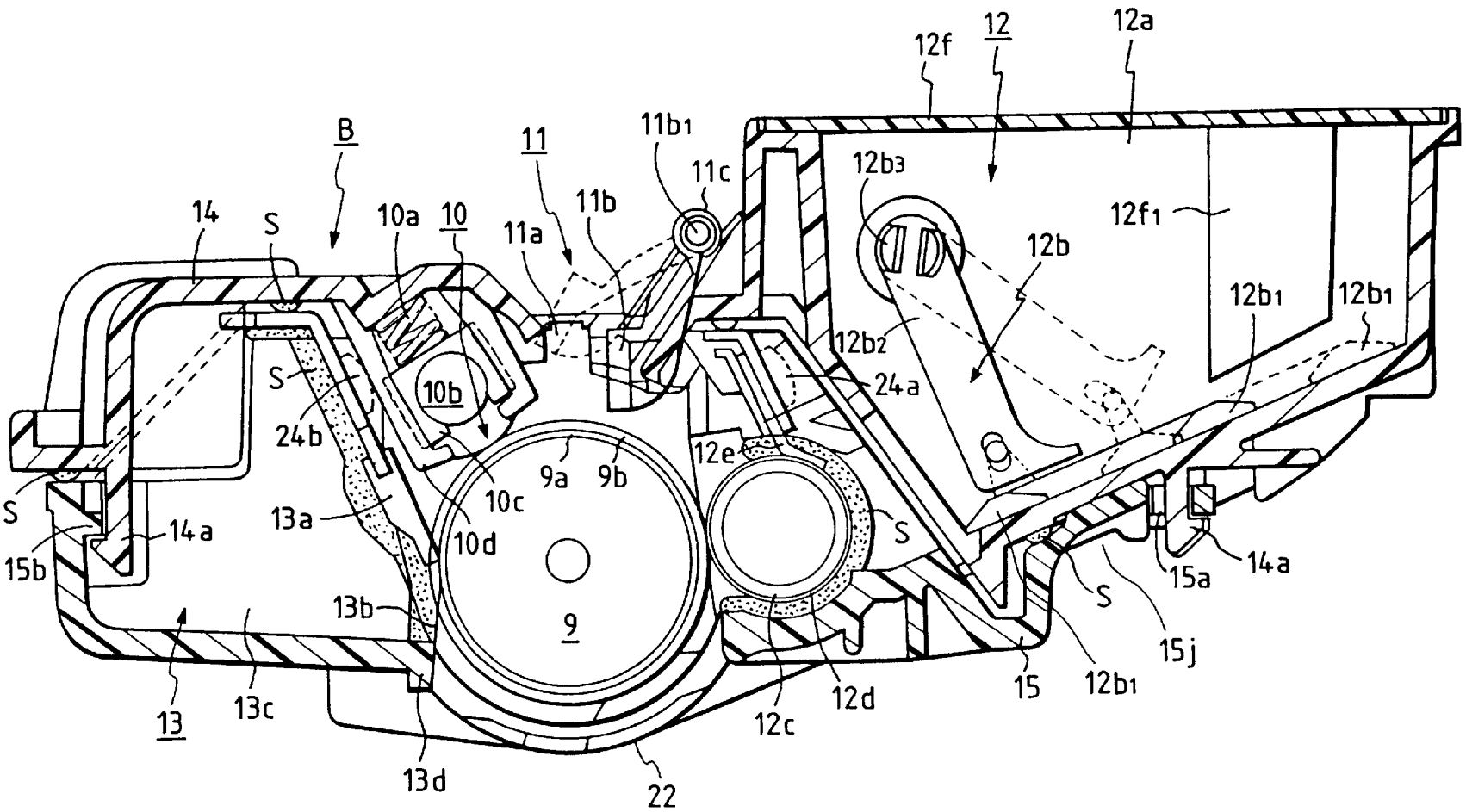
FIG. 4 is an elevational sectional view of the process cartridge.
Figure 5:
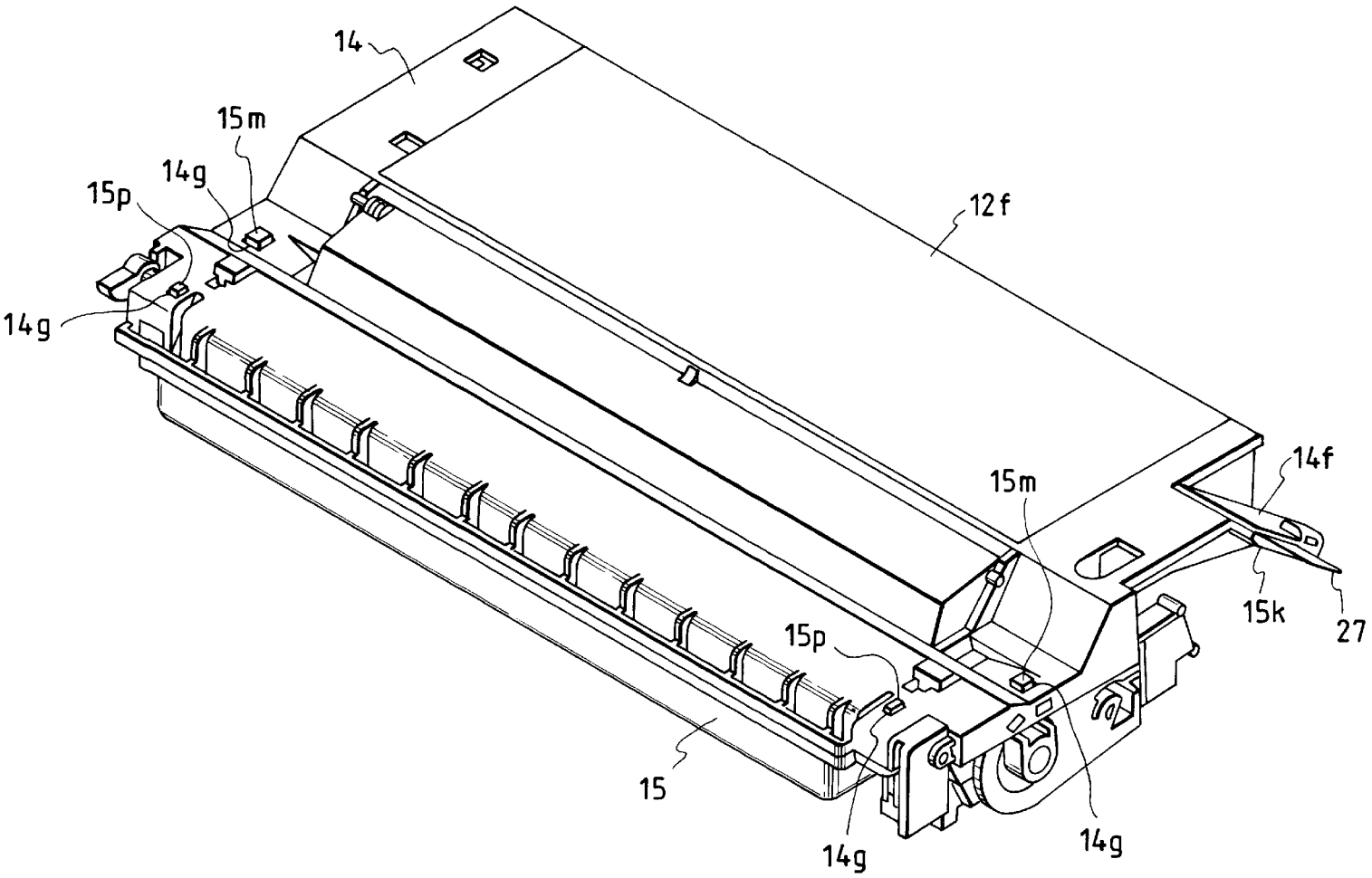
FIG. 5 is a perspective view of the process cartridge.
Figure 6:
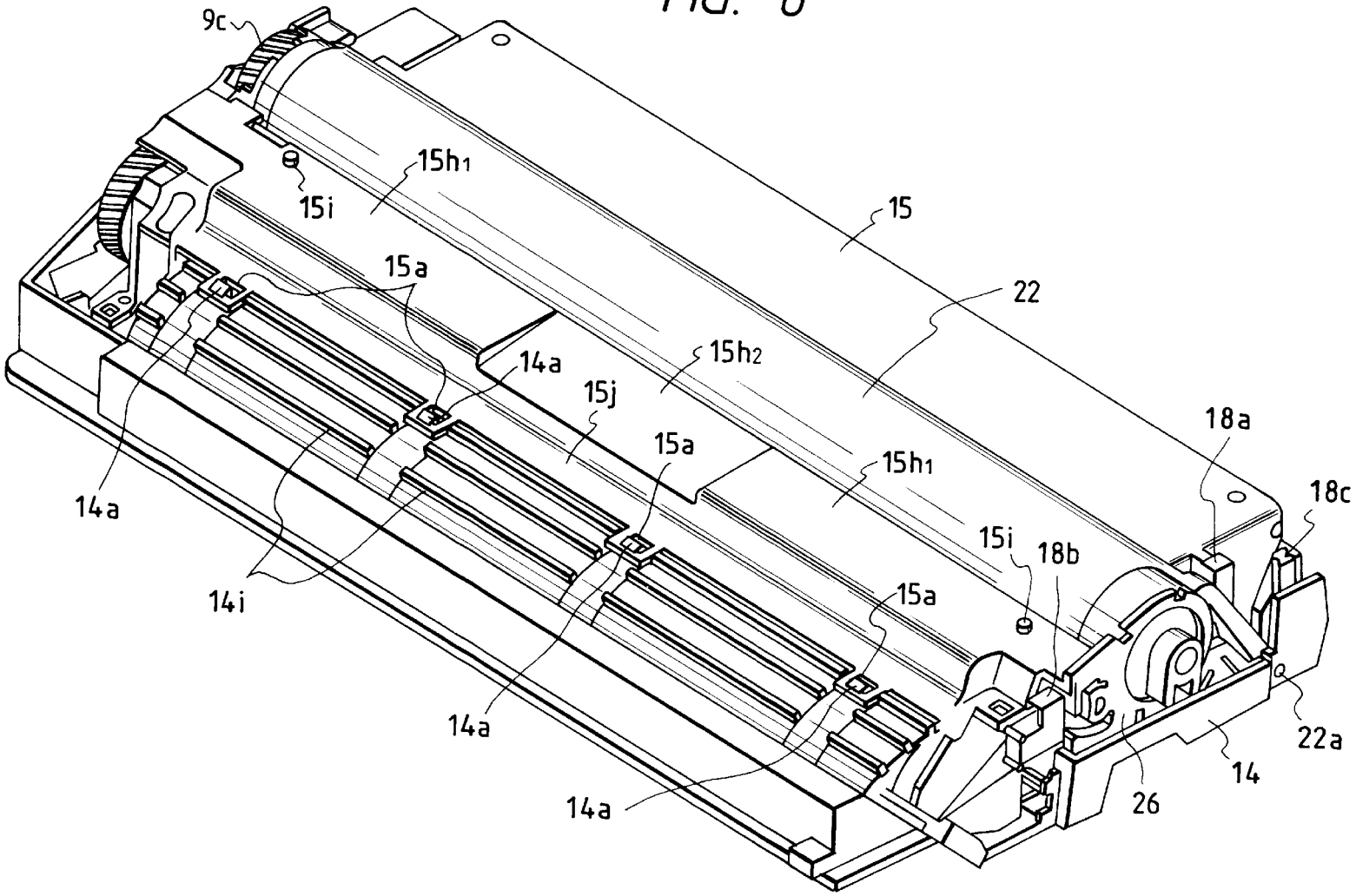
FIG. 6 is a perspective view of the process cartridge in an inverted condition.

The Whole Construction of a Process Cartridge and an Image Forming System Mounting the Process Cartridge thereon First of all, the whole construction of the image forming system will briefly be described. Incidentally, FIG. 1 is an elevational sectional view of a copying machine as an example of the image forming system, within which the process cartridge is mounted, FIG. 2 is a perspective view of the copying machine with a tray opened, FIG. 3 is a perspective view of the copying machine with the tray closed, FIG. 4 is an elevational sectional view of the process cartridge, FIG. 5 is a perspective view of the process cartridge, and FIG. 6 is a perspective view of the process cartridge in an inverted condition.

Figure 1:
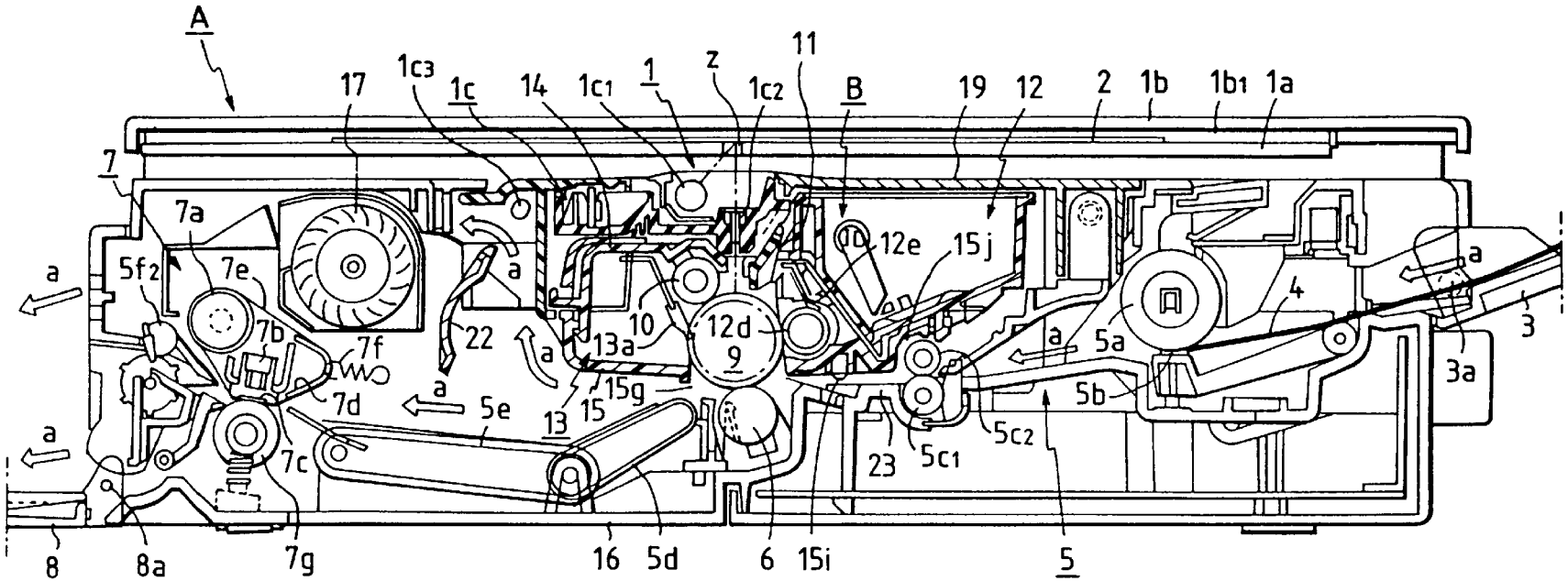
FIG. 1 is an elevational sectional view of a copying machine within which a process cartridge according to a preferred embodiment of the present invention is mounted.

As shown in FIG. 1, the image forming system A operates to optically read image information on an original or document 2 by an original reading means 1. A recording medium resting on a sheet supply tray 3 or manually inserted from the sheet supply tray 3 is fed, by a feeding means 5, to an image forming station of the process cartridge B, where a developer (referred to as "toner" hereinafter) image formed in response to the image information is transferred onto the recording medium 4 by a transfer means 6. Thereafter, the recording medium 4 is sent to a fixing means 7 where the transferred toner image is permanently fixed to the recording medium 4. Then, the recording medium is ejected onto an ejection tray 8.

The process cartridge B defining the image forming station operates to uniformly charge a surface of a rotating photosensitive drum (image bearing member) 9 by a charger means 10, then to form a latent image on the photosensitive drum 9 by illuminating a light image read by the reading means 1 on the photosensitive drum by means of an exposure means 11, and then to visualize the latent image as a toner image by a developing means 12. After the toner image is transferred onto the recording medium 4 by the transfer means 6, the residual toner remaining on the photosensitive drum 9 is removed by a cleaning means 13.

Incidentally, the process cartridge B is formed as a cartridge unit by housing the photosensitive drum 9 and the like within frames which include a first or upper frame 14 and a second or lower frame 15. Further, in the illustrated embodiment, the frames 14, 15 are made of high impact styrol resin (HIPS), and a thickness of the upper frame 14 is about 2 mm and a thickness of the lower frame 15 is about 2.5 mm. However, material and thickness of the frames are not limited to the above, but may be selected appropriately.

Next, various parts of the image forming system A and the process cartridge B mountable within the image forming system will be fully described.

Image Forming System

First of all, various parts of the image forming system A will be explained.

(Original Reading Means)

The original reading means 1 serves to optically read the information written on the original, and, as shown in FIG. 1, includes an original glass support 1*a* which is disposed at an upper portion of a body 16 of the image forming system and on which the original 2 is to be rested. An original hold-down plate 1*b* having a sponge layer 1*b*1 on its inner surface is attached to the original glass support 1*a* for opening and closing movement. The original glass support 1*a* and the original hold-down plate 1*b* are mounted on the system body 16 for reciprocal sliding movement in the left and right directions as viewed in FIG. 1. On the other hand, a lens unit 1*c* is disposed below the original glass support 1*a* at the upper portion of the system body 16 and includes a light source 1*c*1 and a short focus focusing lens array 1*c*2 therein.

With this arrangement, when the original 2 is rested on the original glass support la with an image surface thereof faced to the downside and the light source 1*c*1 is activated and the original glass support 1*a* is slid in the left and right direction as viewed in FIG. 1, the photosensitive drum 9 of the process cartridge B is exposed by reflection light from the original 2 via the lens array 1*c*2.

(Recording Medium Feeding Means)

The feeding means 5 serves to feed the recording medium 4 rested on the sheet supply tray 3 to the image forming station and to feed the recording medium to the fixing means 7. More particularly, after a plurality of recording media 4 are stacked on the sheet supply tray 3 or a single recording medium 4 is manually inserted on the sheet supply tray 3, and leading end(s) of the recording media or medium are abutted against a nip between a sheet supply roller 5*a* and a friction pad 5*b* urged against the roller, when a copy start button A3 is depressed, the sheet supply roller 5*a* is rotated to separate and feed the recording medium 4 to a pair of regist, or registration, rollers 5*c*1, 5*c*2 which, in turn, feed the recording medium in registration with the image forming operation. After the image forming operation, the recording medium 4 is fed to the fixing means 7 by a convey belt 5*d* and a guide member 5*e*, and then is ejected onto the ejection tray 8 by a pair of ejector rollers 5*f*1, 5*f*2.

(Transfer Means)

The transfer means 6 serves to transfer the toner image formed on the photosensitive drum 9 onto the recording medium 4 and, in the illustrated embodiment, as shown in FIG. 1, it comprises a transfer roller 6. More particularly, by urging the recording medium 4 against the photosensitive drum 9 in the process cartridge B mounted within the image forming system by means of the transfer roller 6 provided in the image forming system and by applying to the transfer roller 6 a voltage having the polarity opposite to that of the toner image formed on the photosensitive drum 9, the toner image on the photosensitive drum 9 is transferred onto the recording medium 4.

(Fixing Means)

The fixing means 7 serves to fix the toner image transferred to the recording medium 4 by applying the voltage to the transfer roller 6 and, as shown in FIG. 1, comprises a heat-resistive fixing film 7*e* wound around and extending between a driving roller 7*a*, a heating body 7*c* held by a holder 7*b* and a tension plate 7*d*. Incidentally, the tension plate 7*d* is biased by a tension spring 7*f* to apply a tension force to the film 7*e*. A pressure roller 7*g* is urged against the heating body 7*c* with the interposition of the film 7*e* so that the fixing film 7*e* is pressurized against the heating body 7*c* with a predetermined force required to the fixing operation.

The heating body 7*c* is made of heat-resistive material such as alumina and has a heat generating surface comprised of a wire-shaped or plate-shaped members having a width of about 160 $\mu$m and a length (dimension perpendicular to a plane of FIG. 1) of about 216 mm and made of $Ta_2N$ for example arranged on an under surface of the holder 7*b* made of insulation material or composite material including insulation, and a protection layer made of $Ta_2O$ for example and covering the heat generating surface. The lower surface of the heating body 7*c* is flat, and front and rear ends of the heating body are rounded to permit the sliding movement of the fixing film 7*e*. The fixing film 7*e* is made of heat-treated polyester and has a thickness of about 9 $\mu$m. The film can be rotated in a clockwise direction by the rotation of the driving roller 7*a*. When the recording medium 4 to which the toner image was transferred passes through an area between the fixing film 7*e* and the pressure roller 7*g*, the toner image is fixed to the recording medium 4 by heat and pressure.

Incidentally, in order to escape or discharge the heat generated by the fixing means 7 out of the image forming system, a cooling fan 17 is provided within the body 16 of the image forming system. The fan 17 is rotated, for example when the copy start button A3 (FIG. 2) is depressed, so as to generate an air flow a (FIG. 1) flowing into the image forming system from the recording medium supply inlet and flowing out from the recording medium ejecting outlet. The various parts including the process cartridge B are cooled by the air flows so that the heat does not remain in the image forming system.

(Recording Medium Supply and Ejection Trays)

As shown in FIGS. 1 to 3, the sheet supply tray 3 and the ejection tray 8 are mounted on shafts 3*a*, 8*a*, respectively within the system body 16 for pivotal movements in directions b in FIG. 2, and for pivotal movements around shafts 3*b*, 8*b* in directions c in FIG. 2. Locking projections 3*c*, 8*c* are formed on free ends of the trays 3, 8 at both sides thereof, respectively. These projections can be fitted into locking recesses 1*b*2 formed in an upper surface of the original hold-down plate 1*b*. Thus, as shown in FIG. 3, when the trays 3, 8 are folded inwardly to fit the locking projections 3*c*, 8*c* into the corresponding recesses 1*b*2, the original glass support 1*a* and the original hold-down plate 1*b* are prevented from sliding in the left and right directions. As a result, an operator can easily lift the image forming system A via grippers 16*a* and transport it.

(Setting Buttons for Density and the like)

Incidentally, setting buttons for setting the density and the like are provided on the image forming system A. Briefly explaining, in FIG. 2, a power switch A1 is provided to turn ON and OFF the image forming system. A density adjusting dial A2 is used to adjust the fundamental density (of the copied image) of the image forming system. The copy start button A3, when depressed, starts the copying operation of the image forming system. A copy clear button A4, when depressed, interrupts the copying operation and clears the various setting conditions (for example, the set density condition). A copy number counter button A5 serves to set the number of copies when depressed. An automatic density setting button A6, when depressed, automatically sets the density in the copying operation. A density setting dial A7 is provided so that the operator can adjust the copy density by rotating this dial at need.

Process Cartridge

Next, various parts of the process cartridge B which can be mounted within the image forming system A will be explained.

The process cartridge B includes an image bearing member and at least one process means. For example, the process means may comprise a charge means for charging a surface of the image bearing member, a developing means for forming a toner image on the image bearing member and/or a cleaning means for removing the residual toner remaining on the image bearing member. As shown in FIGS. 1 and 4, in the illustrated embodiment, the process cartridge B is constituted as a cartridge unit which can be removably mounted within the body 16 of the image forming system, by enclosing the charger means 10, the developing means 12 containing the toner (developer) and the cleaning means 13 which are arranged around the photosensitive drum 9 as the image bearing member by a housing comprising the upper and lower frames 14, 15. The charger means 10, exposure means 11 (opening 11*a*) and toner reservoir 12*a* of the developing means 12 are disposed within the upper frame 14, and the photosensitive drum 9, developing sleeve 12*d* of the developing means 12 and cleaning means 13 are disposed within the lower frame 15.

Figure 7:
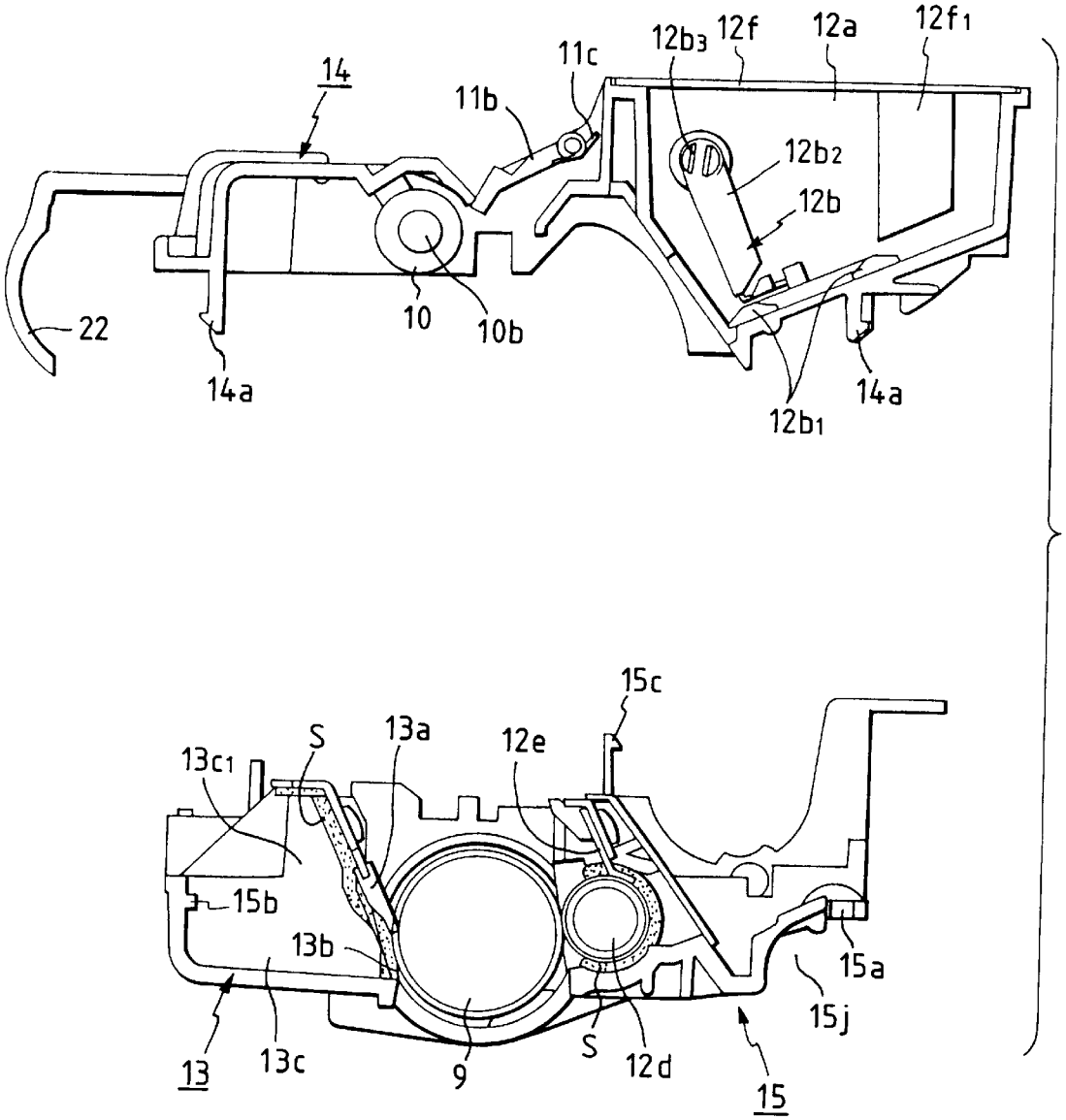
FIG. 7 is an exploded sectional view of the process cartridge in a condition that an upper frame and a lower frame are separated.
Figure 8:
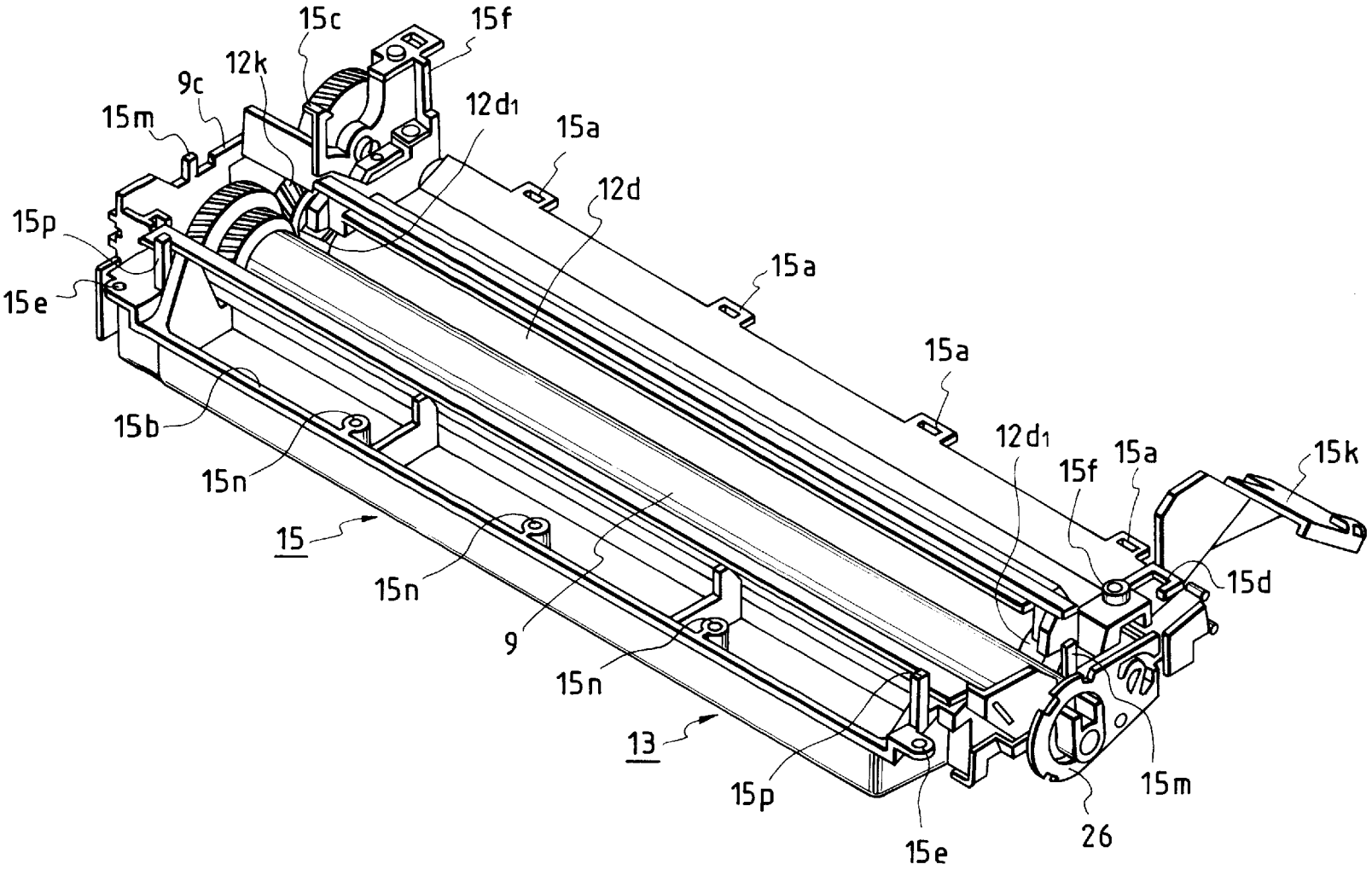
FIG. 8 is a perspective view of the lower frame showing an internal structure thereof.
Figure 9:
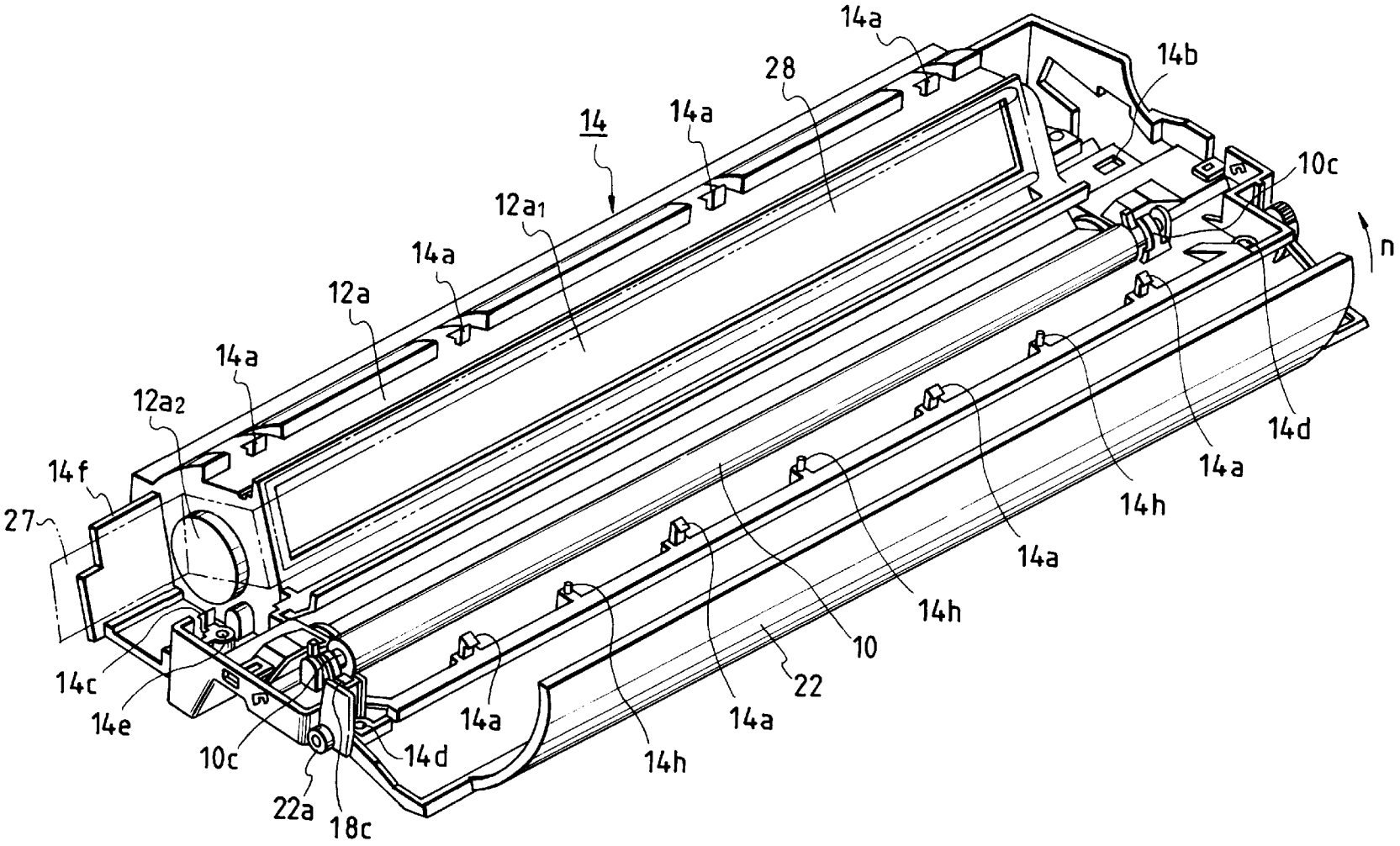
FIG. 9 is a perspective view of the upper frame showing an internal structure thereof.

Now, the various parts of the process cartridge B will be fully described regarding the charger means 11, exposure Means 11, developing means 12 and cleaning means 13 in order. Incidentally, FIG. 7 is a sectional view of the process cartridge with the upper and lower frames separated from each other, FIG. 8 is a perspective view showing the internal construction of the lower frame, and FIG. 9 is a perspective view showing the internal construction of the upper frame.

(Photosensitive Drum)

In the illustrated embodiment, the photosensitive drum 9 comprises a cylindrical drum core 9*a* having a thickness of about 1 mm and made of aluminium, and an organic photosensitive layer 9*b* disposed on an outer peripheral surface of the drum core, so that an outer diameter of the photosensitive drum 9 becomes 24 mm. The photosensitive drum 9 is rotated in a direction shown by the arrow in response to the image forming operation, by transmitting a driving force of a drive motor 54 (FIG. 56) of the image forming system to a flange gear 9*c* (FIG. 8) secured to one end of the photosensitive drum 9.

During the image forming operation, when the photosensitive drum 9 is being rotated, the surface of the photosensitive drum 9 is uniformly charged by applying to the charger roller 10 (contacting with the drum 9) a vibrating voltage obtained by overlapping a DC voltage with an AC voltage. In this case, in order to uniformly charge the surface of the photosensitive drum 9, the frequency of the AC voltage applied to the charger roller 10 must be increased. However, if the frequency exceeds about 2000 Hz, the photosensitive drum 9 and the charger roller 10 will be vibrated, thus generating the so-called "charging noise".

That is to say, when the AC voltage is applied to the charger roller 10, an electrostatic attraction force is generated between the photosensitive drum 9 and the charger roller 10, so that the attraction force becomes maximum at the maximum and minimum values of the AC voltage, thus attracting the charger roller 10 against the photosensitive drum 9 while elastically deforming the charger roller. On the other hand, at an intermediate value of the AC voltage, the attraction force becomes minimum, with the result that the elastical deformation of the charger roller 10 is restored to try to separate the charger roller 10 from the photosensitive drum 9. Consequently, the photosensitive drum 9 and the charger roller 10 are vibrated at the frequency twice as that of the applied AC voltage. Further, when the charger roller 10 is attracted against the photosensitive drum 9, the rotations of the drum and the roller are braked, thus causing the vibration due to stick slip, which also results in the charging noise.

Figure 10:
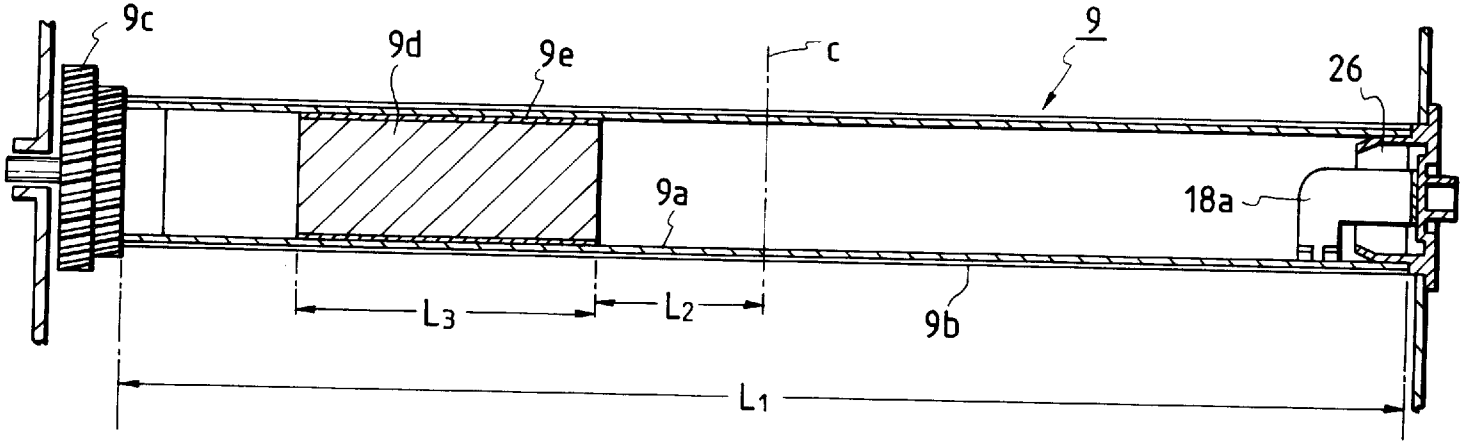
FIG. 10 is a longitudinal sectional view of a photosensitive drum of the process cartridge.

In order to reduce the vibration of the photosensitive drum 9, in the illustrated embodiment, as shown in FIG. 10 (sectional view of the drum), a rigid or elastic filler 9*d* is disposed within the photosensitive drum 9. The filler 9*d* may be made of metal such as aluminium, brass or the like, cement, ceramics such as gypsum, or rubber material such as natural rubber, in consideration of the productivity, workability, effect of weight and cost. The filler 9*d* has a solid cylindrical shape or a hollow cylindrical shape, and has an outer diameter smaller than an inner diameter of the photosensitive drum 9 by about 100 $\mu$m, and is inserted into the drum core 9*a*. That is to say, a gap between the drum core 9*a* and the filler 9*d* is set to have a value of 100 $\mu$m at the maximum, and an adhesive (for example, cyanoacrylate resin, epoxy resin or the like) 9*e* is applied on the outer surface of the filler 9*d* or on the inner surface of the drum core 9*a*, and the filler 9*d* is inserted into the drum core 9*a*, thus adhering them to each other.

Figure 11:
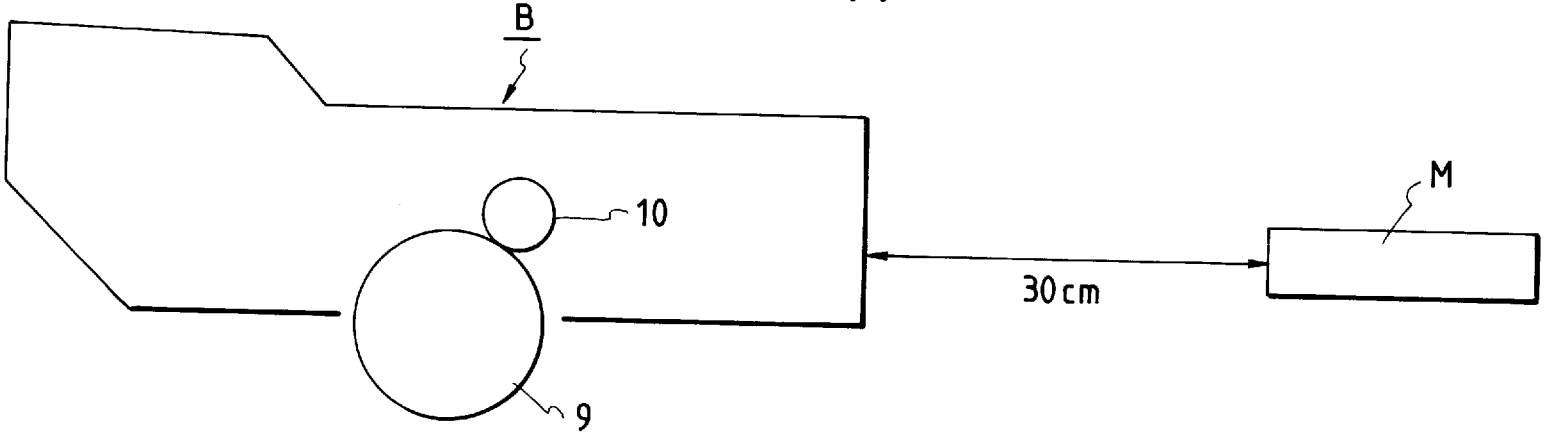
FIG. 11 is a schematic view for explaining the measurement of the charging noise.
Figure 12:
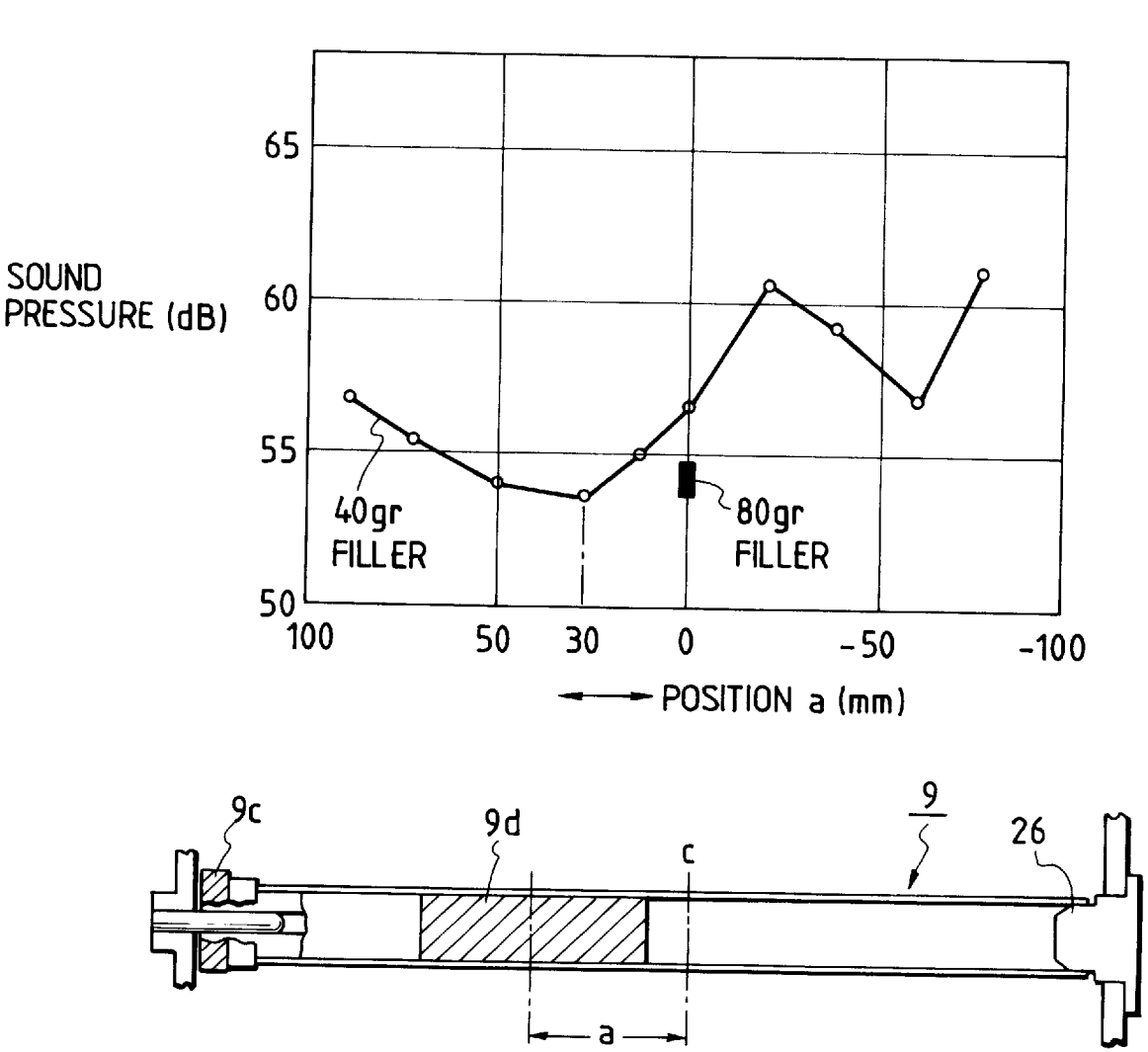
FIG. 12 is a graph showing the result of the measurement of the charging noise regarding a position of a filler.

Now, the test results performed by the inventors, wherein the relation between the position of the filler 9*d* and the noise pressure (noise level) was checked by varying the position of the filler 9*d* in the photosensitive drum 9 will be explained. As shown in FIG. 11, the noise pressure was measured by a microphone M arranged at a distance of 30 cm from the front surface of the process cartridge B disposed in a room having the background noise of 43 dB. As result, as shown in FIG. 12, when the filler having a weight of 80 grams was arranged, at a central position in the longitudinal direction of the photosensitive drum 9, the noise pressure was 54.5–54.8 dB. Whereas, when the filler having a weight of 40 grams was arranged at a position offset from the central position toward the flange gear 9*c* by 30 mm, the noise pressure was minimum. From this result, it was found that it was more effective to arrange the filler 9*d* in the photosensitive drum 9 offset from the central position toward the gear flange 9*c*. The reason seems to be that one end of the photosensitive drum 9 is supported via the flange gear 9*c* while the other end of the drum 9 is supported by a bearing member 26 having no flange, so that the construction of the photosensitive drum 9 is not symmetrical with respect the central position in the longitudinal direction of the drum.

Thus, in the illustrated embodiment, as shown in FIG. 10, the filler 9*d* is arranged in the photosensitive drum 9 offset from the central position c (in the longitudinal direction of the drum) toward the flange gear 9*c*, i.e., toward the drive transmission mechanism to the photosensitive drum 9. Incidentally, in the illustrated embodiment, a filler 9*d* comprising a hollow aluminium member having a length L3 of 40 mm and a weight of about 20–60 grams, preferably 35–45 grams (most preferably about 40 grams) is positioned within the photosensitive drum 9 having a longitudinal length L1 of 257 mm at a position offset from the central position c toward the flange gear 9*c* by a distance L2 of 9 mm. By arranging the filler 9*d* within the photosensitive drum 9, the photosensitive drum can be rotated stably, thus suppressing the vibration due to the rotation of the photosensitive drum 9 in the image forming operation. Therefore, even when the frequency of the AC voltage applied to the charger roller 10 is increased, it is possible to reduce the charging noise.

Further, in the illustrated embodiment, as shown in FIG. 10, an earthing contact 18*a* is contacted with the inner surface of the photosensitive drum 9 and the other end of the earthing contact is abutted against a drum earth contact pin 35*a*, thereby electrically earthing the photosensitive drum 9. The earthing contact 18*a* is arranged at the end of the photosensitive drum opposite to the end adjacent to the flange gear 9*c*.

Figure 13:
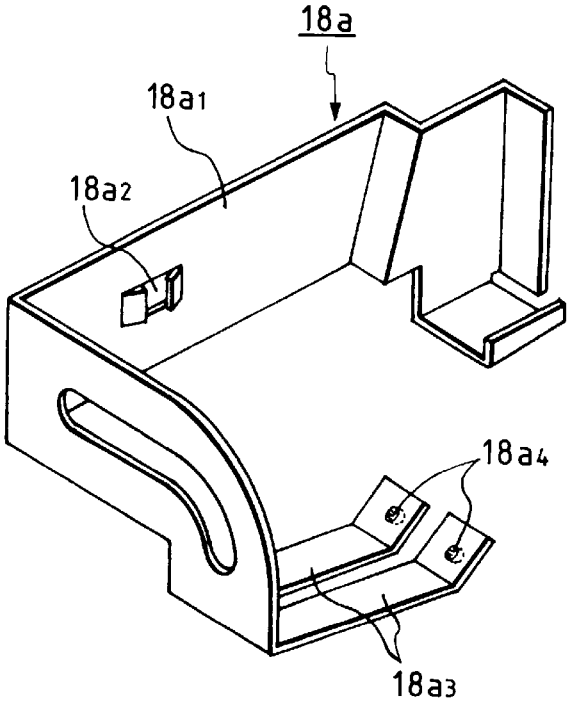
FIG. 13 is a perspective view of an earthing contact for the photosensitive drum.

The earthing contact 18*a* is made of spring stainless steel, spring bronze phosphate or the like and is attached to the bearing member 26. More particularly, as shown in FIG. 13, the earthing contact comprises a base portion 18*a*1 having a locking opening 18*a*2 into which a boss formed on the bearing member 26 can be fitted, and two arm portions 18*a*3 extending from the base portion 18*a*1, each arm portion being provided at its free end with a semi-circular projection 18*a*4 protruding downwardly. When the bearing member 26 is attached to the photosensitive drum 9, the projections 18*a*4 of the earthing contact 18*a* are urged against the inner surface of the photosensitive drum 9 by the elastic force of the arm portions 18*a*3. In this case, since the earthing contact 18*a* is contacted with the photosensitive drum at plural points (two points), the reliability of the contact is improved, and, since the earthing contact 18*a* is contacted with the photosensitive drum via the semi-circular projections 18*a*4, the contact between the earthing contact and the photosensitive drum 9 is stabilized.

Figure 14:
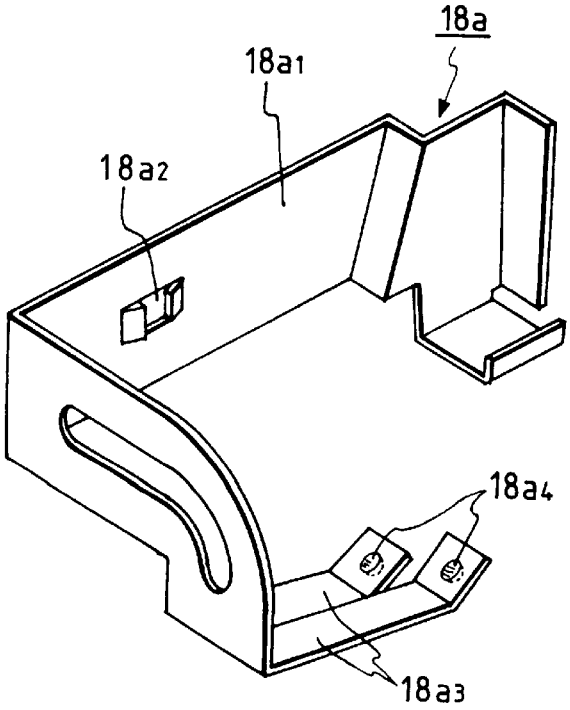
FIG. 14 is a perspective view of an earthing contact for the photosensitive drum, according to another embodiment.

Incidentally, as shown in FIG. 14, lengths of the arm portions 18*a*3 of the earthing contact 18*a* may be differentiated from each other. With this arrangement, since positions where the semi-circular projections 18*a*4 are contacted with the photosensitive drum 9 are offset from each other in the circumferential direction of the drum, even if there is a cracked portion extending in the axial direction in the inner surface of the photosensitive drum 9, both projections 18*a*4 do not contact with such cracked portion simultaneously, thereby maintaining the earthing contact (between the contact and the drum) without fail. Incidentally, when the lengths of the arm portions 18*a*3 are differentiated, the contacting pressure between one of the arm portions 18*a*3 and the photosensitive drum is differentiated from the contacting pressure between the other arm portion and the drum. However, such difference can be compensated, for example, by changing the bending angles of the arm portions 18*a*3.

Figure 15:
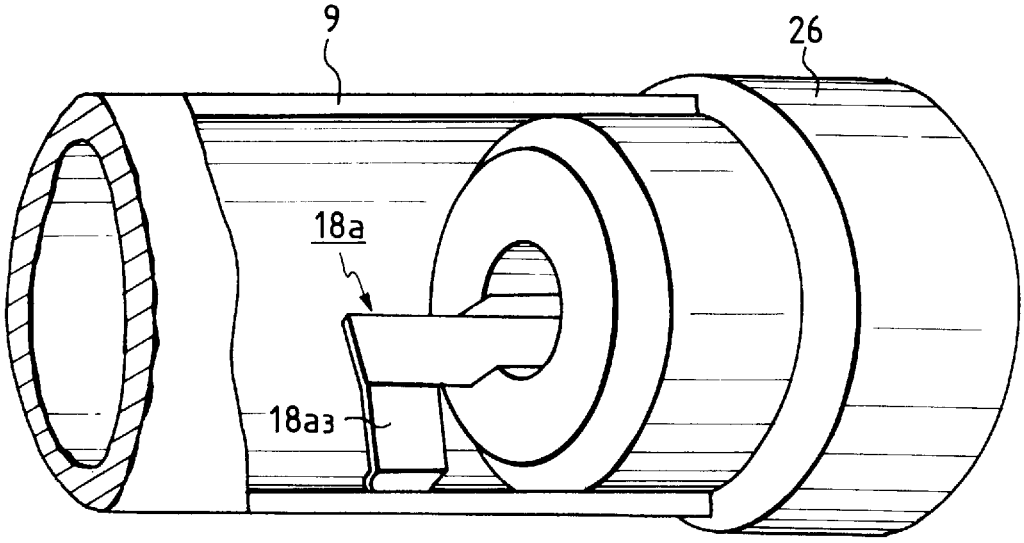
FIG. 15 is a perspective view showing an embodiment wherein an earthing contact which is not bifurcated is used with the photosensitive drum.
Figure 16:
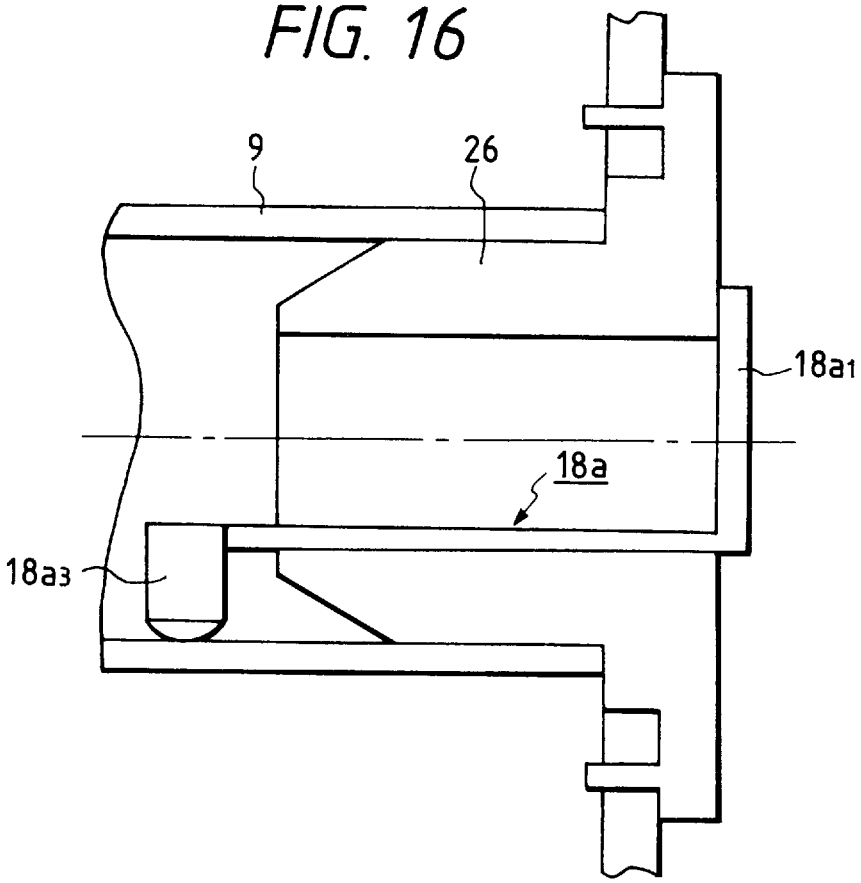
FIG. 16 is a sectional view of the non-bifurcated earthing contact used with the photosensitive drum.

In the illustrated embodiment, while the earthing contact 18*a* had two arm portions 18*a*3 as mentioned above, three or more arm portions may be provided, or, when the earthing contact is contacted with the inner surface of the photosensitive drum 9 without fail, a single arm portion 18*a*3 (not bifurcated) having no projection may be used, as shown in FIGS. 15 and 16.

Now, if the contacting pressure between the earthing contact 18*a* and the inner surface of the photosensitive drum 9 is too weak, the semi-circular projections 18*a*4 cannot follow the unevenness of the inner surface of the photosensitive drum, thus causing the poor contact between the earthing contact and the photosensitive drum and generating the noise due to the vibration of the arm portions 18*a*3. In order to prevent such poor contact and noise, the contacting pressure must be increased. However, if the contacting pressure is too strong, when the image forming system is used for a long time, the inner surface of the photosensitive drum will be damaged by the high pressure of the semi-circular projections 18*a*4. Consequently, when the semi-circular projections 18*a*4 pass through such damaged portion, the vibration occurs, thus causing the poor contact and the vibration noise. In consideration of the above affairs, it is preferable that the contacting pressure between the earthing contact 18*a* and the inner surface of the photosensitive drum is set in a range between about 10 grams and about 200 grams. That is to say, according to the test result effected by the inventors, when the contacting pressure was smaller than about 10 grams, it was feared that the poor contact was likely to occur in response to the rotation of the photosensitive drum, thus causing the radio wave jamming regarding other electronic equipments. On the other hand, when the contacting pressure was greater than about 200 grams, it was feared that the inner surface of the photosensitive drum 9 would be damaged due to the sliding contact between the drum inner surface and the earthing contact 18*a* for a long time, thus causing the abnormal noise and/or poor contact.

Incidentally, although the generation of the above noise and the like sometimes cannot be eliminated completely because of the inner surface condition of the photosensitive drum, it is possible to reduce the vibration of the photosensitive drum 9 by arranging the filler 9*d* within the drum 9, and it is also possible to prevent the damage of the drum and the poor contact more effectively by disposing the conductive grease on the contacting area between the earthing contact 18*a* and the inner surface of the photosensitive drum 9. Further, since the earthing contact 18*a* is positioned on the bearing member 26 such that it is situated remote from the filler 9*d* offset toward the flange gear 9*c*, the earthing contact can easily be attached to the bearing member.

(Charger Means)

The charger means serves to charge the surface of the photosensitive drum 9. In the illustrated embodiment, the charger means is of a so-called contact charging type as disclosed in the Japanese Patent Laid-open Appln. No. 63-149669. More specifically, as shown in FIG. 4, the charger roller 10 is rotatably mounted on the inner surface of the upper frame 14 via a slide bearing 10*c*. The charger roller 10 comprises a metallic roller shaft 10*b* (for example, a conductive metal core made of iron, SUS or the like), an elastic rubber layer made of EPDM, NBR or the like and arranged around the roller shaft, and a urethane rubber layer having carbon dispersed therein and arranged around the elastic rubber layer, or the charger roller 10 comprises a metallic roller shaft and a foam urethane rubber layer having carbon dispersed therein. The roller shaft 10*b* of the charger roller 10 is held by bearing slide guide pawls 10*d* of the upper frame 14 via the slide bearing 10*c* so that it cannot become detached from the upper frame and it can slightly be moved toward the photosensitive drum 9. The roller shaft 10*b* is biased by a spring 10*a* so that the charger roller 10 is urged against the surface of the photosensitive drum 9. Thus, the charger means is constituted by the charger roller 10 incorporated into the upper frame 14 via the bearing 10*c*. In the image forming operation, when the charger roller 10 is driven by the rotation of the photosensitive drum 9, the surface of the photosensitive drum 9 is uniformly charged by applying the overlapped DC and AC voltage to the charger roller 10 as mentioned above.

Now, the voltage applied to the charger roller 10 will be described. Although the voltage applied to the charger roller 10 may be the DC voltage alone, in order to achieve the uniform charging, the vibration voltage obtained by overlapping the DC voltage and the AC voltage as mentioned above should be applied to the charger roller. Preferably, the vibration voltage obtained by overlapping the DC voltage having the peak-to-peak voltage value greater, by twice or more, than the charging start voltage when the DC voltage alone is used, and the AC voltage is applied to the charger roller 10 to improve the uniform charging (refer to the Japanese Patent Laid-open Appln. No. 63-149669). The "vibration voltage" described herein means a voltage such that the voltage value is periodically changed as a function of time and that preferably has the peak-to-peak voltage greater, by twice or more, than the charging start voltage when the surface of the photosensitive drum is charged only by the DC voltage. Further, the wave form of the vibration voltage is not limited to a sinusoidal wave, but may be a rectangular wave, triangular wave or pulse wave. However, the sinusoidal wave not including the higher harmonic component is preferable in view of the reduction of the charging noise. The DC voltage may include a voltage having a rectangular wave obtained by periodically turning ON/OFF a DC voltage source, for example.

Figure 17:
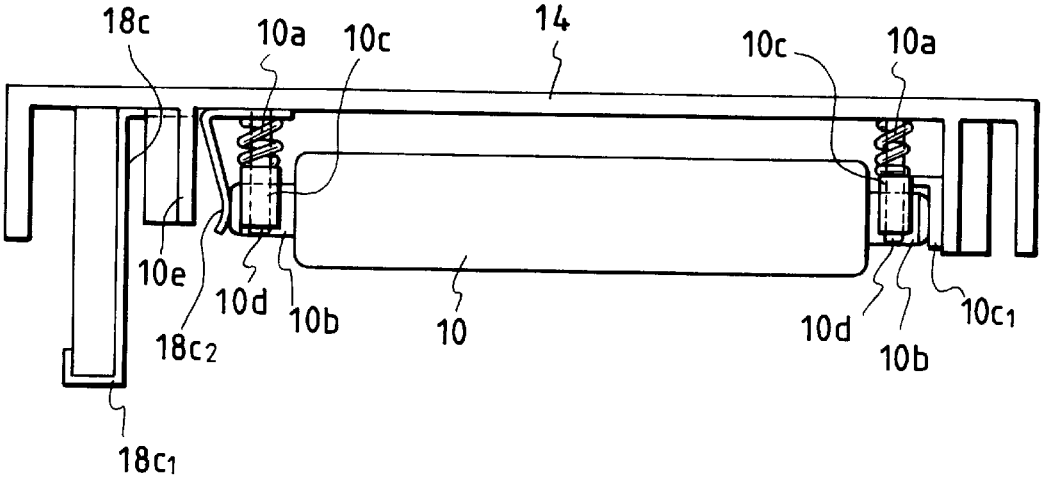
FIG. 17 is an elevational view showing an attachment structure for a charger roller.

As shown in FIG. 17, the application of the voltage to the charger roller 10 is accomplished by urging one end 18*c*1 of a charging bias contact 18*c* against a charging bias contact pin of the image forming system as will be described later, and the other end 18*c*2 of the charging bias contact 18*c* is urged against the metallic roller shaft 10*b*, thereby applying the voltage to the charger roller 10. Incidentally, since the charger roller 10 is biased by the elastic contact 18*c* toward the right as viewed in FIG. 17, the charger roller bearing 10*c* disposed remote from the contact 18*c* has a hooked stopper portion 10*c*1. Further, a stopper portion 10e depending from the upper frame 14 is arranged near the contact 18*c* in order to prevent the excessive axial movement of the charger roller 10 when the process cartridge B is dropped or vibrated.

In the illustrated embodiment, with the arrangement as mentioned above, the voltage of 1.6–2.4 KVVpp, −600 $VV_{DC}$ (sinusoidal wave) is applied to the charger roller 10.

When the charger roller 10 is incorporated into the upper frame 14, first of all, the bearing 10*c* is supported by the guide pawls 10*d* of the upper frame 14 and then the roller shaft 10*b* of the charger roller 10 is fitted into the bearing 10*c*. And, when the upper frame 14 is assembled with the lower frame 15, the charger roller 10 is urged against the photosensitive drum 9, as shown in FIG. 4.

Incidentally, the bearing 10*c* for the charger roller 10 is made of conductive bearing material including a great amount of carbon filler, and the voltage is applied to the charger roller 10 from the charging bias contact 18*c* via the metallic spring 10*a* so that the stable charging bias can be supplied.

(Exposure Means)

The exposure means 11 serves to expose the surface of the photosensitive drum 9 which has been uniformly charged by the charger roller 10 with a light image from the reading means 1. As shown in FIGS. 1 and 4, the upper frame 14 is provided with an opening 11*a* through which the light from the lens array 1*c*2 of the image forming system is illuminated onto the photosensitive drum 9. Incidentally, when the process cartridge B is removed from the image forming system A, if the photosensitive drum 9 is exposed by the ambient light through the opening 11*a*, it is feared that the photosensitive drum may be deteriorated. To avoid this, a shutter member 11*b* is attached to the opening 11*a* so that when the process cartridge B is removed from the image forming system A the opening 11*a* is closed by the shutter member 11*b* and when the process cartridge is mounted within the image forming system the shutter member opens the opening 11*a*.

Figure 18A:
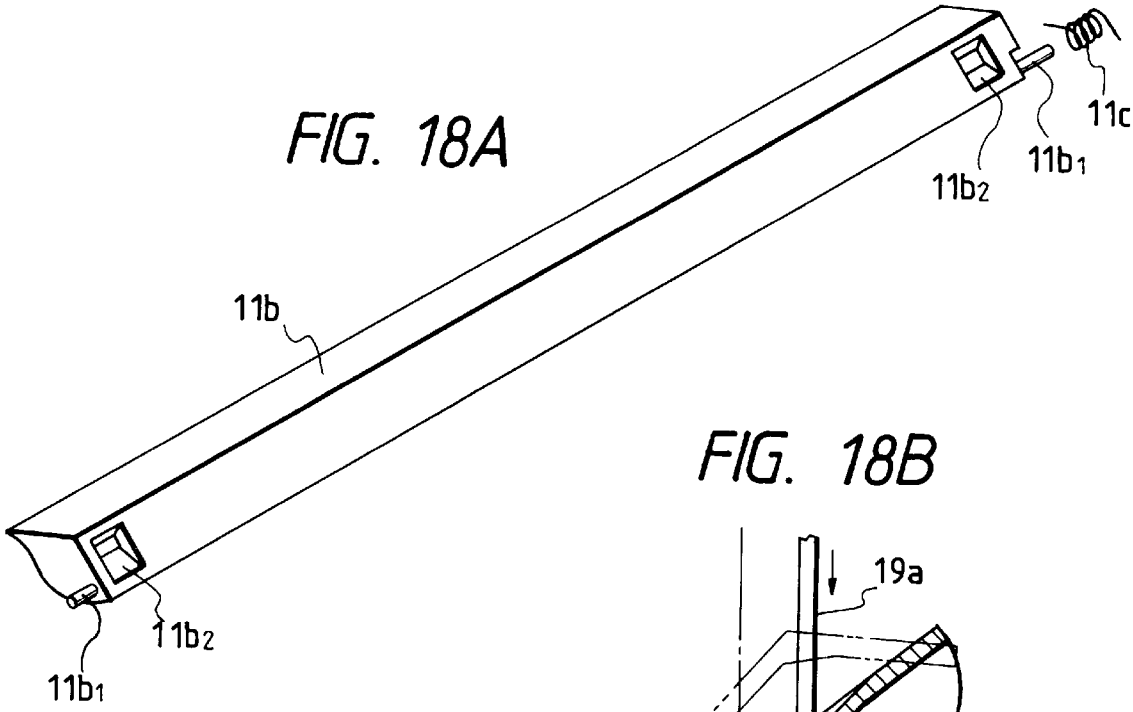
FIG. 18A is a perspective view of an exposure shutter.
Figure 18B:
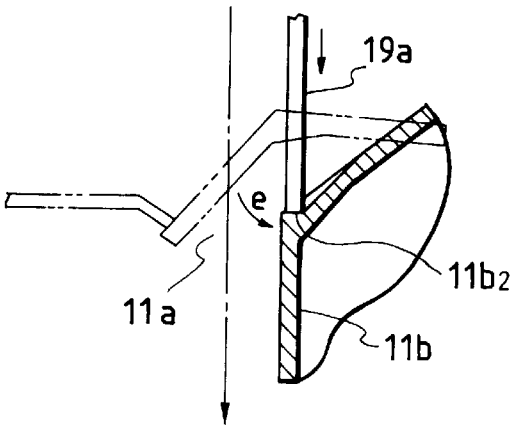
FIG. 18B is a partial sectional view of the exposure shutter.

As shown in FIGS. 18A and 18B, the shutter member 11*b* has an L-shaped cross-section having a convex portion directed toward the outside of the cartridge, and is pivotally mounted on the upper frame 14 via pins 11*b*1. A torsion coil spring 11*c* is mounted around one of the pins 11*b*1 so that the shutter member 11*b* is biased by the coil spring 11*c* to close the opening 11*a* in a condition that the process cartridge B is dismounted from the image forming system A.

As shown in FIG. 18A, abutment portions 11*b*2 are formed on the outer surface of the shutter member 11*b* so that, when the process cartridge B is mounted within the image forming system A and an upper opening/closing cover 19 (FIG. 1), which is openable with respect to the body 16 of the image forming system, is closed, a projection 19*a* formed on the cover 19 is abutted against the abutment portions 11*b*2, thereby rotating the shutter member 11*b* in a direction shown by the arrow e (FIG. 18B) to open the opening 11*a*.

In the opening and closing operation of the shutter member 11*b*, since the shutter member 11*b* has the L-shaped cross-section and the abutment portions 11*b*2 are disposed outwardly of the contour of the cartridge B and near the pivot pins 11*b*1, as shown in FIGS. 4 and 18B, the shutter member 11*b* is abutted against the projection 19*a* of the cover 19 outwardly of the contour of the process cartridge B. As a result, even when the opening and closing angle of the shutter member 11*b* is small, a leading end of the rotating shutter member 11*b* is surely opened, thereby surely illuminating the light from the lens array 1*c*2 disposed above the shutter member onto the photosensitive drum to form the good electrostatic latent image on the surface of the photosensitive drum 9. By constituting the shutter member 11*b* as mentioned above, when the process cartridge B is inserted into the image forming system, it is not necessary to retard the cartridge B from the shutter opening projection 19*a* of the cover 19 of the image forming system, with the result that it is possible to shorten the stroke of the projection, thereby making the process cartridge B and the image forming system A small-sized.

(Developing Means)

Next, the developing means 12 will be explained. The developing means 12 serves to visualize the electrostatic latent image formed on the photosensitive drum 9 by the exposure means with toner as a toner image. Incidentally, in this image forming system A, although magnetic toner or non-magnetic toner can be used, in the illustrated embodiment, the developing means in the process cartridge B includes the magnetic toner as one-component magnetic developer.

Binder resin of the one-component magnetic toner used in the developing operation may be the following or a mixture of the following polymer of styrene or a substitute thereof such as polystyrene and polyvinyltoluene; styrene copolymer such as styrene-propylene copolymer, styrene-vinyltoluene copolymer, styrene-vinylnaphthalene copolymer, styrene-acrylic acid ethyl copolymer or styrene-acrylic acid butyl copolymer; polymetylmethacrylate, polybuthymethacrylate, polyvinylacetate, polyethylene, polypropylene, polyvinylbutyral, polycrylic acid resin, rosin, modified rosin, turpentine resin, phenolic resin, aliphatic hydrocarbon resin, alicyclic hydrocarbon resin, aromatic petroleum resin, paraffin wax, carnauba wax or the like.

As for the coloring material added to the magnetic toner it may be known carbon black, copper phthalocyanine, iron black or the like. The magnetic fine particles contained in the magnetic toner may be of the material magnetizable when placed in the magnetic field, such as ferromagnetic powder of metal such as iron, cobalt, and nickel, powder of metal alloy or powder of compound such as magnetite or ferrite.

As shown in FIG. 4, the developing means 12 for forming the toner image with the magnetic toner has a toner reservoir 12*a* for containing the toner, and a toner feed mechanism 12*b* disposed within the toner reservoir 12*a* and adapted to feed out the toner. Further, the developing means is so designed that the developing sleeve 12*d* having a magnet 12*c* therein is rotated to form a thin toner layer on a surface of the developing sleeve. When the toner layer is being formed on the developing sleeve 12*d*, the developable frictional charging charges are applied to the electrostatic latent image on the photosensitive drum 9 by the friction between the toner and the developing sleeve 12*d*. Further, in order to regulate a thickness of the toner layer, a developing blade 12*e* is urged against the surface of the developing sleeve 12*d*. The developing sleeve 12*d* is disposed in a confronting relation to the surface of the photosensitive drum 9 with a gap of about 100–400 $\mu$m therebetween.

As shown in FIG. 4, the magnetic toner feed mechanism 12*b* has feed members 12*b*1 made of polypropylene (PP), acrylobutadienestyrol (ABS), high-impact styrol (HIPS) or the like and is reciprocally shiftable in a direction shown by the arrows f along a bottom surface of the toner reservoir 12*a*. Each feed member 12*b*1 has a substantial triangular cross-section and is provided with a plurality of long rod members extending along the rotation axis of the photosensitive drum (direction perpendicular to the plane of FIG. 4) for scraping the whole bottom surface of the toner reservoir 12*a*. The rod members are interconnected at both of ends to form an integral structure. Further, there are three feed members 12*b*1, and the shifting range of the feed members are selected to be greater than a bottom width of the triangular cross-section so that all of the toner on the bottom surface of the toner reservoir can be scraped. In addition, an arm member 12*b*2 is provided at its free end with a projection 12*b*6, thereby preventing the feed members 12*b*1 from floating and being disordered.

The feed member 12*b*1 has a lock projection 12*b*4 at its one longitudinal end, which projection is rotatably fitted into a slot 12*b*5 formed in the arm member 12*b*2. The arm member 12*b*2 is rotatably mounted on the upper frame 14 via a shaft 12*b*3 and is connected to an arm (not shown) disposed outside the toner reservoir 12*a*. Further, a drive transmitting means is connected to the feed members 12*b*1 so that, when the process cartridge B is mounted within the image forming system A, the driving force from the image forming system is transmitted to the feed members to swing the arm member 12*b*2 around the shaft 12*b*3 by a predetermined angle. Incidentally, as shown in FIG. 7 and the like, the feed members 12*b*1 and the arm member 12*b*2 may be integrally formed from resin such as polypropylene, polyamide or the like so that they can be folded at a connecting portion therebetween.

Accordingly, in the image forming operation, when the arm member 12*b*2 is rocked by the predetermined angle, the feed members 12*b*1 are reciprocally shifted along the bottom surface of the toner reservoir 12*a* in directions f between a condition shown by the solid lines and a condition shown by the broken lines. Consequently, the toner situated near the bottom surface of the toner reservoir 12*a* is fed toward the developing sleeve 12*d* by the feed members 12*b*1. In this case, since each feed member 12*b*1 has a triangular cross-section, the toner is scraped by the feed members and is gently fed along inclined surfaces of the feed members 12*b*1. Thus, it is difficult to agitate the toner near the developing sleeve 12*d*, and, therefore, the toner layer formed on the surface of the developing sleeve 12*d* does not deteriorate easily.

Further, as shown in FIG. 4, a lid member 12*f* of the toner reservoir 12*a* is provided with a depending member 12*f*1. A distance between a lower end of the depending member 12*f*1 and the bottom surface of the toner reservoir is selected so as to be slightly greater than a height of the triangular cross-section of each toner feed member 12*b*1. Accordingly, the toner feed member 12*b*1 is reciprocally shifted between the bottom surface of the toner reservoir and the depending member 12*f*1, with the result that, if the feed member 12*b*1 tries to float from the bottom surface of the toner reservoir, such floating is limited or regulated, thus preventing the floating of the feed members 12*b*1.

Incidentally, the image forming system A according to the illustrated embodiment can also receive a process cartridge including the non-magnetic toner. In this case, the toner feed mechanism is driven to agitate the non-magentic toner near the developing sleeve 12*d*.

Figure 19:
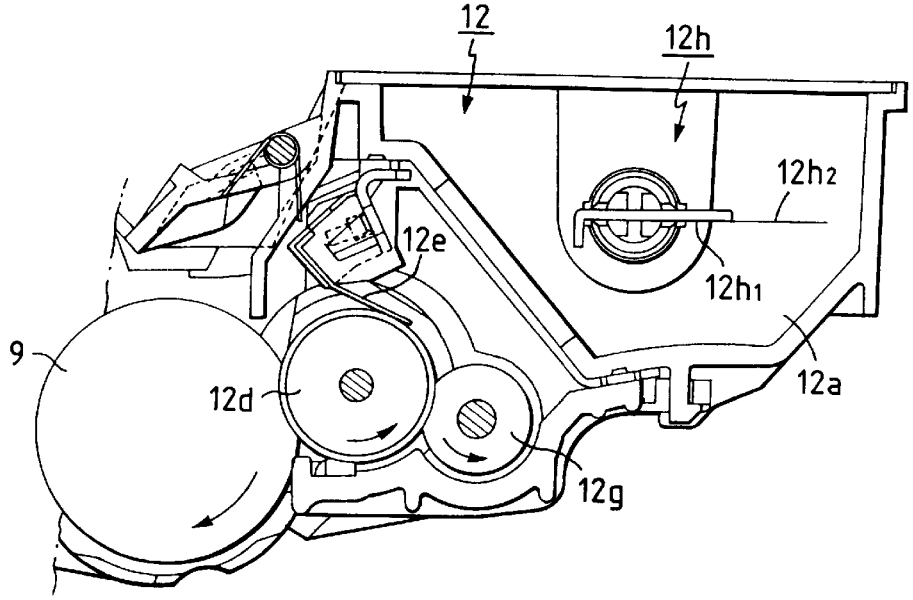
FIG. 19 is a sectional view showing a non-magnetic toner feeding mechanism having an agitating vane.

That is to say, when the non-magnetic toner is used, as shown in FIG. 19, an elastic roller 12*g* rotated in a direction the same as that of the developing sleeve 12*d* feeds the non-magnetic toner fed from the toner reservoir 12*a* by the toner feed mechanism 12*h* toward the developing sleeve 12*d*. In this case, at a nip between the developing sleeve 12*d* and the elastic roller 12*g*, the toner on the elastic roller 12*g* is frictionally charged by the sliding contact between the toner and the developing sleeve 12*d* to be adhered onto the developing sleeve 12*d* electrostatically. Thereafter, during the rotation of the developing sleeve 12*d*, the non-magnetic toner adhered to the developing sleeve 12*d* enters into an abutment area between the developing blade 12*e* and the developing sleeve 12*d* to form the thin toner layer on the developing sleeve, and the toner is frictionally charged by the sliding contact between the toner and the developing sleeve with the polarity sufficiently to develop the electrostatic latent image. However, when the toner remains on the developing sleeve 12*d*, the remaining toner is mixed with the new toner fed to the developing sleeve 12*d* and is fed to the abutment area between the developing sleeve and the developing blade 12*e*. The remaining toner and the new toner are frictionally charged by the sliding contact between the toner and the developing sleeve 12*d*. In this case, however, although the new toner is charged with the proper charge, since the remaining toner is further charged from the condition that it has already been properly charged, it becomes over-charged. The over-charged or excessively charged toner has an adhesion force (to the developing sleeve 12*d*) stronger than that of the properly charged toner, thus becoming harder to use in the developing operation.

To avoid this, in the illustrated embodiment, regarding the process cartridge containing the non-magnetic toner, as shown in FIG. 19, the non-magnetic toner feed mechanism 12*h* comprises a rotary member 12*h*1 disposed in the toner reservoir 12*a*, which rotary member 12*h*1 has an elastic agitating vane 12*h*2. When the non-magnetic toner cartridge is mounted within the image forming system A, the drive transmitting means is connected to the rotary member 12*h*1 so that the latter is rotated by the image forming system in the image forming operation. In this way, when the image is formed by using the cartridge containing the non-magnetic toner and mounted within the image forming system, the toner in the toner reservoir 12*a* is greatly agitated by the agitating vane 12*h*2. As a result, the toner near the developing sleeve 12*d* is also agitated to be mixed with the toner in the toner reservoir 12*a*, thereby dispersing the charges removed from the developing sleeve 12*d* in the toner within the toner reservoir to prevent the deterioration of the toner.

By the way, the developing sleeve 12*d* on which the toner layer is formed is arranged in a confronting relation to the photosensitive drum 9 with a small gap therebetween (about 300 μm regarding the process cartridge containing the magnetic toner, or about 200 μm regarding the process cartridge containing the non-magnetic toner). Accordingly, in the illustrated embodiment, abutment rings each having an outer diameter greater than that of the developing sleeve by an amount corresponding to the small gap are arranged in the vicinity of both axial ends of the developing sleeve 12*d* and outside the toner layer forming area so that these rings are abutted against the photosensitive drum 9 at zones outside the latent image forming area.

Figure 20:
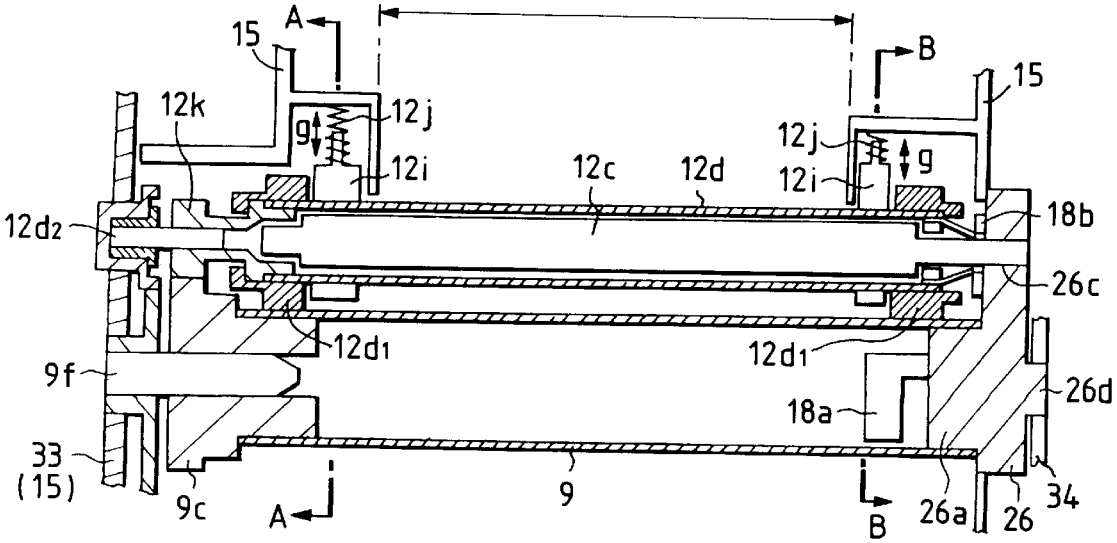
FIG. 20 is a longitudinal sectional view showing a positional relation between the photosensitive drum (9) and a developing sleeve (12*d*) and a structure for pressurizing the developing sleeve.
Figure 21A:
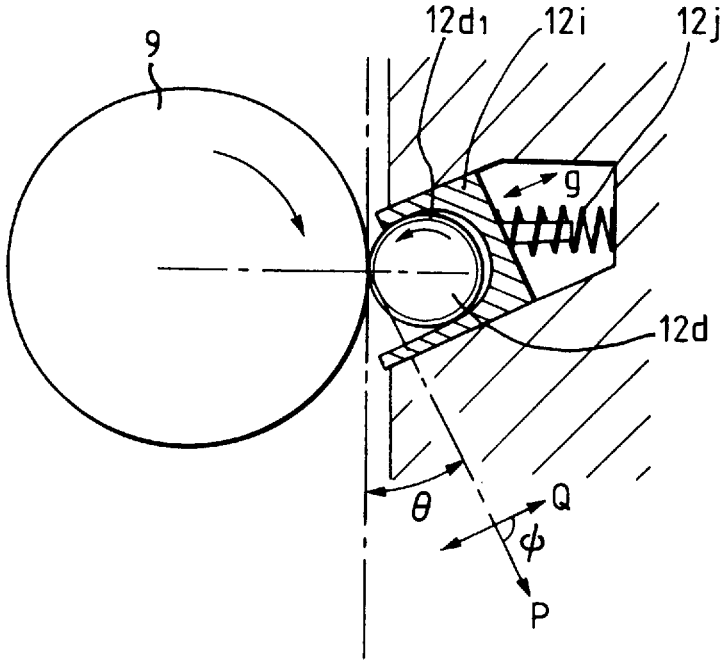
FIG. 21A is a sectional view taken along the line A—A of FIG. 20.
Figure 21B:
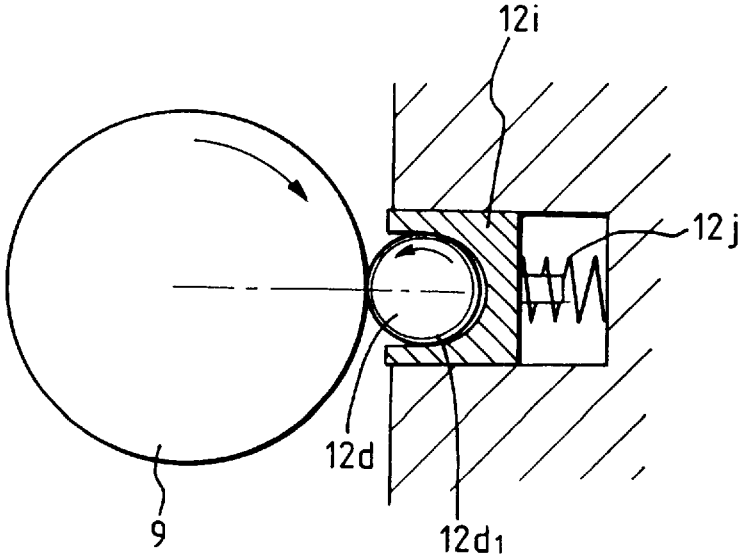
FIG. 21B is a sectional view taken along the line B—B of FIG. 20.

Now, the positional relation between the photosensitive drum 9 and the developing sleeve 12*d* will be explained. FIG. 20 is a longitudinal sectional view showing a positional relation between the photosensitive drum 9 and the developing sleeve 12*d* and a structure for pressurizing the developing sleeve, FIG. 21A is a sectional view taken along the line A—A of FIG. 20, and FIG. 21B is a sectional view taken along the line B—B of FIG. 20.

As shown in FIG. 20, the developing sleeve 12*d* on which the toner layer is formed is arranged in a confronting relation to the photosensitive drum 9 with the small gap therebetween (about 200–300 μm) In this case, the photosensitive drum 9 is rotatably mounted on the lower frame 15 by rotatably supporting a rotary shaft 9*f* of the flange gear 9*c* at the one end of the drum via a supporting member 33. The other end of the photosensitive drum 9 is also rotatably mounted on the lower frame 15 via a bearing portion 26*a* of the bearing member 26 secured to the lower frame. The developing sleeve 12*d* has the above-mentioned abutment rings 12*d*1 each having the outer diameter greater than that of the developing sleeve by the amount corresponding to the small gap and arranged in the vicinity of both axial ends of the developing sleeve and outside the toner layer forming area so that these rings are abutted against the photosensitive drum 9 at the zones outside the latent image forming area.

Further, the developing sleeve 12*d* is rotatably supported by sleeve bearings 12*i* disposed between the abutment rings 12*d*1 in the vicinity of both axial ends of the developing sleeve and outside the toner layer forming area. The sleeve bearings 12*i* are mounted on the lower frame 15 in such a manner that they can be slightly shifted in directions shown by the arrow g in FIG. 20. Each sleeve bearing 12*i* has a rearwardly extending projection around which an urging spring 12*j* having one end abutted against the lower frame 15 is mounted. Consequently, the developing sleeve 12*d* is always biased toward the photosensitive drum 9 by these urging springs. With this arrangement, the abutment rings 12*da* are always abutted against the photosensitive drum 9, with the result that the predetermined gap between the developing sleeve 12*d* and the photosensitive drum 9 is always maintained, thereby transmitting the driving force to the flange gear 9*c* of the photosensitive drum 9 and a sleeve gear 12*k* of the developing sleeve 12*d* meshed with the flange gear 9*c*.

The sleeve gear 12*k* also constitutes a flange portion of the developing sleeve 12*d*. That is to say, according to the illustrated embodiment, the sleeve gear 12*k* and the flange portion are integrally formed from resin material (for example, polyacetylene resin). Further, a metallic pin 12*d*2 having a small diameter (for example, made of stainless steel) and having one end rotatably supported by the lower frame 15 is press-fitted into and secured to the sleeve gear 12*k* (flange portion) at its center. This metallic pin 12*d*2 acts as a rotary shaft at one end of the developing sleeve 12*d*. According to the illustrated embodiment, since the sleeve gear and the flange portion can be integrally formed from resin, it is possible to facilitate the manufacturing of the developing sleeve and to make the developing sleeve 12*d* and the process cartridge B light-weight.

Figure 22:
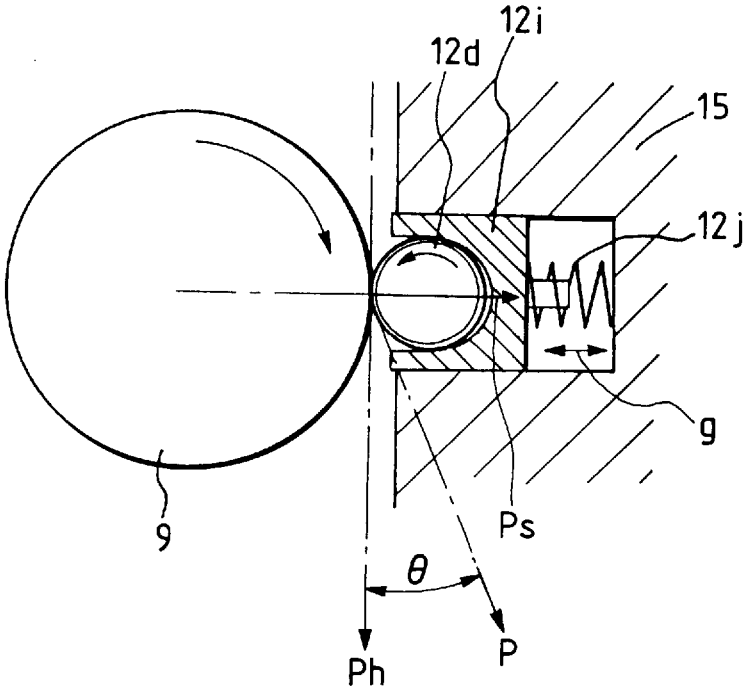
FIG. 22 is a sectional view for explaining the pressurizing force acting on the developing sleeve.

Now, the sliding directions of the sleeve bearings 12*i* will be explained with reference to FIG. 22. First of all, the driving of the developing sleeve 12*d* will be described. When the driving force is transmitted from the drive source (drive motor 54) of the image forming system to the flange gear 9*c* and then is transmitted from the flange gear 9*c* to the sleeve gear 12*k*, the meshing force between the gears is directed to a direction inclined or offset from a tangential line contacting a meshing pitch circle of the flange gear 9*c* and a meshing pitch circle of the sleeve gear 12*k* by a pressure angle (20° in the illustrated embodiment). Thus, the meshing force is directed to a direction shown by the arrow P in FIG. 22 ($\theta \simeq 20°$). In this case, if the sleeve bearings 12*i* are slid in a direction parallel to a line connecting the center of rotation of the photosensitive drum 9 and the center of rotation of the developing sleeve 12*d*, when the meshing force P is divided into a force component Ps of a horizontal direction parallel with the sliding direction and a force component Ph of a vertical direction perpendicular to the sliding direction, as shown in FIG. 22, the force component of the horizontal direction parallel with the sliding direction is directed away from the photosensitive drum 9. As a result, regarding the driving of the developing sleeve 12*d*, the distance between the photosensitive drum 9 and the developing sleeve 12*d* is easily varied in accordance with the meshing force between the flange gear 9*c* and the sleeve gear 12*k*, with the result that the toner on the developing sleeve 12*d* cannot be moved to the photosensitive drum 9 properly, thus worsening the developing ability.

To avoid this, in the illustrated embodiment, as shown in FIG. 21A, in consideration of the transmission of the driving force from the flange gear 9*c* to the sleeve gear 12*k*, the sliding direction of the sleeve bearing 12*i* at the driving side (side where the sleeve gear 12*k* is disposed) is coincided with the direction shown by the arrow Q. That is to say, an angle $\phi$ formed between the direction of the meshing force P (between the flange gear 9*c* and the sleeve gear 12*k*) and the sliding direction is set to have a value of about 90° (92° in the illustrated embodiment). With this arrangement, the force component Ps of the horizontal direction parallel with the sliding direction is negligible, and, in the illustrated embodiment, the force component Ps acts to slightly bias the developing sleeve 12*d* toward the photosensitive drum 9. In such a case, the developing sleeve 12*d* is pressurized by an amount corresponding to spring pressure a of the urging springs 12*j* to maintain a constant distance between the photosensitive drum 9 and the developing sleeve 12*d*, thereby ensuring the proper development.

Next, the sliding direction of the slide bearing 12*i* at the non-driving side (side where the sleeve gear 12*k* is not arranged) will be explained. At the non-driving side, unlike the above-mentioned driving side, since the slide bearing 12*i* does not receive a driving force, as shown in FIG. 21B, the sliding direction of the slide bearing 12*i* is selected to be substantially parallel with a line connecting a center of the photosensitive drum 9 and a center of the developing sleeve 12*d*.

In this way, when the developing sleeve 12*d* is pressurized toward the photosensitive drum 9, by changing the urging angle for urging the developing sleeve 12*d* at the driving side from that at the non-driving side, the positional relation between the developing sleeve 12*d* and the photosensitive drum 9 is always maintained properly, thus permitting the proper development.

Incidentally, the sliding direction of the slide bearing 12*i* at the driving side may be set to be substantially parallel with the line connecting the center of the photosensitive drum 9 and the center of the developing sleeve 12*d* as in the case of the non-driving side. That is to say, as described in the above-mentioned embodiment, at the driving side, since the developing sleeve 12*d* is urged away from the photosensitive drum 9 by the force component Ps (of the meshing force between the flange gear 9*c* and the sleeve gear 12*k*) directing toward the sliding direction of the slide bearing 12*i*, in this embodiment, the urging force of the urging spring 12*j* at the driving side may be set to have a value greater than that at the non-driving side by an amount corresponding to the force component Ps. That is, when the urging force of the urging spring 12*j* to the developing sleeve 12*d* at the non-driving side is P, the urging force P2 of the urging spring 12*j* at the driving side is set to have a relation P2=P1+Ps, with the result that the developing sleeve 12*d* is always subjected to the proper urging force, thus ensuring the constant distance between the developing sleeve and the photosensitive drum 9.

(Cleaning Means)

The cleaning means 13 serves to remove the residual toner remaining on the photosensitive drum 9 after the toner image on the photosensitive drum 9 has been transferred to the recording medium 4 by the transfer means 6. As shown in FIG. 4, the cleaning means 13 comprises an elastic cleaning blade 13*a* contacting with the surface of the photosensitive drum 9 and adapted to remove or scrape off the residual toner remaining on the photosensitive drum 9, a squeegee sheet or strip 13*b* slightly contacting with the surface of the photosensitive drum 9 and disposed below the cleaning blade 13*a* to receive the removed toner, and a waste toner reservoir 13*c* for collecting the waste toner received by the sheet 13*b*. Incidentally, the squeegee sheet 13*b* is slightly contacted with the surface of the photosensitive drum 9 and the serves to permit the passing of the residual toner remaining on the photosensitive drum, but to direct the toner removed from the photosensitive drum 9 by the cleaning blade 13*a* to a direction away from the surface of the photosensitive drum 9.

Figure 23:
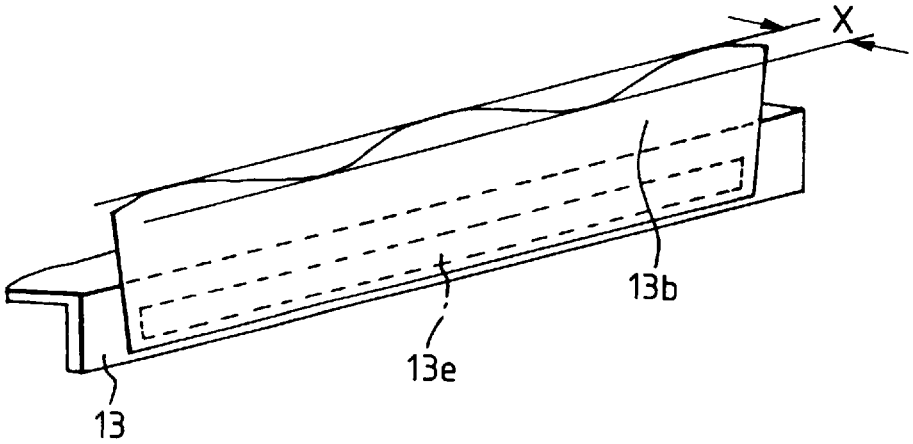
FIG. 23 is a perspective view of a squeegee sheet in a condition that an upper edge of the sheet is tortuous.

Now, a method for attaching the squeegee sheet 13*b* will be described. The squeegee sheet 13*b* is adhered to an attachment surface 13*d* of the waste toner reservoir 13*c* via both-side adhesive tape 13*e*. In this case, the waste toner reservoir 13*c* is made of resin material (for example, high-impact styrol (HIPS) or the like) and has a slightly uneven surface. Thus, as shown in FIG. 23, if the both-sided adhesive tape 13*e* is merely stuck to the attachment surface 13*d* and the squeegee sheet 13*b* is merely attached to the adhesive tape 13*e*, it is feared that a free edge of the squeegee sheet 13*b* (to be contacted with the photosensitive drum 9) becomes tortuous as shown by x. If such a tortuous edge x of the squeegee sheet 13*b* is generated, the squeegee sheet 13*b* does not closely contact with the surface of the photosensitive drum 9, so that it cannot surely receive the toner removed by the cleaning blade 13*a*.

Figure 24A:
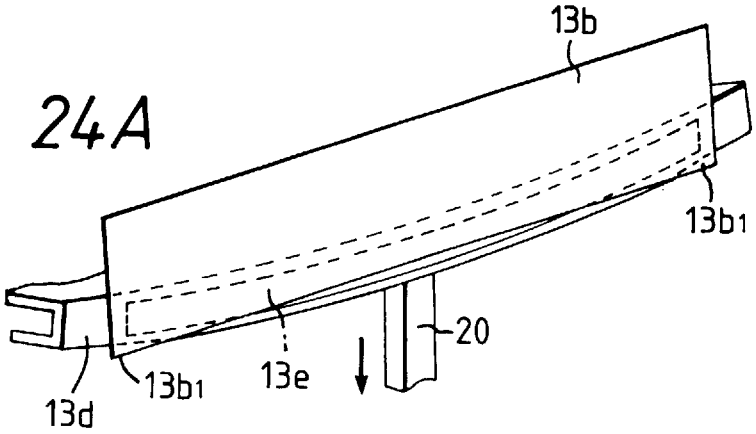
FIG. 24A is a perspective view showing a condition that a both-sided adhesive tape is protruded from a lower end of the squeegee sheet.

In order to avoid this, it is considered that, when the squeegee sheet 13*b* is attached to the attachment surface, as shown in FIG. 24A, the attachment surface 13*d* at a lower portion of the waste toner reservoir is pulled downwardly by a pulling tool 20 to elastically deform the attachment surface to form a curvature and then the squeegee sheet 13*b* is stuck to the curved attachment surface, and, thereafter the curvature of the attachment surface is released to apply the tension to the free edge of-the squeegee sheet 13*b*, thereby preventing the free edge from becoming tortuous. However, in the recent small-sized process cartridges B, since the dimension of the attachment surface 13*d* is small, if the squeegee sheet 13*b* is stuck to the curved attachment surface 13*d*, as shown in FIG. 24A, both lower ends or corners 13*b*1 of the squeegee sheet 13*b* will be protruded from the attachment surface 13*d* downwardly. And, when the squeegee sheet 13*b* is protruded downwardly from the attachment surface 13*d*, as apparent from the sectional view of FIG. 1, it is feared that the recording medium 4 is interfered with by the protruded squeegee sheet 13*b*.

Figure 24B:
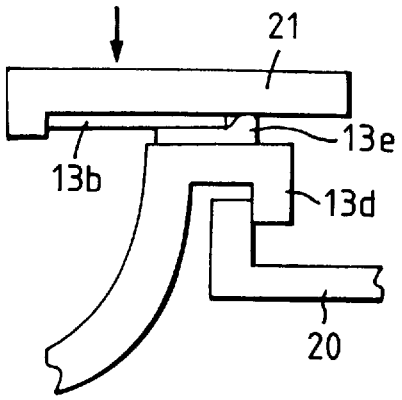
FIGS. 24B and 24C are views showing a condition that a sticking tool is adhered to the protruded both-sided adhesive tape.
Figure 24C:
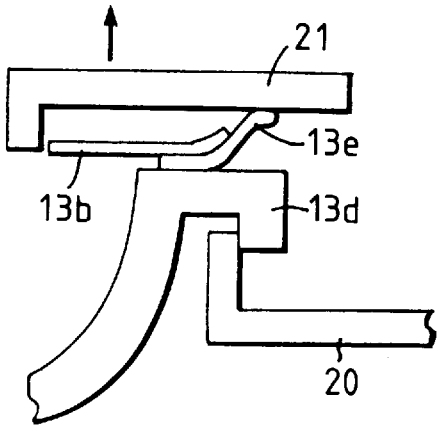

Further, if the squeegee sheet 13*b* is attached to the curved attachment surface 13*d*, as shown in FIG. 24A, the both-sided adhesive tape 13*e* will be protruded from the lower end of the squeegee sheet 13*b*. Thus, in this condition, when the squeegee sheet 13*b* is urged against the both-sided adhesive tape 13*e* by a sticking tool 21, as shown in FIG. 24B, the protruded portion of the both-sided adhesive tape 13*e* is stuck to the sticking tool 21, with the result that, when the sticking tool 21 is removed, as shown in FIG. 24C, the both-sided adhesive tape 13*e* is peeled from the attachment surface 13*d*, thus causing the poor attachment of the squeegee sheet 13*b*.

Figure 25A:
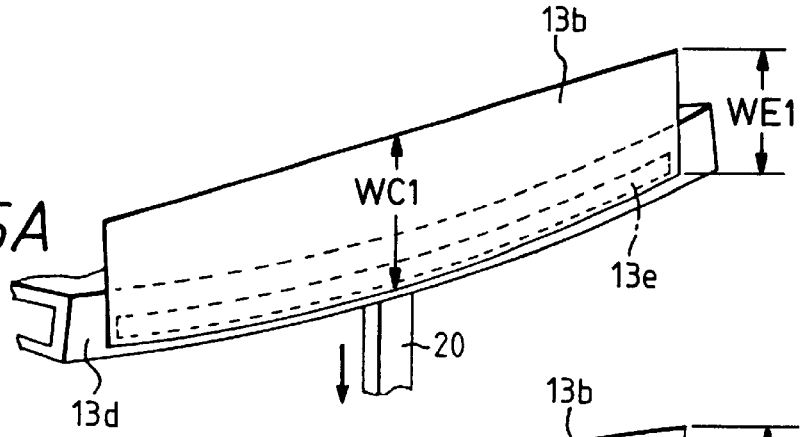
FIG. 25A is a perspective view showing a condition that the squeegee sheet is stuck to a curved attachment surface with a lower end portion of the sheet being curved.
Figure 25B:
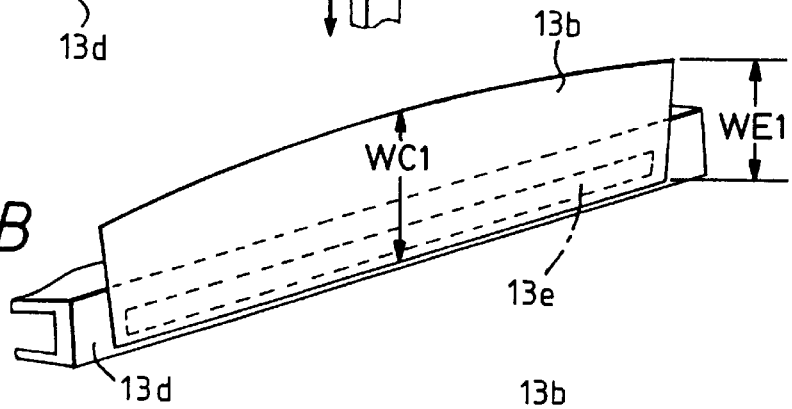
FIG. 25B is a perspective view showing a condition that an upper end portion of the squeegee sheet is tensioned by releasing the curvature of the attachment surface.

To avoid this, in the illustrated embodiment, as shown in FIG. 25A, the configuration of the lower end of the squeegee sheet or strip 13*b* becomes substantially the same as the curvature configuration of the attachment surface 13*d* which has been curved by the pulling tool 20. That is to say, a width of the squeegee sheet 13*b* is varied from both longitudinal ends to a central portion so that the width of the central portion becomes greater than the width of both longitudinal ends (for example, the width at the central portion WC1 is about 7.9 mm, and the width at both ends WE1 is about 7.4 mm). In this way, when the squeegee sheet 13*b* is attached to the attachment surface, the curved both-sided adhesive tape 13*e* does not protrude from the squeegee sheet 13*b*. Further, when the pulling tool 20 is removed to release the curvature of the attachment surface 13*d* thereby to apply the tension to the upper edge of the squeegee sheet 13*b* as shown in FIG. 25B, the lower end of the squeegee sheet does not protrude from the attachment surface 13*d* downwardly. Therefore, the above-mentioned interference between the recording medium 4 and the squeegee sheet 13*b* and the poor attachment of the squeegee sheet 13*b* can be prevented.

Figure 26:
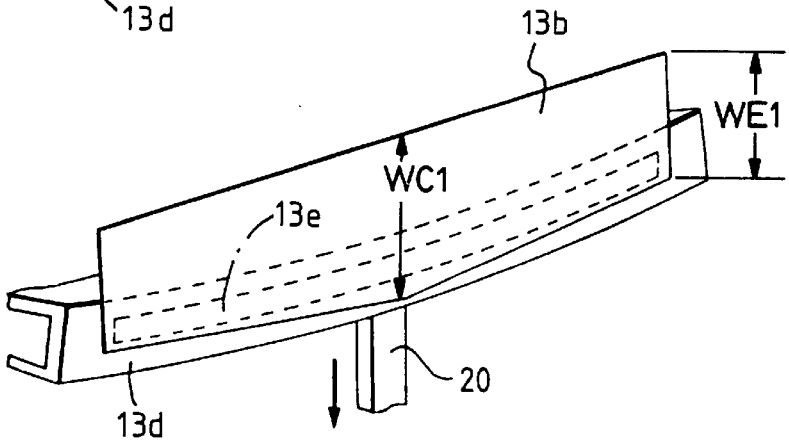
FIG. 26 is a perspective view of a squeegee sheet according to another embodiment wherein a width of the sheet is widened straightly and gradually from both ends to a central portion thereof.
Figure 27:
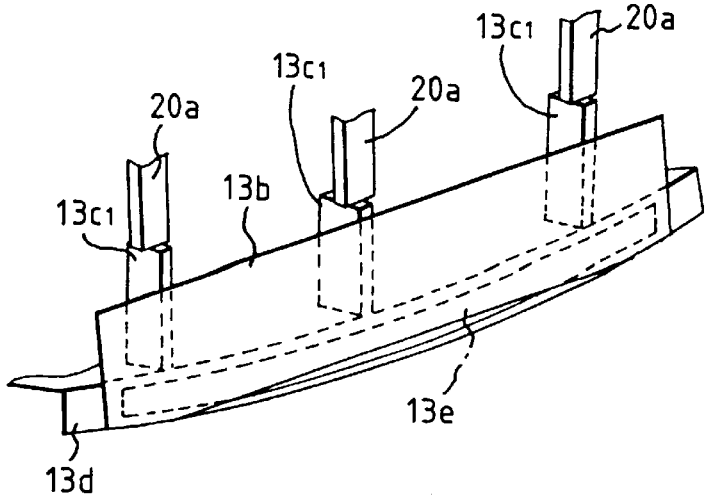
FIG. 27 is a perspective view for explaining the formation of the curvature of the squeegee sheet attachment surface by pressing the surface.

Incidentally, in view of the workability and the service life of a working tool, it is desirable that the lower edge of the squeegee sheet 13*b* is straight. Thus, as shown in FIG. 26, the width of the squeegee sheet 13*b* may be varied straightly so that the width at the central portion WC1 becomes greater than those at both longitudinal ends WE1 in correspondence to the amount of the curvature of the attachment surface 13*d*. In the above-mentioned embodiment, while the attachment surface 13*d* was curved by pulling it by-the pulling tool 20, it is to be understood that, as shown in FIG. 27, the attachment surface 13*d* may be curved by pushing toner reservoir partition plates 13*c*1 integrally formed with the attachment surface 13*d* by pushing tools 20*a*.

Further, in the illustrated embodiment, while the squeegee sheet attachment surface 13*d* was formed on the lower portion of the waste toner reservoir 13*c*, the squeegee sheet 13*b* may be stuck to a metallic plate attachment surface independently formed from the waste toner reservoir 13*c* and then a metallic plate may be incorporated into the waste toner reservoir 13*c*.

Incidentally, in the illustrated embodiment, the squeegee sheet 13*b* is made of polyethylene terephthalate (PET) and has a thickness of about 38 $\mu$m, a length of about 241.3 mm, a-central width of about 7.9 mm, end widths of about 7.4 mm and an appropriate radius of curvature of about 14556.7 mm.

(Upper and Lower Frames)

Next, the upper and lower frames 14, 15 constituting the housing of the process cartridge B will be explained. As shown in FIGS. 7 and 8, the photosensitive drum 9, the developing sleeve 12*d* and developing blade 12*e* of the developing means 12, the cleaning means 13 are provided in the lower frame 15. On the-other hand, as shown in FIGS. 7 and 9, the charger roller 10, the toner reservoir 12*a* of the developing means 12 and the toner feed mechanism 12*b* are provided in the upper frame 14.

In order to assemble the upper and lower frames 14, 15 together, four pairs of locking pawls 14*a* are integrally formed with the upper frame 14 and are spaced apart from each other equidistantly in a longitudinal direction of the upper frame.

Similarly, locking openings 15*a* and locking projections 15*b* for engaging by the locking pawls 14*a* are integrally formed on the lower frame 15. Accordingly, when the upper and lower frames 14, 15 are forcibly urged against each other to engage the locking pawls 14*a* by the corresponding locking openings 15*a* and locking projections 15*b*, the upper and lower frames 14, 15 are interconnected. Incidentally, in order to ensure the interconnection between the upper and lower frames, as shown in FIG. 8, a locking pawl 15*c* and a locking opening 15*d* are formed near both longitudinal ends of the lower frame 15, respectively, whereas, as shown in FIG. 9, a locking opening 14*b* (to be engaged by the locking pawl 15*c*) and a locking pawl 14*c* (to be engaged by the locking opening 15*d*) are formed near both longitudinal ends of the upper frame 14, respectively.

When the parts constituting the process cartridge B are separately contained within the upper and lower frames 14, 15 as mentioned above, by arranging the parts which should be positioned with respect to the photosensitive drum 9 (for example, developing sleeve 12*d*, developing blade 12*e* and cleaning blade 13*a*) within the same frame (lower frame 15 in the illustrated embodiment), it is possible to ensure the excellent positioning accuracy of each part and to facilitate the assembling of the process cartridge B. Further, as shown in FIG. 8, fitting recesses 15*n* are formed in the lower frame 15 in the vicinity of one lateral edge thereof. On the other hand, as shown in FIG. 9, fitting projections 14*h* (to be fitted into the corresponding fitting recesses 15*n*) are formed on the upper frame 14 in the vicinity of one lateral edge thereof at intermediate locations between the adjacent locking pawls 14*a*.

Further, in the illustrated embodiment, as shown in FIG. 8, fitting projections 15*e* are formed on the lower frame 15 near two corners thereof, whereas fitting recesses 15*f* are formed in the lower frame near the other two corners. On the other hand, as shown in FIG. 9, fitting recesses 14*d* (to be engaged by the corresponding fitting projections 15*e*) are formed in the upper frame 14 near two corners thereof, whereas fitting projections 14*e* (to be fitted into the corresponding fitting recesses 15*f*) are formed in the lower frame near the other two corners. Accordingly, when the upper and lower frames 14, 15 are interconnected, by fitting the fitting projections 14*h*, 14*e*, 15*e* (of the upper and lower frames 14, 15) into the corresponding fitting recesses 15*n*, 15*f*, 14*d*, the upper and lower frames 14, 15 are firmly interconnected to each other so that, even if a torsion force is applied to the interconnected upper and lower frames 14, 15, they are not disassembled.

Incidentally, the positions of the above-mentioned fitting projections and fitting recesses may be changed so long as the interconnected upper and lower frames 14, 15 are not disassembled by any torsion force applied thereto.

Further, as shown in FIG. 9, a protection cover 22 is rotatably mounted on the upper frame 14 via pivot pins 22*a*. The protection cover 22 is biased toward a direction shown by the arrow h in FIG. 9 by torsion coil springs (not shown) arranged around the pivot pins 22*a*, so that the projection cover 22 closes or covers the photosensitive drum 9 in the condition that the process cartridge B is removed from the image forming system A as shown in FIG. 4.

More specifically, as shown in FIG. 1, the photosensitive drum 9 is so designed that it is exposed from an opening 15*g* formed in the lower frame 15 to be opposed to the transfer roller 6 in order to permit the transferring of the toner image from the photosensitive drum onto the recording medium 4. However, in the condition that the process cartridge B is removed from the image forming system A, if the photosensitive drum 9 is exposed to the atmosphere, it will be deteriorated by the ambient light and the dirt and the like will be adhered to the photosensitive drum 9. To avoid this, when the process cartridge B s dismounted from the image forming system A, the opening 15*g* is closed by the protection cover 22, thereby protecting the photosensitive drum 9 from the ambient light and dirt. Incidentally, when the process cartridge B is mounted within the image forming system A, the protection cover 22 is rotated by a rocking mechanism (not shown) to expose the photosensitive drum 9 from the opening 15*g*.

Further, as apparent from FIG. 1, in the illustrated embodiment, the lower surface of the lower frame 15 also acts as a guide for conveying the recording medium 4. The lower surface of the lower frame is formed as both side guide portions 15*h*1 and a stepped central guide portion 15*h*2 (FIG. 6). The longitudinal length (i.e., distance between the steps) of the central guide portion 15*h*2 is about 102–120 mm (107 mm in the illustrated embodiment) which is slightly greater than a width (about 100 mm), and the depth of the step is selected to have a value of about 0.8–2 mm. With this arrangement, the central guide portion 15*h*2 increases the conveying space for the recording medium 4, with the result that, even when a thicker and resilient sheet such as a post card, visiting card or envelope is used as the recording medium 4, such a thicker sheet does not interfere with the guide surface of the lower frame 15, thereby preventing the recording medium from jamming. On the other hand, when a thin sheet having a greater width than that of the post card such as a plain sheet is used as the recording medium, since such a sheet (recording medium) is guided by both of the side guide portions 15*h*1, it is possible to convey the sheet without floating.

Figure 28:
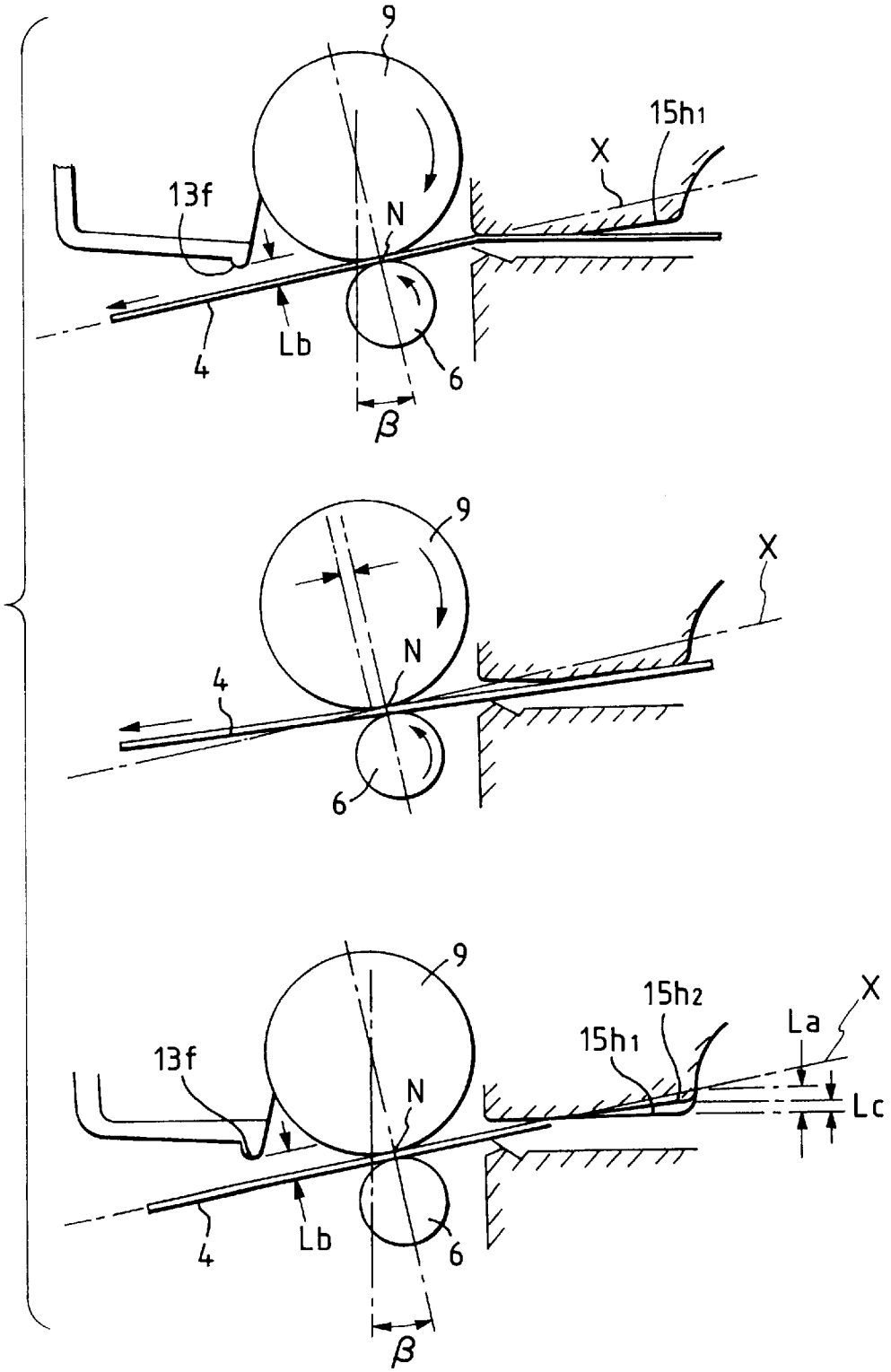
FIG. 28 is a view showing conditions that a recording medium is being guided by a lower surface of the lower frame.

Now, the lower surface of the lower frame 15 acting as the convey guide for the recording medium will be described more concretely. As shown in FIG. 28, the both side guide portions 15*h*1 can be flexed by an amount La (=5–7 mm) with respect to a tangential direction X regarding a nip N between the photosensitive drum 9 and the transfer roller 6.

Since the both side guide portions 15*h*1 are formed on the lower surface of the lower frame 15 designed to provide the required space between the lower frame and the developing sleeve 12*d* and the required space for sufficiently supplying the toner to the developing sleeve, such guide portions are determined by the position of the developing sleeve 12*d* selected to obtain the optimum developing condition. If the lower surfaces of the side guide portions approach the tangential line X, the thickness of the lower portion of the lower frame 15 is decreased, thus causing a problem regarding the strength of the process cartridge B.

Further, the position of a lower end 13*f* of the cleaning means 13 is determined by the positions of the cleaning blade 13*a*, the squeegee sheet 13*b* and the like, forming the cleaning means 13 as described later, and is so selected to provide a distance Lb (=3–5 mm) preventing the interference with the recording medium 4 being fed. Incidentally, in the illustrated embodiment, as angle β between a vertical line passing through the rotational center of the photosensitive drum 9 shown in FIG. 28 and a line connecting the rotational center of the photosensitive drum and the rotational center of the transfer roller 6 is selected to have a value of 5–20 degrees.

In consideration of the above affairs, by providing the recess or step having a depth Lc (=1–2 mm) only in the central guide portion 15*h*2 to approach this guide portion to the tangential line X, it is possible to feed the thicker and resilient recording medium 4 smoothly without reducing the strength of the lower frame 15. Incidentally, in most cases, since the thicker and resilient recording medium 4 is the visiting card, envelope or the like which is narrower than the post card under the general specification of the image forming system, so long as the width of the stepped or recessed central guide portion 15*h*2 is selected to be slightly greater than that of the post card, there is no problem in practical use.

Further, regulating projections 15*i* protruding downwardly are formed on the outer surface of the lower frame 15 in areas outside of the recording medium guiding zone. The regulating projections 15*i* each protrudes from the guide surface of the lower frame for the recording medium 4 by about 1 mm. With this arrangement, even if the process cartridge B is slightly lowered for some reason during the image forming operation, since the regulating projections 15*i* are abutted against a lower guide member 23 (FIG. 1) of the body 16 of the image forming system, the further lowering of the process cartridge can be prevented. Accordingly, a space of at least 1 mm is maintained between the lower guide member 23 and the lower guide surface of the lower frame 15 to provide a convey path for the recording medium 4, thereby conveying the recording medium-without jamming. Further, as shown in FIG. 1, a recess 15*j* is formed in the lower surface of the lower frame 15 so as not to interfere with the regist roller 5*c*2. Thus, when the process cartridge B is mounted within the image forming system A, since it can be mounted near the regist roller 5*c*2, the whole image forming system can be small-sized.

(Assembling of Process Cartridge)

Figure 29:
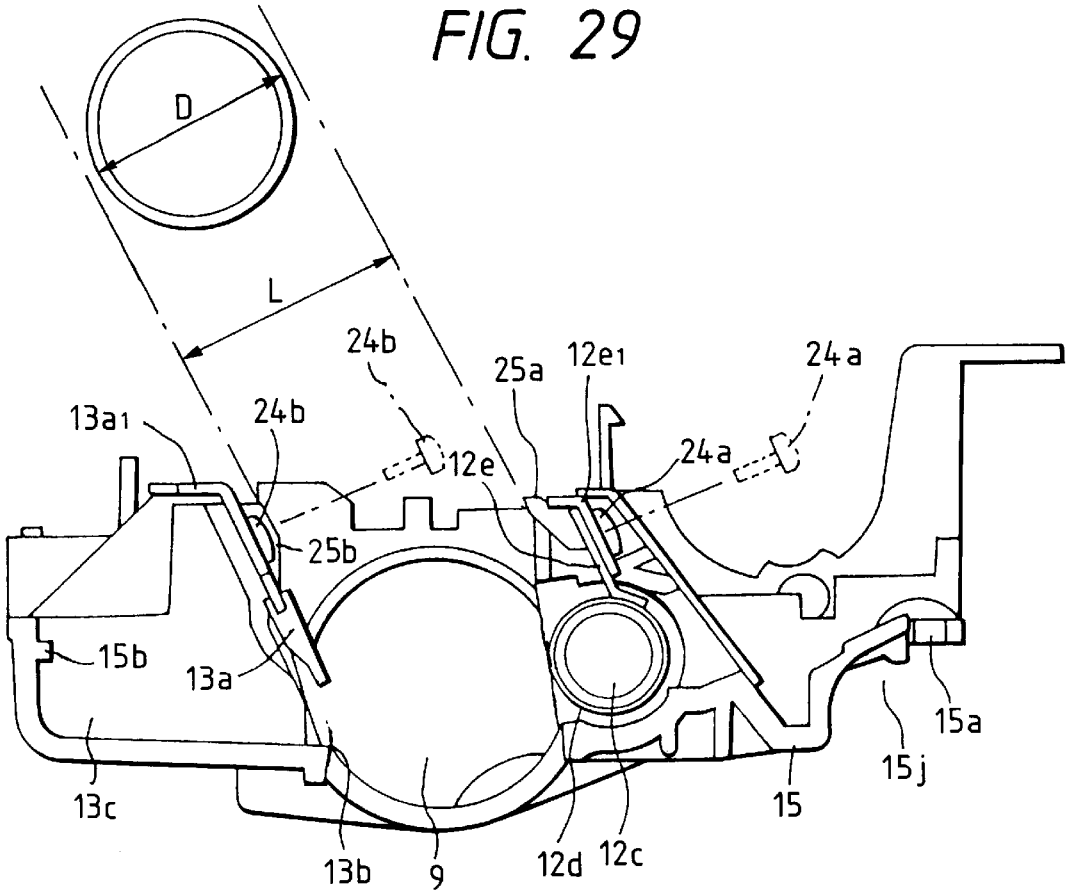
FIG. 29 is a sectional view showing final assembly of the photosensitive drum.

Next, the assembling of the process cartridge having the above-mentioned construction will be explained. In FIG. 29, toner leak preventing seals S having a regular shape and made of Moltopren (flexible polyurethane, manufactured by INOAC Incorp.) rubber for preventing the leakage of toner are stuck on ends of the developing means 12 and of the cleaning means 13 and on the lower frame 15. Incidentally, the toner leak preventing seals S each may not have the regular shape. Alternatively, toner leak preventing seals may be attached by forming recesses in portions (to be attached) of the seals and by pouring liquid material which becomes elastomer when solidified into the recesses.

A blade support member 12*e*1 to which the developing sleeve 12*e* is attached and a blade support member 13*a*1 to which the cleaning blade 13*a* is attached are attached to the lower frame 15 by pins 24*a*, 24*b*, respectively. According to the illustrated embodiment, as shown by the phantom lines in FIG. 29, the attachment surfaces of the blade support members 12*e*1, 13*a*1 may be substantially parallel to each other so that the pins 24*a*, 24*b* can be driven from the same direction. Thus, when a large number of process cartridges B are manufactured, the developing blades 12*e* and the cleaning blades 13*a* can be continuously attached by the pins by using an automatic device. Further, the assembling ability for the blades 12*e*, 13*a* can be improved by providing a space for a screw driver, and the shape of a mold can be simplified by aligning the housing removing direction from the mold, thereby achieving cost reductions.

Figure 30:
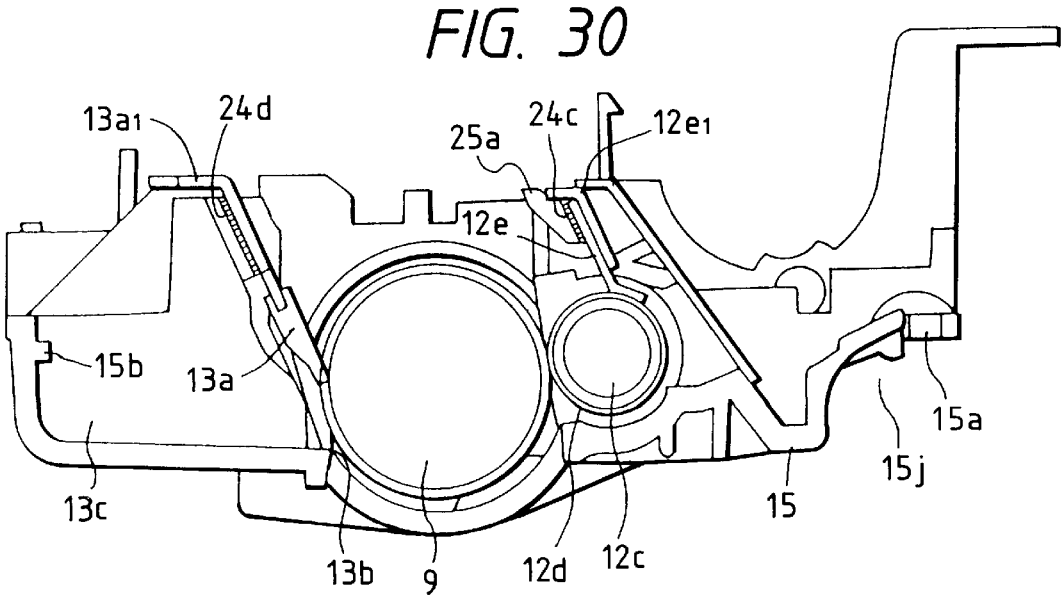
FIG. 30 is a sectional view showing a condition that a developing blade and a cleaning blade are stuck.

Incidentally, the developing blade 12*e* and the cleaning blade 13*a* may not be attached by the pins (screws), but may be attached to the lower frame 15 by adhesives 24*c*, 24*d* as shown in FIG. 30. Also in this case, when the adhesives can be applied from the same direction, the attachment of the developing blade 12*e* and the cleaning blade 13*a* can be automatically and continuously performed by using an automatic device.

Figure 31:
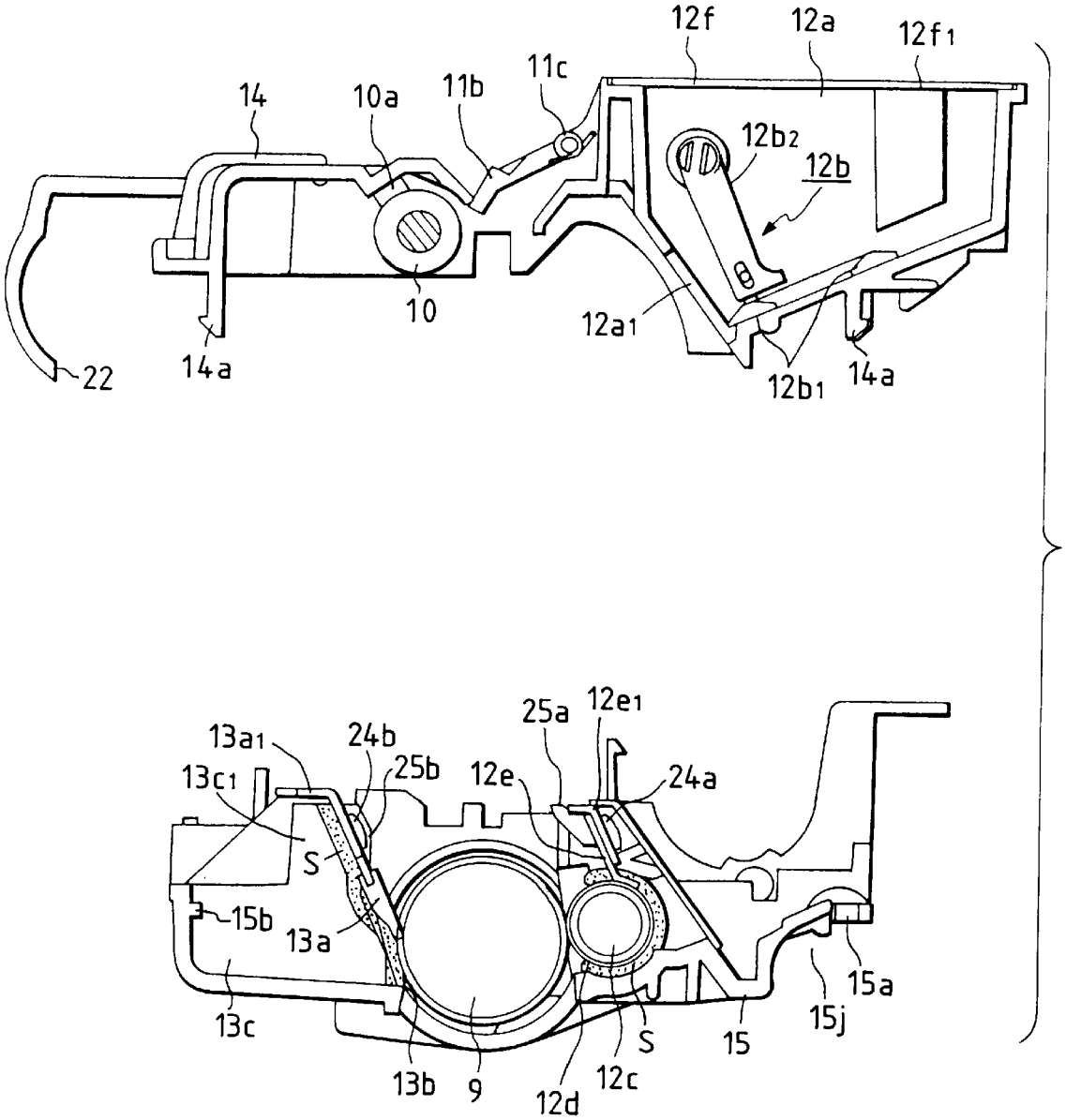
FIG. 31 is an exploded view for explaining the assembling of the process cartridge.
Figure 32:
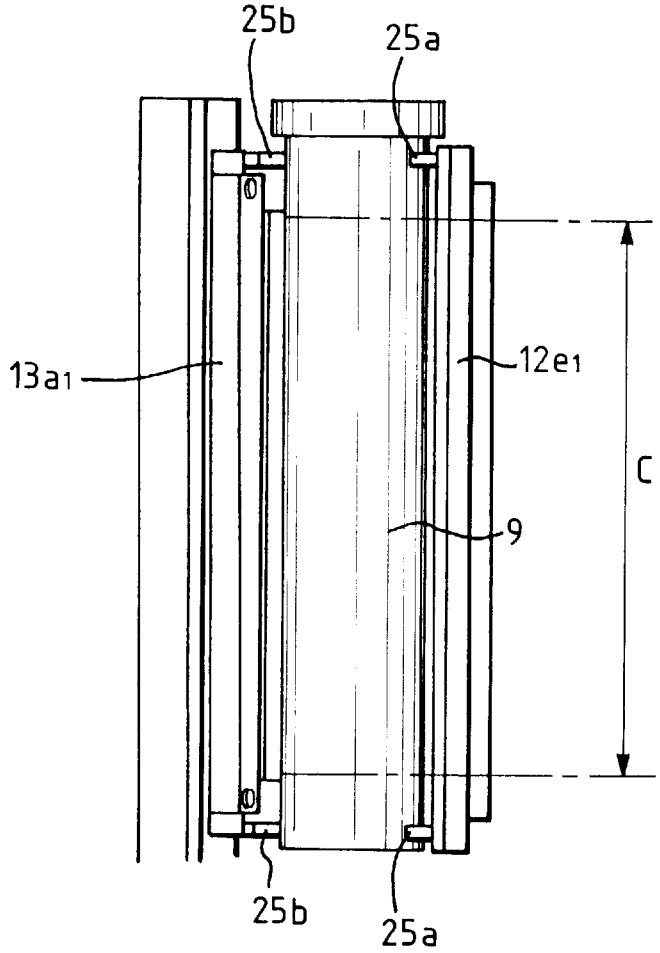
FIG. 32 is a view for explaining a position of guide members when the photosensitive drum of the process cartridge is assembled.

After the blades 12*e*, 13*a* have been attached as mentioned above, the developing sleeve 12*d* is attached to the lower frame 15. Then, the photosensitive drum 9 is attached to the lower frame 15. To this end, in the illustrated embodiment, guide members 25*a*, 25*b* are attached to surfaces (opposed to the photosensitive drum) of the blade support members 12*e*1, 13*a*1, respectively, at zones outside of the longitudinal image forming area C (FIG. 32) of the photosensitive drum 9. (Incidentally, in the illustrated embodiment, the guide members 25*a*, 25*b* are integrally formed with the lower frame 15). A distance between the guide members 25*a* and 25*b* is set to be greater than the outer diameter D of the photosensitive drum 9. Thus, after the various parts such as the developing blade 12*e*, cleaning blade 13*a* and the like have been attached to the lower frame 15, as shown in FIG. 31, the photosensitive drum 9 can be finally attached to the lower frame while guiding both longitudinal ends (outside of the image forming area) of the photosensitive drum by the guide members 25*a*, 25*b*. That is to say, the photosensitive drum 9 is attached to the lower frame 15 while slightly flexing the cleaning blade 13*a* and/or slightly retarding and rotating the developing sleeve 12*d*.

If the photosensitive drum 9 is firstly attached to the lower frame 15 and then the blades 12*e*, 13*a* and the like are attached to the lower frame, it is feared that the surface of the photosensitive drum 9 is damaged during the attachment of the blades 12*e*, 13*a* and the like. Further, during the assembling operation, it is difficult or impossible to check the attachment positions of the developing blade 12*e* and the cleaning blade 13*a* and to measure the contacting pressures between the blades and the photosensitive drum. In addition, although lubricant must be applied to the blades 12*e*, 13*a* to prevent the increase in torque and/or the blade turn-up due to the close contact between the initial blades 12*e*, 13*a* (at the non-toner condition) and the photosensitive drum 9 and the developing sleeve 12*d* before the blades 12*e*, 13*a* are attached to the lower frame 15, such lubricant is likely to drop off the blades during the assembling of the blades. However, according to the illustrated embodiment, since the photosensitive drum 9 is finally attached to the lower frame, the above-mentioned drawbacks and problems can be eliminated.

Figure 33:
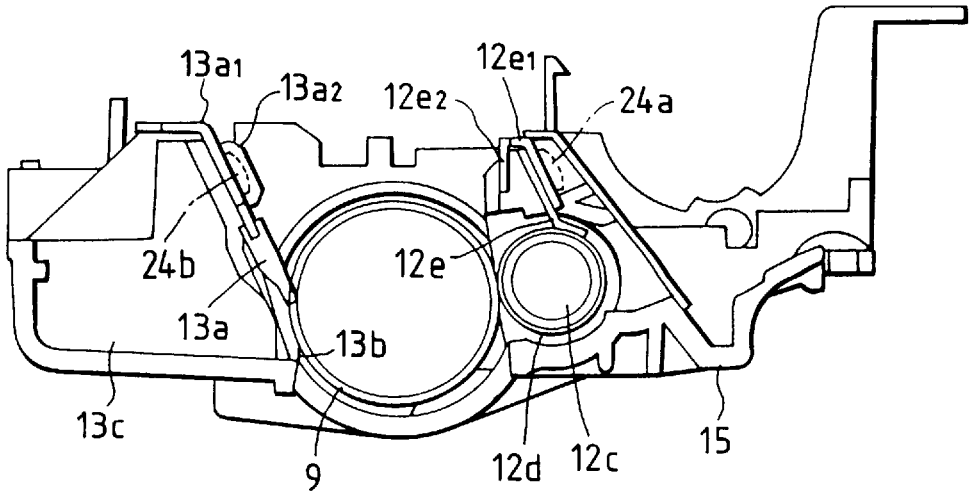
FIG. 33 is a sectional view of a structure wherein drum guides are arranged at ends of blade supporting members.

As mentioned above, according to the illustrated embodiment, it is possible to check the attachment positions of the developing means 12 and the cleaning means 13 in the condition that these means 12, 13 are attached to the frames, and to prevent the image forming area of the photosensitive drum from being damaged or scratched during the assembling of the drum. Further, since it is possible to apply the lubricant to the blades in the condition that these means 12, 13 are attached to the frames, the dropping off of the lubricant can be prevented, thereby preventing the occurrence of the increase in torque and/or the blade turn-up due to the close contact between the developing blade 12*e* and the developing sleeve 12*d*, and the cleaning blade 13*a* and the photosensitive drum 9. Incidentally, in the illustrated embodiment, while the guide members 25*a*, 25*b* were integrally formed with the lower frame 15, as shown in FIG. 33, projections 12*e*2, 13*a*2 may be integrally formed on the blade support members 12*e*1, 13*a*1 or other guide members may be attached to the blade support members at both longitudinal end zones of the blade support members outside of the image forming area of the photosensitive drum 9, so that the photosensitive drum 9 is guided by these projections or other guide members during the assembling of the drum.

Figure 34:
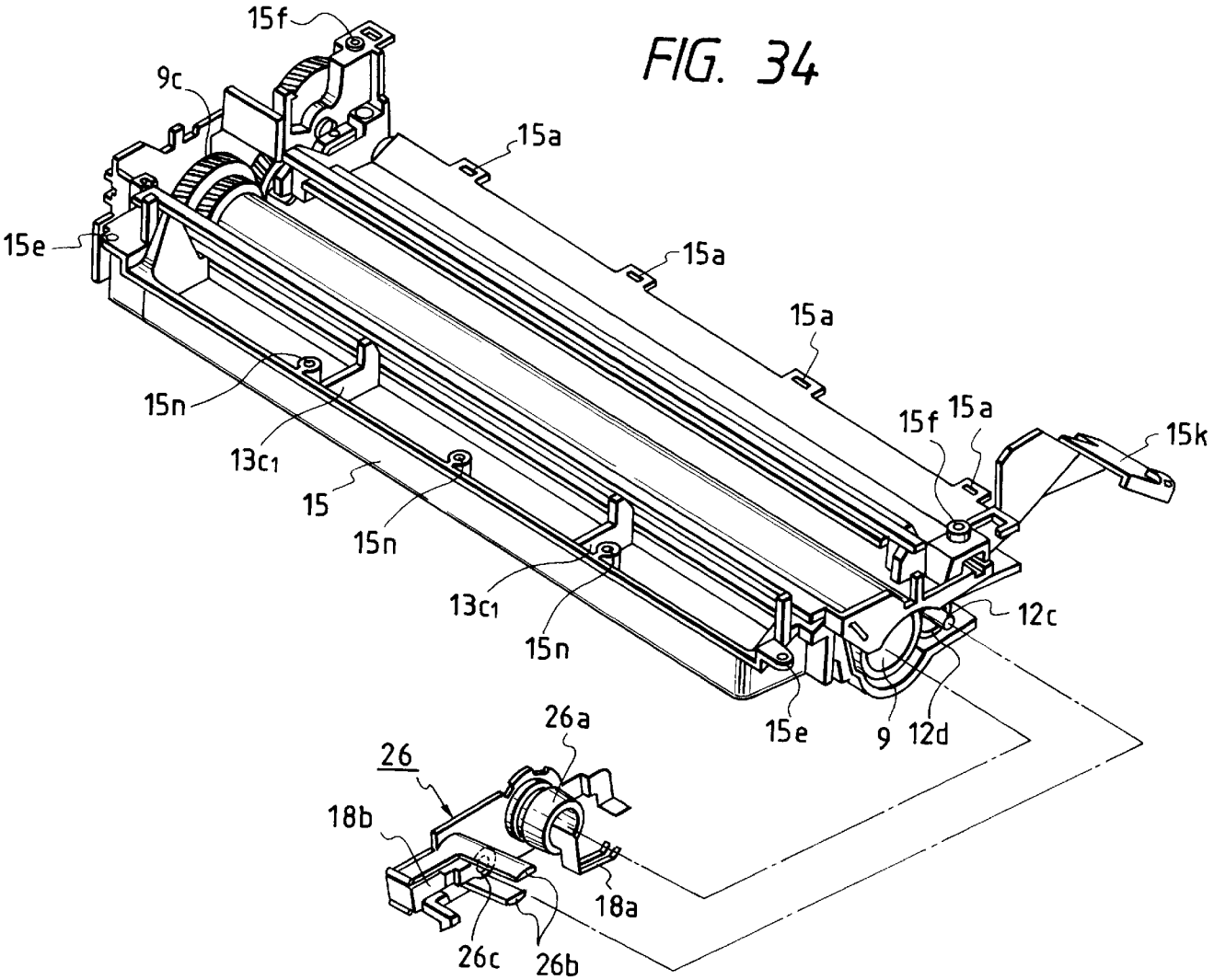
FIG. 34 is a perspective view for explaining the attachment of bearing members for the photosensitive drum and the developing sleeve.
Figure 35:
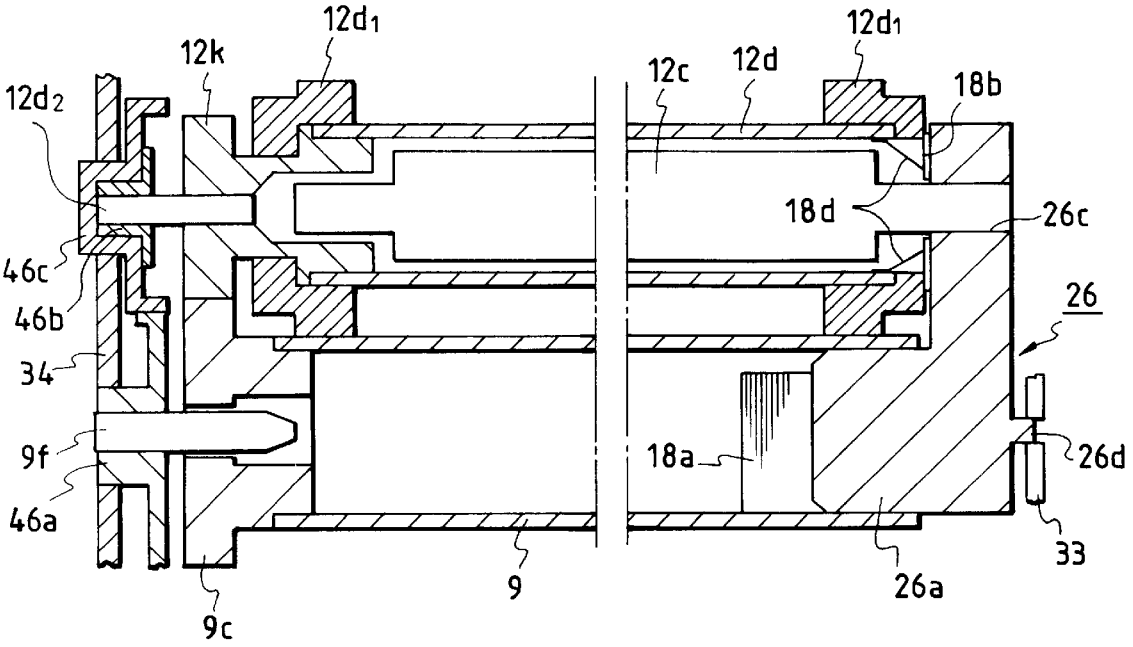
FIG. 35 is a sectional view of the photosensitive drum and the developing sleeve with the bearing members attached thereto.

After the developing sleeve 12*d*, developing blade 12*e*, cleaning blade 13*a* and photosensitive drum 9 have been attached to the lower frame 15 as mentioned above, as shown in FIG. 34 (perspective view) and FIG. 35 (sectional view), the bearing member 26 is incorporated to rotatably support one of the ends of the photosensitive drum 9 and of the developing sleeve 12*d*. The bearing member 26 is made of anti-wear material such as polyacetal and comprises a drum bearing portion 26*a* to be fitted on the photosensitive 9, a sleeve bearing portion 26*b* to be fitted on the outer surface of the developing sleeve 12*d*, and a D-cut hole portion 26*c* to be fitted on an end of a D-cut magnet 12*c*. Alternatively, the sleeve bearing portion 26*b* may be fitted on the outer surface of the sleeve bearing 12*i* supporting the outer surface of the developing sleeve 12*d* or may be fitted between slide surfaces 15Q of the lower frame 15 which are fitted on the outer surface of the slide bearing 12*i*.

Accordingly, when the drum bearing portion 26*a* is fitted on the end of the photosensitive drum 9 and the end of the magnet 12*c* is inserted into the D-cut hole portion 26*c* and the developing sleeve 12*d* is inserted into the sleeve bearing portion 26*b* and the bearing member 26 is fitted into the side of the lower frame 15 while sliding it in the longitudinal direction of the drum, the photosensitive drum 9 and the developing sleeve 12*d* are rotatably supported. Incidentally, as shown in FIG. 34, the earthing contact 18*a* is attached to the bearing member 26, and, when the bearing member 26 is fitted into the side of the lower frame, the earthing contact 18*a* is contacted with the aluminium drum core 9*a* of the photosensitive drum 9 (see FIG. 10). Further, the developing bias contact 18*b* is also attached to the bearing member 26, and, when the bearing member 26 is attached to the developing sleeve 12*d*, the bias contact 18*b* is contacted with a conductive member 18*d* contacting the inner surface of the developing sleeve 12*d*.

In this way, by rotatably supporting the photosensitive drum 9 and the developing sleeve 12*d* by the single bearing member 26, it is possible to improve the positional accuracy of the elements 9, 12*d*, and to reduce the number of parts, thereby facilitating the assembling operation and achieving cost reductions. Further, since the positioning of the photosensitive drum 9 and the positioning of the developing sleeve 12*d* and the magnet 12*c* can be performed by using the single member, it is possible to determine the positional relation between the photosensitive drum 9 and the magnet 12*c* with high accuracy, with the result that it is possible to maintain a constant magnetic force regarding the surface of the photosensitive drum 9, thus obtaining the high quality image. In addition, since the earthing contact 18*a* for earthing the photosensitive drum 9 and the developing bias contact 18*b* for applying the developing bias to the developing sleeve 12*d* are attached to the bearing member 26, the compactness of the parts can be achieved effectively, thus making the process cartridge B small-sized effectively.

Further, by providing (on the bearing member 26) supported portions for positioning the process cartridge B within the image forming system when the process cartridge is mounted within the image forming system, the positioning of the process cartridge B regarding the image forming system can be effected accurately. Furthermore, as apparent from FIGS. 5 and 6, an outwardly protruding U-shaped projection, i.e, drum shaft portion 26*d* (FIG. 20) is also formed on the bearing member 26. When the process cartridge B is mounted within the body 16 of the image forming system, the drum shaft portion 26*d* is supported by a shaft support member 34 as will be described later, thereby positioning the process cartridge B. In this way, since the process cartridge B is positioned by the bearing member 26 for directly supporting the photosensitive drum 9 when the cartridge is mounted within the system body 16, the photosensitive drum 9 can be accurately positioned regardless of the manufacturing and/or assembling errors of other parts.

Further, as shown in FIG. 35, the other end of the magnet 12*c* is received in an inner cavity formed in the sleeve gear 12*k*, and an outer diameter of the magnet 12*c* is selected so as to be slightly smaller than an inner diameter of the cavity. Thus, at the sleeve gear 12*k*, the magnet 12*c* is held in the cavity without any play and is maintained in a lower position in the cavity by its own weight or is biased toward the blade support member 12*e*1 made of magnetic metal such as ZINKOTE (zinc plated steel plate, manufactured by shin Nippon Steel Incorp.) by a magnetic force of the magnet 12*c*. In this way, since the sleeve gear 12*k* and the magnet 12*c* are associated with each other without any play, the frictional torque between the magnet 12*c* and the rotating sleeve gear 12*k* can be reduced, thereby reducing the torque regarding the process cartridge.

On the other hand, as shown in FIG. 31, the charger roller 10 is rotatably mounted within the upper frame 14, and the shutter member 11*b*, the protection cover 22 and the toner feed mechanism 12*b* are also attached to the upper frame 15. The opening 12*a*1 for feeding out the toner from the toner reservoir 12*a* to the developing sleeve 12*d* is closed by a cover film 28 (FIG. 36) having a tear tape 27. Further, the lid member 12*f* is secured to the upper frame, and, thereafter, the toner is supplied to the toner reservoir 12*a* through the filling opening 12*a*3 and then the filling opening 12*a*3 is closed by the lid 12*a*2, thus sealing the toner reservoir 12*a*.

Figure 36:
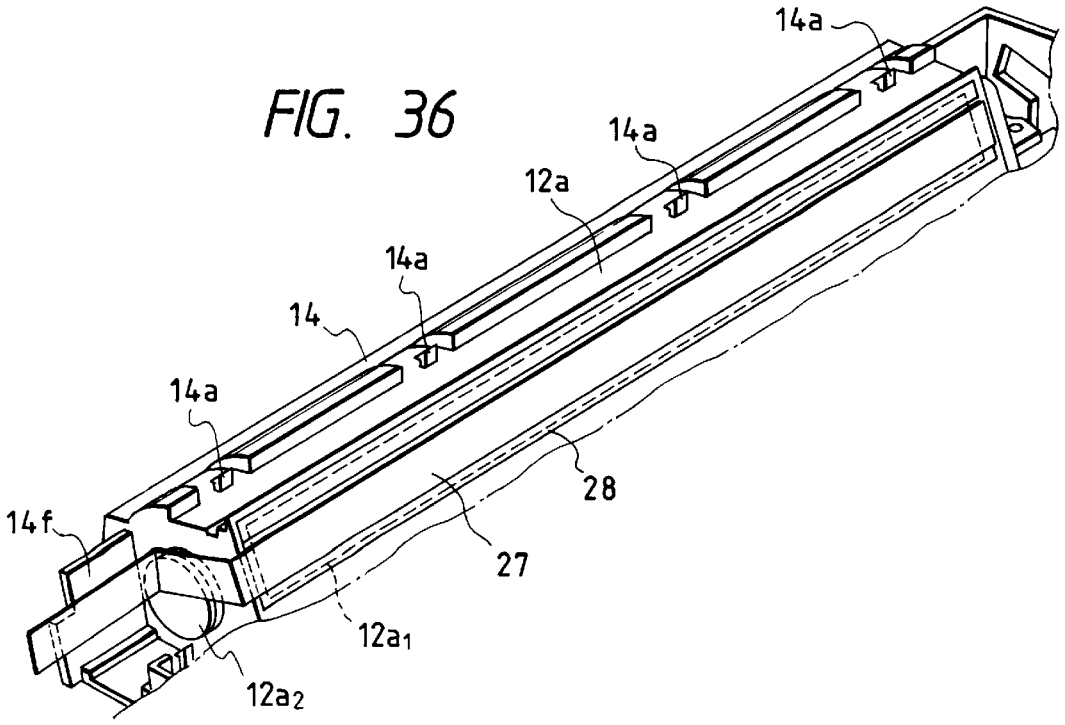
FIG. 36 is a perspective view for explaining a cover film and a tear tape.

Incidentally, as shown in FIG. 36, the tear tape 27 of the cover film 28 stuck around the opening 12*a*1 extends from one longitudinal end (right end in FIG. 36) of the opening 12*a*1 to the other longitudinal end (left end in FIG. 36) and is bent at the other end and further extends along a gripper portion 14*f* formed on the upper frame 14 and protrudes outwardly therefrom.

Next, the process cartridge B is assembled by interconnecting the upper and lower frames 14, 15 via the above-mentioned locking pawls and locking openings or recesses.

Figure 37:
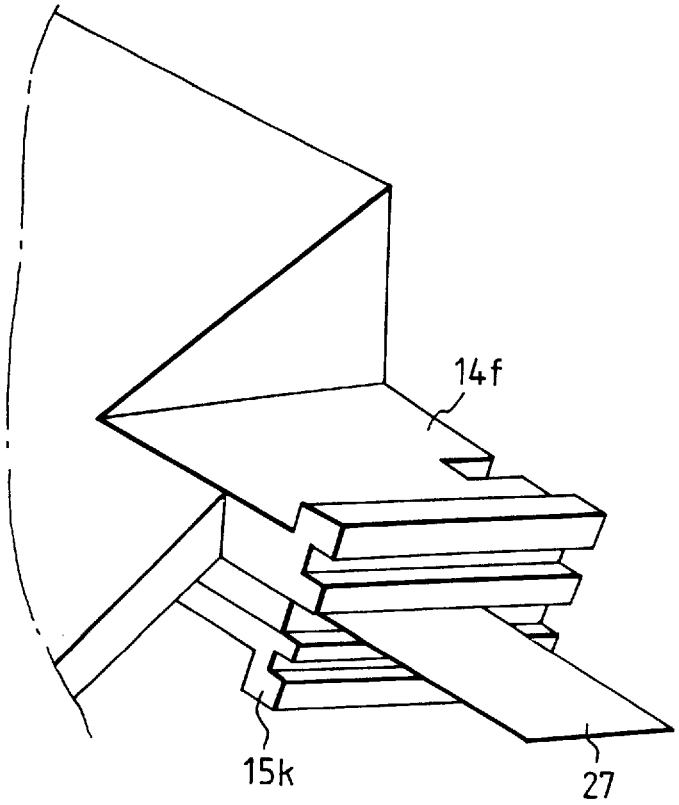
FIG. 37 is a perspective view showing a condition that the tear tape is protruded from a gripper.

In this case, as shown in FIG. 37, the tear tape 27 is exposed between the gripper portion 14*f* of the upper frame 14 and a gripper portion 15*k* of the lower frame 15. Therefore, when a new process cartridge B is used, the operator pulls a protruded portion of the tear tape 27 exposed between the gripper portions 14*f*, 15*k* to peel the tear tape 27 from the cover film 28 so as to open the opening 12*a*1, thus permitting the movement of the toner in the toner reservoir 12*a* toward the developing sleeve 12*d*. Thereafter, the process cartridge is mounted within the image forming system A.

As mentioned above, by exposing the tear tape 27 between the gripper portions 14*f*, 15*k* of the upper and lower frames 14, 15, the tear tape 27 can easily be exposed from the process cartridge in assembling the upper and lower frames 14, 15. The gripper portions 14*f*, 15*k* are utilized when the process cartridge B is mounted within the image forming system. Thus, if the operator forgets to remove the tear tape 27 before the process cartridge is mounted within the image forming system, since he must grip the gripper portions in mounting the process cartridge, he will know the exsistence of the non-removed tear tape 27. Further, when the color of the tear tape 27 is clearly differentiated from the color of the frames 14, 15 (for example, if the frames are black, a white or yellow tear tape 27 is used), the noticeability is improved, thus reducing the likelihood of missing the removal of the tear tape.

Figure 38:
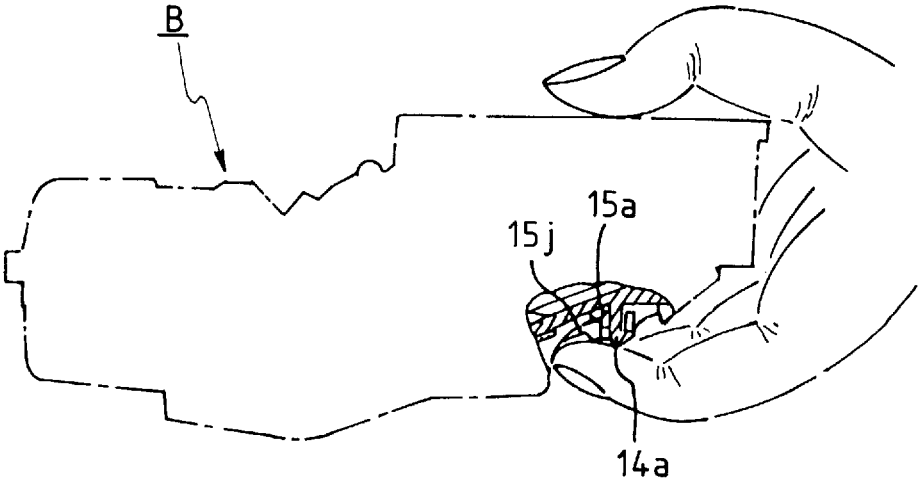
FIG. 38 is a schematic view showing a condition that the process cartridge is gripped by an operator's hand.

Further, for example, when a U-shaped guide rib for temporarily holding the tear tape 27 is provided on the gripper portion 14*f* of the upper frame 14, it is possible to surely and easily expose the tear tape 27 at a predetermined position during the interconnection between the upper and lower frames 14, 15. Incidentally, when the process cartridge B is assembled by interconnecting the upper and lower frames 14, 15, since the recess 15*j* for receiving the regist roller 5*c*2 is formed in the outer surface of the lower frame 15, as shown in FIG. 38, the operator can surely grip the process cartridge B by inserting his fingers into the recess 15*j*. Further, in the illustrated embodiment, as shown in FIG. 6, slip preventing ribs 14*i* are formed on the process cartridge B so that the operator can easily grip the process cartridge by hooking his fingers against the ribs. Incidentally, since the recess for receiving (preventing the contact with) the regist roller 5*c*2 is formed in the lower frame 15 of the process cartridge B, it is possible to make the image forming system more small-sized.

Further, as shown in FIG. 6 since the recess 15*j* is formed along and in the vicinity of the locking pawls 14*a* and the locking openings 15*b* through which the upper and lower frames 14, 15 are interconnected, when the operator grips the process cartridge B by hooking his fingers against the recess 15*j*, the gripping force from the operator acts toward the locking direction, thus surely interlocking the locking pawls 14*a* and the locking openings 15*b*.

Figure 39A:
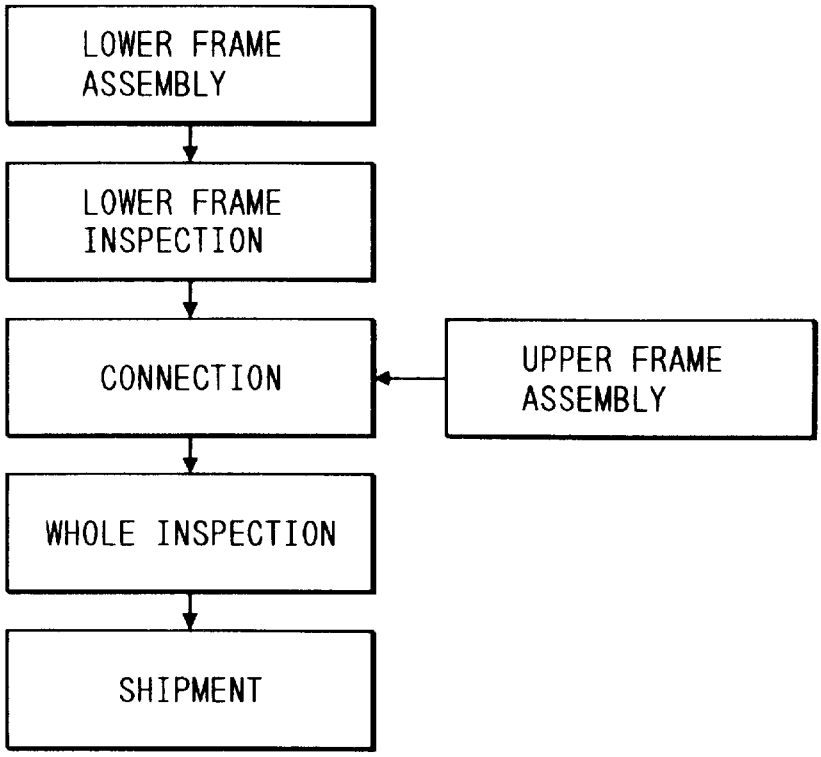
FIG. 39A is a flow chart showing the assembling and shipping procedure for the process cartridge.

Now, the assembling and shipping procedure for the process cartridge B will be explained with reference to FIG. 39A. As shown, the various parts are assembled in the lower frame 15, and then, the lower frame into which the various parts are incorporated is checked (for example, the positional relation between the photosensitive drum 9 and the developing sleeve 12*d* is checked). Then, the lower frame 15 is interconnected to the upper frame 14 within which the parts such as the charger roller 10 are assembled, thereby forming the process cartridge B. Thereafter, the total check of the process cartridge B is effected, and then the process cartridge is shipped. Thus, assembling and shipping is very simple.

(Mounting of Cartridge)

Next, the construction for mounting the process cartridge B within the image forming system A will be explained.

Figure 40:
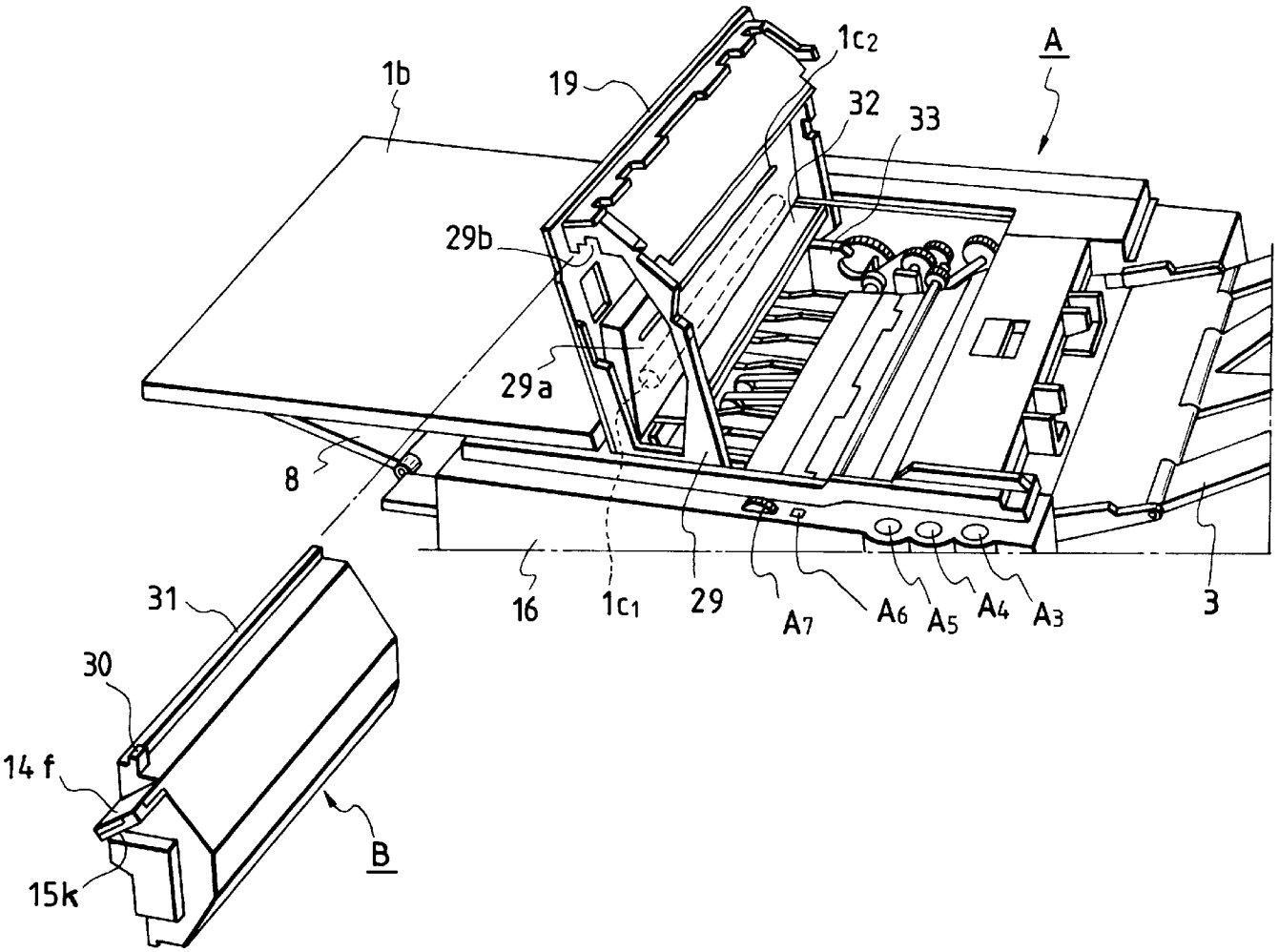
FIG. 40 is a perspective view showing a condition that the process cartridge is being mounted within the image forming system.

As shown in FIG. 40, a loading member 29 having a fitting window 29*a* matched to the contour of the process cartridge B is provided on the upper opening/closing cover 19 of the image forming system A. The process cartridge B is inserted into the image forming system through the fitting window 29*a* by gripping the gripper portions 14*f*, 15*k*. In this case, a guide ridge 31 formed on the process cartridge B is guided by a guide groove (not numbered) formed in the cover 19 and the lower portion of the process cartridge is guided a guide plate 32 having a hook at its free end.

Figure 41:
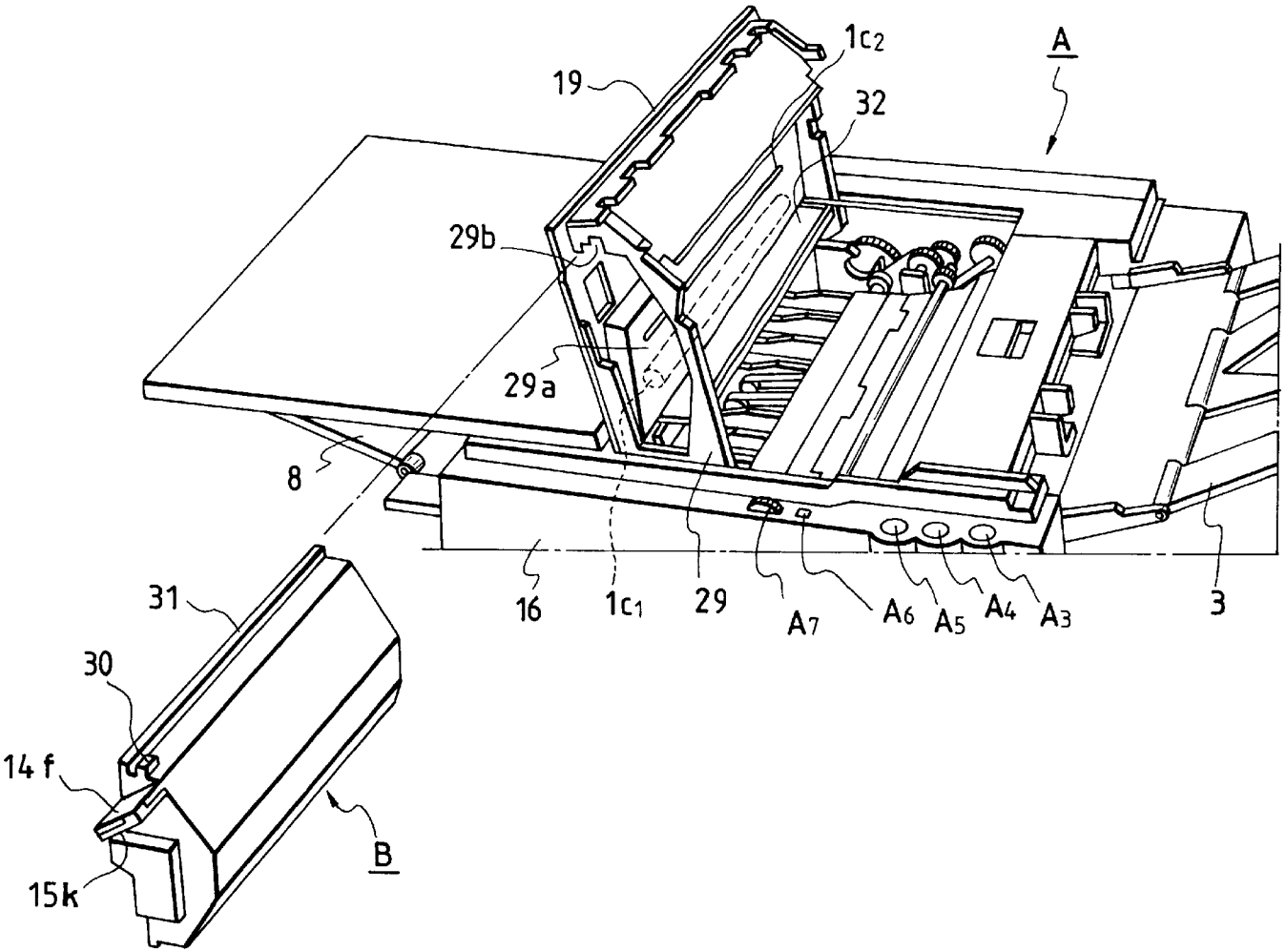
FIG. 41 is a perspective view showing a condition that the process cartridge of FIG. 24 is being mounted within the image forming system.

Incidentally, as shown in FIG. 40, a mis mount preventing projection 30 is formed on the process cartridge B and the fitting window 29*a* has a recess 29*b* for receiving the projection 30. As shown in FIGS. 40 and 41, the configuration or position of the projection 30 is differentiated depending upon a particular process cartridge containing the toner having the developing sensitivity suitable to a particular image forming system A (i.e. differentiated for each process cartridge), so that, even when a process cartridge containing the toner having the different developing sensitivity is tried to be mounted within the particular image forming system, since the projection 30 does not match with the fitting window 29*a* of that image forming system, it cannot be mounted within that image forming system. Accordingly, the mis mounting of the process cartridge B can be prevented, thus preventing the formation of an obscure image due to the different developing sensitive toner. Incidentally, it is also possible to prevent the mis mounting of a process cartridge including a different kind of photosensitive drum, as well as the different developing sensitivity. Further, since the recess 29*b* and the projection 30 are situated at this side when the process cartridge is mounted, if the operator tries to erroneously mount the process cartridge within the image forming system, he can easily ascertain with his eyes the fact that the projection 30 is blocked by the filling member 29. Thus, the possibility that the operator may forcibly push the process cartridge into the image forming system to damage the process cartridge B and/or the image forming system A as in the conventional case can be avoided.

After the process cartridge B is inserted into the fitting window 29*a* of the opening/closing cover 19, when the cover 19 is closed, the rotary shaft 9*f* of the photosensitive drum 9 which is protruded from one side of the upper and lower frames 14, 15 is supported by a shaft support member 33 (FIG. 40) via a bearing 46*a*, and the rotary shaft 12*d*2 of the developing sleeve 12*d* which is protruded from one side of the upper and lower frames 14, 15 is supported by the shaft support member 33 via a slide bearing 46*b* and a bearing 46*c* (FIG. 35). On the other hand, the drum shaft portion 26*d* (FIG. 35) of the bearing member 26 attached to the other end of the photosensitive drum 9 is supported by a shaft support member 34 shown in FIG. 42.

In this case, the protection cover 22 is rotated to expose the photosensitive drum 9, with the result that the photosensitive drum 9 is contacted with the transfer roller 6 of the image forming system A. Further, the drum earthing contact 18*a* contacting the photosensitive drum 9, the developing bias contact 18*b* contacting the developing sleeve 12*d* and the charging bias contact 18*c* contacting the charger roller 10 are provided on the process cartridge B so that these contacts protrude from the lower surface of the lower frame 15, and these contacts 18*a*, 18*b*, 18*c* are urgingly contacted with the drum earthing contact pin 35*a*, developing bias contact pin 35*b* and charging bias contact pin 35*c* (FIG. 42), respectively.

Figure 42:
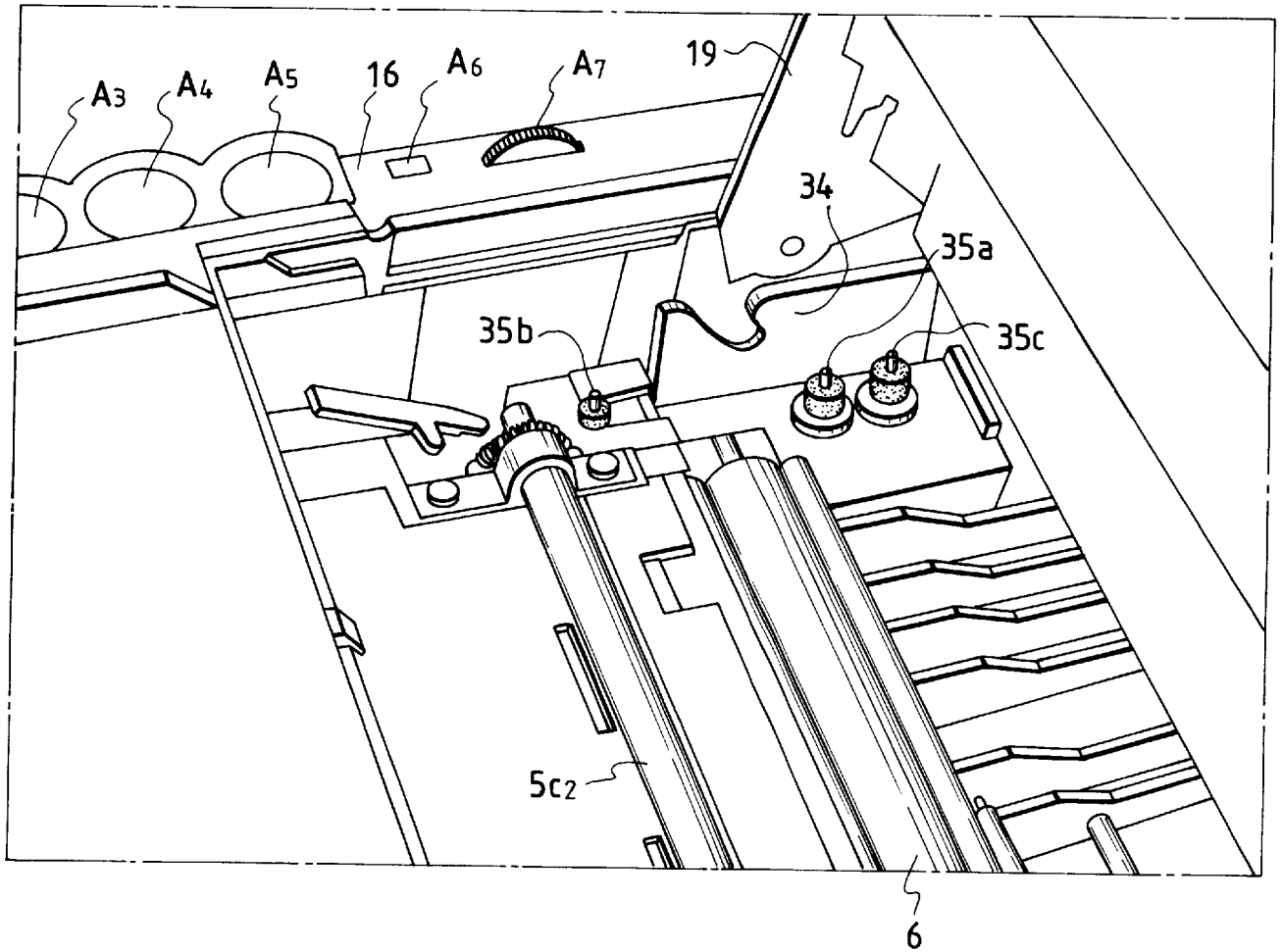
FIG. 42 is a perspective view showing the arrangement of three contacts provided on the image forming system.
Figure 43:
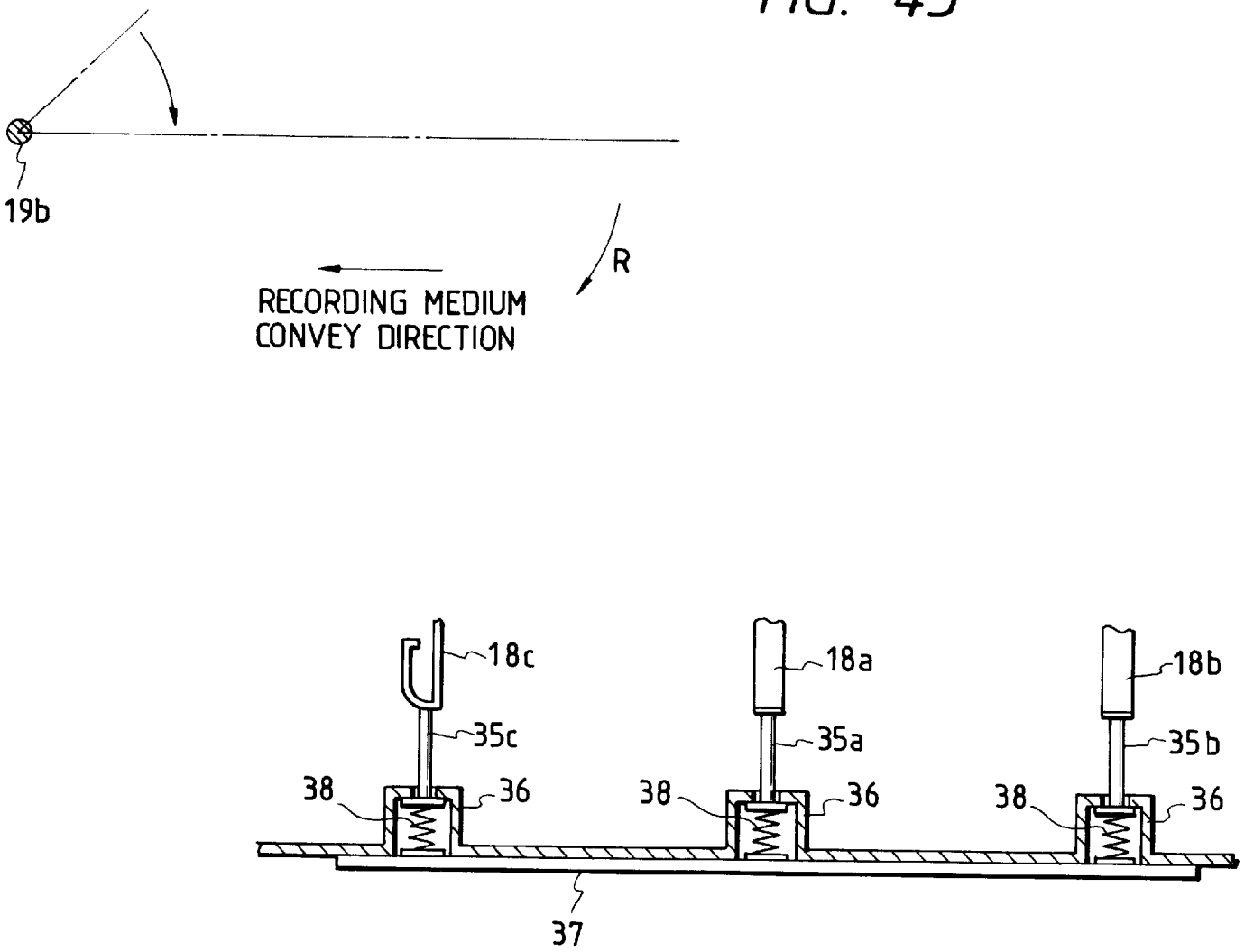
FIG. 43 is a sectional view showing the construction of the three contacts.

As shown in FIG. 42, these contact pins 35*a*, 35*b*, 35*c* are arranged so that the drum earthing contact pin 35*a* and the charging bias contact pin 35*c* are disposed at a downstream side of the transfer roller 6 in the recording medium feeding direction and the developing bias contact pin 35*b* is disposed at an upstream side of the transfer roller 6 in the recording medium feeding direction. Accordingly, as shown in FIG. 43, the contacts 18*a*, 18*b*, 18*c* provided on the process cartridge B are similarly arranged so that the drum earthing contact 18*a* and the charging bias contact 18*c* are disposed at a downstream side of the photosensitive drum 9 in the recording medium feeding direction and the developing bias contact 18*b* is disposed at an upstream side of the photosensitive drum 9 in the recording medium feeding direction.

Now, the disposition of the electric contacts of the process cartridge B will be explained with reference to FIG. 51. Incidentally, FIG. 51 is a schematic plan view showing the positional relation between the photosensitive drum 9 and the electric contacts 18*a*, 18*b*, 18*c*.

Figure 51:
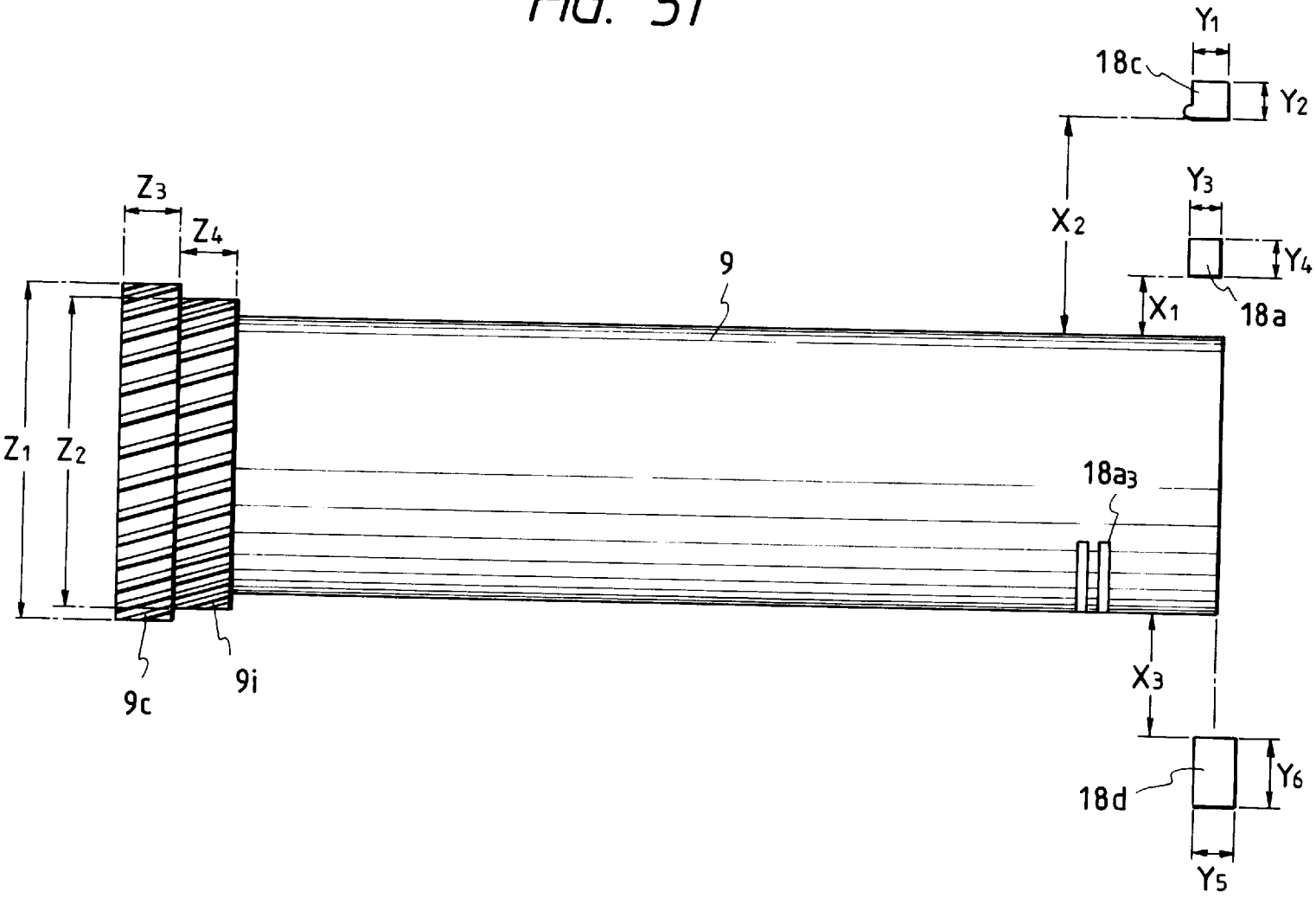
FIG. 51 is a view showing gears and contacts attached to the photosensitive drum.

As shown in FIG. 51, the contacts 18*a*, 18*b*, 18*c* are disposed at the end of the photosensitive drum 9 opposite to the end where the flange gear 9*c* is arranged in the longitudinal direction of the drum. The developing bias contact 18*b* is disposed at one side of the photosensitive drum 9 (i.e. side where the developing means 12 is arranged), and the drum earthing contact 18*a* and the charging bias contact 18*c* are disposed at the other side of the photosensitive drum (where the cleaning means 13 is arranged). The drum earthing contact 18*a* and the charging bias contact 18*c* are substantially arranged on a straight line. Further, the developing bias contact 18*b* is arranged slightly outwardly of the positions of the drum earthing contact 18*a* and the charging bias contact 18*c* in the longitudinal direction of the photosensitive drum 9. The drum earthing contact 18*a*, the developing bias contact 18*b* and the charging bias contact 18*c* are spaced apart from the outer peripheral surface of the photosensitive drum 9 gradually in order (i.e. a distance between the contact 18*a* and the drum is smallest, and a distance between the contact 18*c* and the drum is greatest). Further, an area of the developing bias contact 18*b* is greater than an area of the drum earthing contact 18*a* and an area of the charging bias contact 18*c*. Furthermore, the developing bias contact 18*b*, the drum earthing contact 18*a* and the charging bias contact 18*c* are disposed outwardly of a position where the arm portions 18*a*3 of the drum earthing contact 18*a* are contacted with the inner surface of the photosensitive drum 9, in the longitudinal direction of the photosensitive drum 9.

As mentioned above, by arranging the electric contacts between the process cartridge (which can be mounted within the image forming system) and the image forming system at the positioning and abutting side of the process cartridge, it is possible to improve the positional accuracy between the contacts of the process cartridge and the contact pins of the image forming system, thereby preventing the poor electrical connection, and, by arranging the contacts at the non-driving side of the process cartridge, it is possible to make the configurations of the contact pins of the image forming system simple and small-sized.

Further, since the contacts of the process cartridge are disposed inside of the contour of the frames of the process cartridge, it is possible to prevent foreign matters from adhering to the contacts, and, thus, to prevent the corrosion of the contacts; and, further to prevent the deformation of the contacts due to the external force. Further, since the developing bias contact 18*b* is arranged at the side of the developing means 12 and the drum earthing contact 18*a* and the charging bias contact 18*c* are arranged at the side of the cleaning means 13, the arrangement of electrodes in the process cartridge can be simplified, thus making the process cartridge small-sized.

Now, dimensions of various parts in the illustrated embodiment will be listed below. However, it should be noted that these dimensions are merely an example, and the present invention is not limited to this example:

| | |
|---|---|
| (1) Distance (X1) between the photosensitive drum 9 and the drum earthing contact 18a | about 6.0 mm; |
| (2) Distance (X2) between the photosensitive drum 9 and the charging bias contact 18c | about 18.9 mm; |
| (3) Distance (X3) between the photosensitive drum 9 and the developing bias contact 18b | about 13.5 mm; |
| (4) Width (Y1) of the charging bias contact 18c | about 4.9 mm; |
| (5) Length (Y2) of the charging bias contact 18c | about 6.5 mm; |
| (6) Width (Y3) of the drum earthing contact 18a | about 5.2 mm; |
| (7) Length (Y4) of the drum earthing contact 18a | about 5.0 mm; |
| (8) Width (Y5) of the developing bias contact 18a | about 7.2 mm; |
| (9) Length (Y6) of the developing bias contact 18a | about 8.0 mm |
| (10) Diameter (Z1) of the flange gear 9c | about 28.6 mm; |
| (11) Diameter (Z2) of the gear 9i | about 26.1 mm; |
| (12) Width (Z3) of the flange gear 9c | about 6.7 mm; |
| (13) Width (Z3) of the gear 91 | about 4.3 mm; |
| (14) Number of teeth of the flange gear 9c | 33; and |
| (15) Number of teeth of the gear 9i | 30. |

Now, the flange gear 9*c* and the gear 9*i* will be explained. The gears 9*c*, 9*i* comprise helical gears. When the driving force is transmitted from the image forming system to the flange gear 9*c*, the photosensitive drum 9 mounted in the lower frame 15 with play is subjected to the thrust force to be shifted toward the flange gear 9*c*, thereby positioning the drum at the side of the lower frame 15.

The gear 9*c* is used with a process cartridge containing the magnetic toner for forming a black image. When the black image forming cartridge is mounted within the image forming system, the gear 9*c* is meshed with a gear of the image forming system to receive the driving force for rotating the photosensitive drum 9 and is meshed with a gear of the developing sleeve 12*d* to rotate the latter. The gear 9*i* is meshed with a gear connected to the transfer roller 6 of the image forming system to rotate the transfer roller. In this case, the rotational load does not act on the transfer roller 6.

Incidentally, the gear 9*i* is used with a color image forming cartridge containing the non-magnetic toner. When the color image forming cartridge is mounted within the image forming system, the gear 9*c* is meshed with the gear of the image forming system to receive the driving force for rotating the photosensitive drum 9. On the other hand, the gear 9*i* is meshed with the gear connected to the transfer roller 6 of the image forming system to rotate the transfer roller and is meshed with the gear of the developing sleeve 12*d* for the non-magnetic toner to rotate the latter. The flange gear 9*c* has a diameter greater than that of the gear 9*i*, a width greater than that of the gear 9*i* and a number of teeth greater than-that of the gear 9*i*. Thus, even when the greater load is applied to the gear 9*c*, the gear 9*c* can receive the driving force to rotate the photosensitive drum 9 more surely, and can transmit the greater driving force to the developing sleeve 12*d* for the magnetic toner to rotate the latter more surely.

Incidentally, as shown in FIG. 43, each of the contact pins 35*a*–35*c* is held in a corresponding holder cover 36 in such a manner that it can be shifted in the holder cover but cannot be detached from the holder cover. Each contact pin 35*a*–35*c* is electrically connected to a wiring pattern printed on an electric substrate 37 to which the holder covers 36 are attached, via a corresponding conductive compression spring 38. Incidentally, the charging bias contact 18*c* to be abutted against the contact pin 35*c* has the arcuated curvature in the vicinity of the pivot axis 19*b* of the upper opening/closing cover 19 so that, the opening/closing cover 19 with the process cartridge B mounted thereon, is rotated around the pivot axis 19*b* in a direction shown by the arrow R to close the cover, and in so doing the charging bias contact 18*c* nearest to the pivot axis 19*b* (i.e. having the minimum stroke) can contact with the contact pin 35*c* effectively.

(Positioning)

When the process cartridge B is mounted and the opening/closing cover 19 is closed, the positioning is established so that a distance between the photosensitive drum 9 and the lens unit 1*c* and a distance between the photosensitive drum 9 and the original glass support 1*a* are kept constant. Such positioning will now be explained.

As shown in FIG. 8, positioning projections 15*m* are formed on the lower frame 15 to which the photosensitive drum 9 is attached, in the vicinity of both longitudinal ends of the frame. As shown in FIG. 5, when the upper and lower frames 14, 15 are interconnected, these projections 15*m* protrude upwardly through holes 14*g* formed in the upper frame 14.

Figure 44:
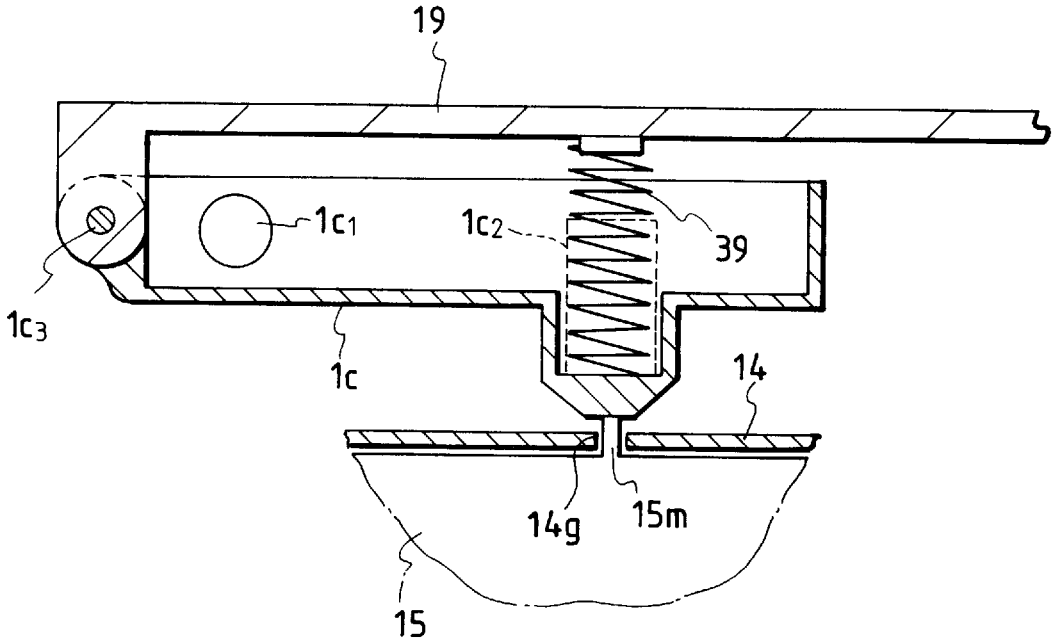
FIG. 44 is a sectional view for explaining the relative positioning between the lower frame and a lens unit.

Further, as shown in FIG. 44, the lens unit 1*c* containing therein the lens array 1*c*2 for reading the original 2 is attached to the upper opening/closing cover 19 (on which the process cartridge B is mounted) via a pivot pin 1*c*3 for slight pivotal movement around the pivot pin and is biased downwardly (FIG. 44) by an urging spring 39. Thus, when the process cartridge B is mounted on the upper cover 19 and the latter is closed, as shown in FIG. 44, the lower surface of the lens unit 1*c* is abutted against the positioning projections 15*m* of the process cartridge B. As a result, when the process cartridge B is mounted within the image forming system A, the distance between the lens array 1*c*2 in the lens unit 1*c* and the photosensitive drum 9 mounted on the lower frame 15 is accurately determined, so that the light image optically read from the original 2 can be accurately illuminated onto the photosensitive drum 9 via the lens array 1*c*2.

Figure 45:
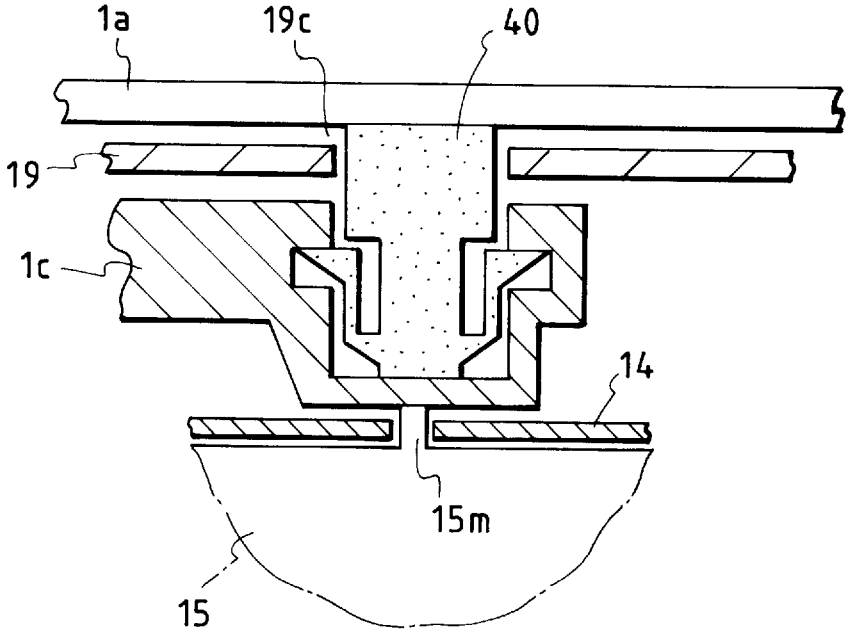
FIG. 45 is a sectional view for explaining the relative positioning between the lower frame and an original glass support.
Figure 46:
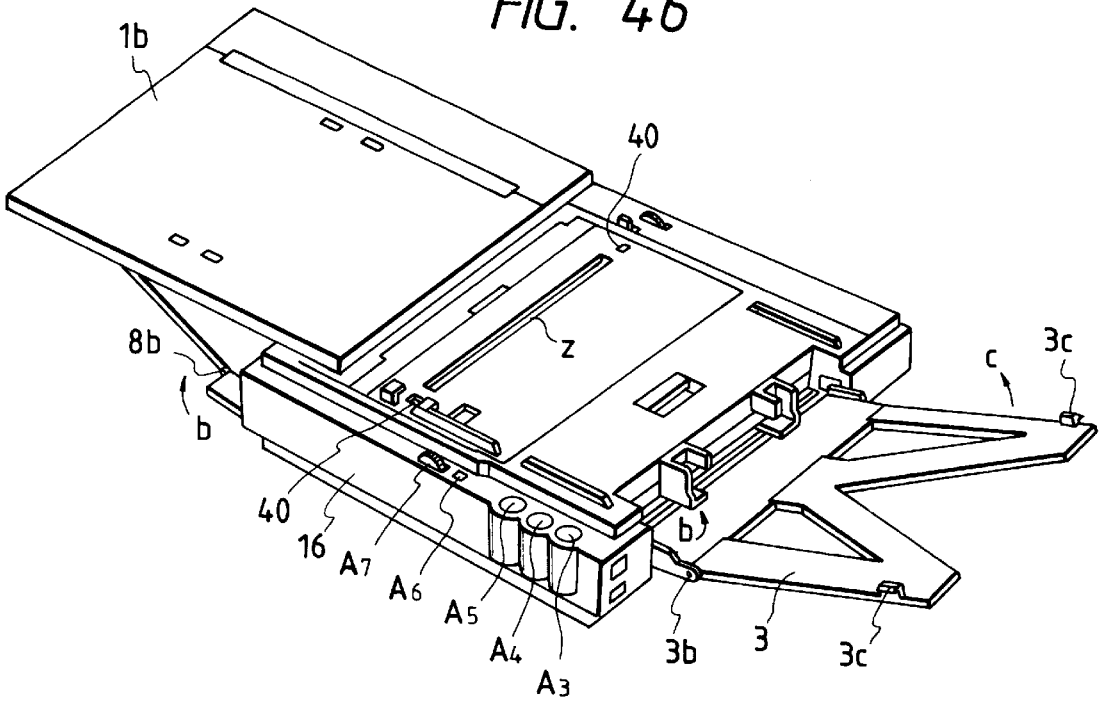
FIG. 46 is a perspective view showing the attachment positions of positioning pegs.

Further, as shown in FIG. 45, positioning pegs 40 are provided in the lens unit 1*c*, which positioning pegs can be protruded slightly from the upper cover 19 upwardly through holes 19*c* formed in the upper cover. As shown in FIG. 46, the positioning pegs 40 are protruded slightly at both longitudinal sides of an original reading slit Z (FIGS. 1 and 46). Thus, when the process cartridge B is mounted on the upper cover 19 and the latter is closed and then the image forming operation is started, as mentioned above, since the lower surface of the lens unit 1*c* is abutted against the positioning projections 15*m*, the original glass support 1*a* is shifted while riding on the positioning pegs 40. As a result, a distance between the original 2 rested on the original glass support 1*a* and the photosensitive drum 9 mounted on the lower frame 15 is always kept constant, thus illuminating the light reflected from the original 2 onto the photosensitive drum 9 accurately. Therefore, since the information written on the original 2 can be optically read accurately and the exposure to the photosensitive drum 9 can be effected accurately, it is possible to obtain the high quality image.

(Drive Transmission)

Next, the driving force transmission to the photosensitive drum 9 in the process cartridge B mounted within the image forming system A will be explained.

Figure 47:
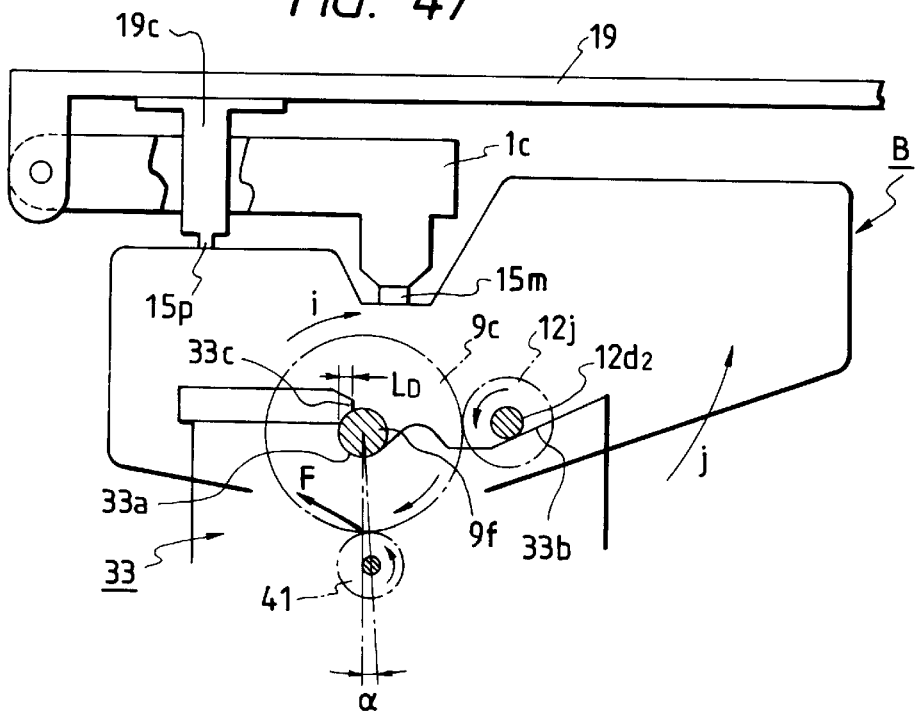
FIG. 47 is a schematic elevational view showing the relation between rotary shafts of the drum and of the sleeve and shaft supporting members therefor, and a transmitting direction of a driving force from a drive gear to a flange gear of the photosensitive drum.

When the process cartridge B is mounted within the image forming system A, the rotary shaft 9*f* of the photosensitive drum 9 is supported by the shaft support member 33 of the image forming system as mentioned above. As shown in FIG. 47, the shaft support member 33 comprises a supporting portion 33*a* for the drum rotary shaft 9*f*, and an abutment portion 33*b* for the rotary shaft 12*d*2 of the developing sleeve 12*d*. An overlap portion 33*c* having a predetermined overhanging amount L (1.8 mm in the illustrated embodiment) is formed on the supporting portion 33*a*, thus preventing the drum rotary shaft 9*f* from floating upwardly. Further, when the drum rotary shaft 9*f* is supported by the supporting portion 33*a*, the rotary shaft 12*d*2 of the developing sleeve is abutted against the abutment portion 33*b*, thus preventing the rotary shaft 12*d*2 from dropping downwardly. Further, when the upper opening/closing cover 19 is closed, positioning projections 15*p* of the lower frame 15 protruding from the upper frame 14 of the process cartridge B are abutted against an abutment portion 19*c* of the opening/closing cover 19.

Accordingly, when the driving force is transmitted to the flange gear 9*c* of the photosensitive drum 9 by driving the drive gear 41 of the image forming system meshed with the flange gear, the process cartridge B is subjected to a reaction force tending to rotate the process cartridge around the drum rotary shaft 9*f* in a direction shown by the arrow i in FIG. 47. However, since the rotary shaft 12*d*2 of the developing sleeve is abutted against the abutment portion 33*b* and the positioning projections 15*p* of the lower frame 15 protruding from the upper frame 14 are abutted against the abutment portion 19*c* of the upper cover, the rotation of the process cartridge B is prevented.

As mentioned above, although the lower surface of the lower frame 15 acts as the guide for the recording medium 4, since the lower frame is positioned by abutting it against the body of the image forming system as mentioned above, the positional relation between the photosensitive drum 9, the transfer roller 6 and the guide portions 15*h*1, 15*h*2 for the recording medium 4 is maintained with high accuracy, thus performing the feeding of the recording medium and the image transfer with high accuracy.

During the driving force transmission, the developing sleeve 12*d* is biased downwardly not only by the rotational reaction force acting on the process cartridge B but also by a reaction force generated when the driving force is transmitted from the flange gear 9*c* to the sleeve gear 12*j*. In this case, if the rotary shaft 12*d*2 of the developing sleeve is not abutted against the abutment portion 33*b*, the developing sleeve 12*d* will be always biased downwardly during the image forming operation. As a result, it is feared that the developing sleeve 12*d* will be displaced downwardly and/or the lower frame 15 on which the developing sleeve 12*d* is mounted will be deformed. However, in the illustrated embodiment, since the rotary shaft 12*d*2 of the developing sleeve is abutted against the aboutment portion 33*b* without fail, the above-mentioned inconvenience does not occur.

Figure 48:
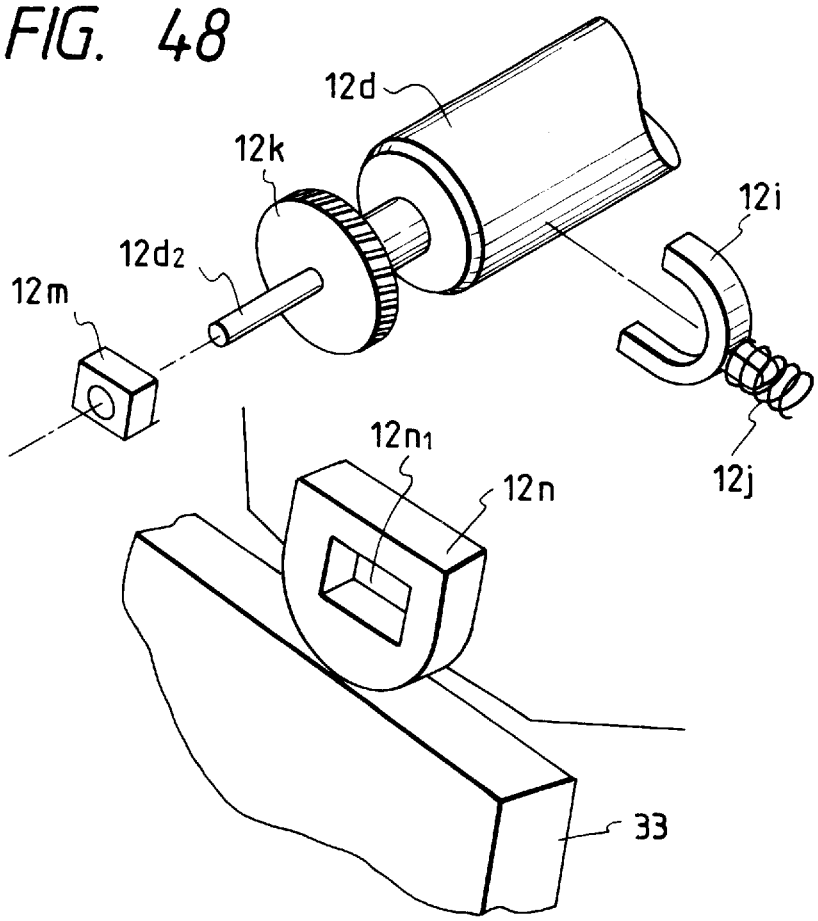
FIG. 48 is an exploded perspective view of a developing sleeve according to an embodiment wherein the developing sleeve can easily be slid.
Figure 49:
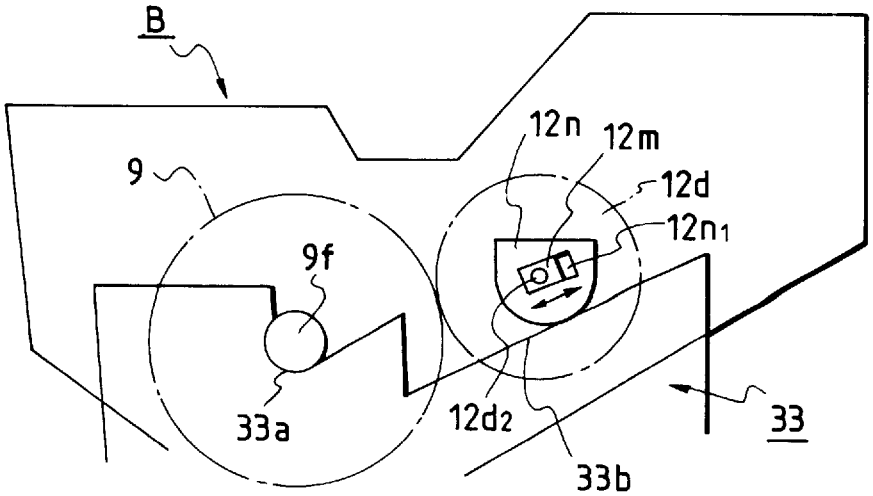
FIG. 49 is a schematic elevational view of the developing sleeve of FIG. 48.

Incidentally, as shown in FIG. 20 the developing sleeve 12*d* is biased against the photosensitive drum 9 by the springs 12*j* via the sleeve bearings 12*i*. In this case, the arrangement as shown in FIG. 48 may be adopted to facilitate the sliding movement of sleeve bearings 12*i*. That is to say, a bearing 12*m* for supporting the rotary shaft 12*d*2 of the developing sleeve is held in a bearing holder 12*n* in such a manner that the bearing 12*m* can slide along a slot 12*n*1 formed in the bearing holder. With this arrangement, as shown in FIG. 49, the bearing holder 12*n* is abutted against the abutment portion 33*b* of the shaft support member 33 and is supported thereby; in this condition, the bearing 12*m* can be slid along the slot 12*n*1 in directions shown by the arrow. Incidentally, in the illustrated embodiment, an inclined angle θ (FIG. 47) of the abutment portion 33*b* is selected to have a value of about 40 degrees.

Figure 52A:
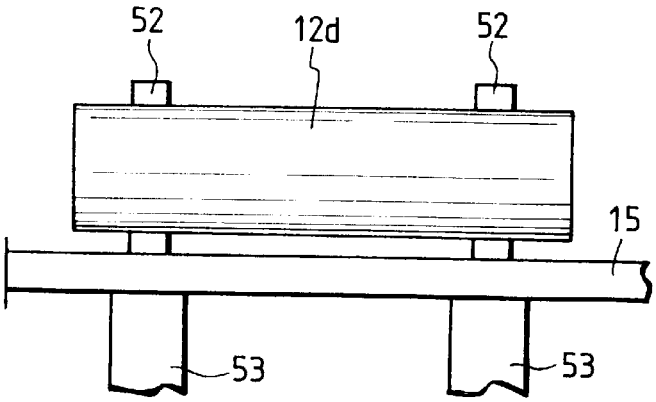
FIG. 52A is an elevational view of a developing sleeve receiving member according to another embodiment.
Figure 52B:
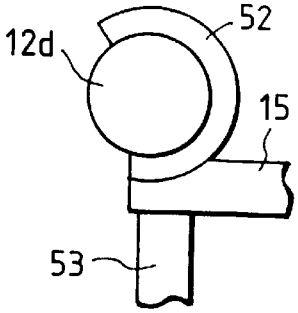
FIG. 52B is an end view of the receiving member of FIG. 52A.

Further, the developing sleeve 12*d* may be supported by means other than the sleeve rotary shaft. For example, as shown in FIGS. 52A and 52B, it may be supported at both of its ends portions by sleeve bearings 52, lower ends of which are supported by the lower frame 15 which is in turn supported by receiving portions 53 formed on the image forming system.

Further, in the illustrated embodiment, the flange gear 9*c* of the photosensitive drum 9 is meshed with the drive gear 41 for transmitting the driving force to the flange gear in such a manner that, as shown in FIG. 47, a line connecting a rotational center of the flange gear 9*c* and a rotational center of the drive gear 41 is offset from a vertical line passing through the rotational center of the flange gear 9*c* in an anti-clockwise direction by a small angle α (about 1° in the illustrated embodiment), whereby a direction F of the driving force transmission from the drive gear 41 to the flange gear 9*c* directs upwardly. In general, although the floating of the process cartridge can be prevented by a downwardly directing force generated by setting the angle α to a value of 20° or more, in the illustrated embodiment, such angle α is set to about 1°.

By setting the above-mentioned angle a to about 1°, when the upper opening/closing cover 19 is opened in a direction shown by the arrow j to remove the process cartridge B, the flange gear 9*c* is not blocked by the drive gear 41 and, thus, can be smoothly disengaged from the drive gear 41. Further, when the direction F of the driving force transmission is directed upwardly as mentioned above, the rotary shaft 9*f* of the photosensitive drum is pushed upwardly and, therefore, tends to be disengaged from the drum supporting portion 33*a*. However, in the illustrated embodiment, since the overlap portion 33*c* is formed on the supporting portion 33*a*, the drum rotary shaft 9*f* is not disengaged from the drum supporting portion 33*a*.

(Re-cycle)

The process cartridge having the above-mentioned construction permits recycling of used-up process cartridges. That is to say, the used-up process cartridge(s) can be collected from the market and the parts thereof can be re-used to form a new process cartridge. Such re-cycle will now be explained. Generally, the used-up process cartridge was disposed or dumped in the past. However, the process cartridge B according to the illustrated embodiment can be collected from the market after the toner in the toner reservoir has been used up, to protect the resources of the earth and the natural environment. Then, the collected process cartridge is disassembled into the upper and lower frames 14, 15 which are in turn cleaned. Thereafter, reusable parts and new parts are mounted on the upper frame 14 or the lower frame 15 as needed, and then new toner is supplied into the toner reservoir 12*a* again. In this way, a new process cartridge is obtained.

Figure 50:
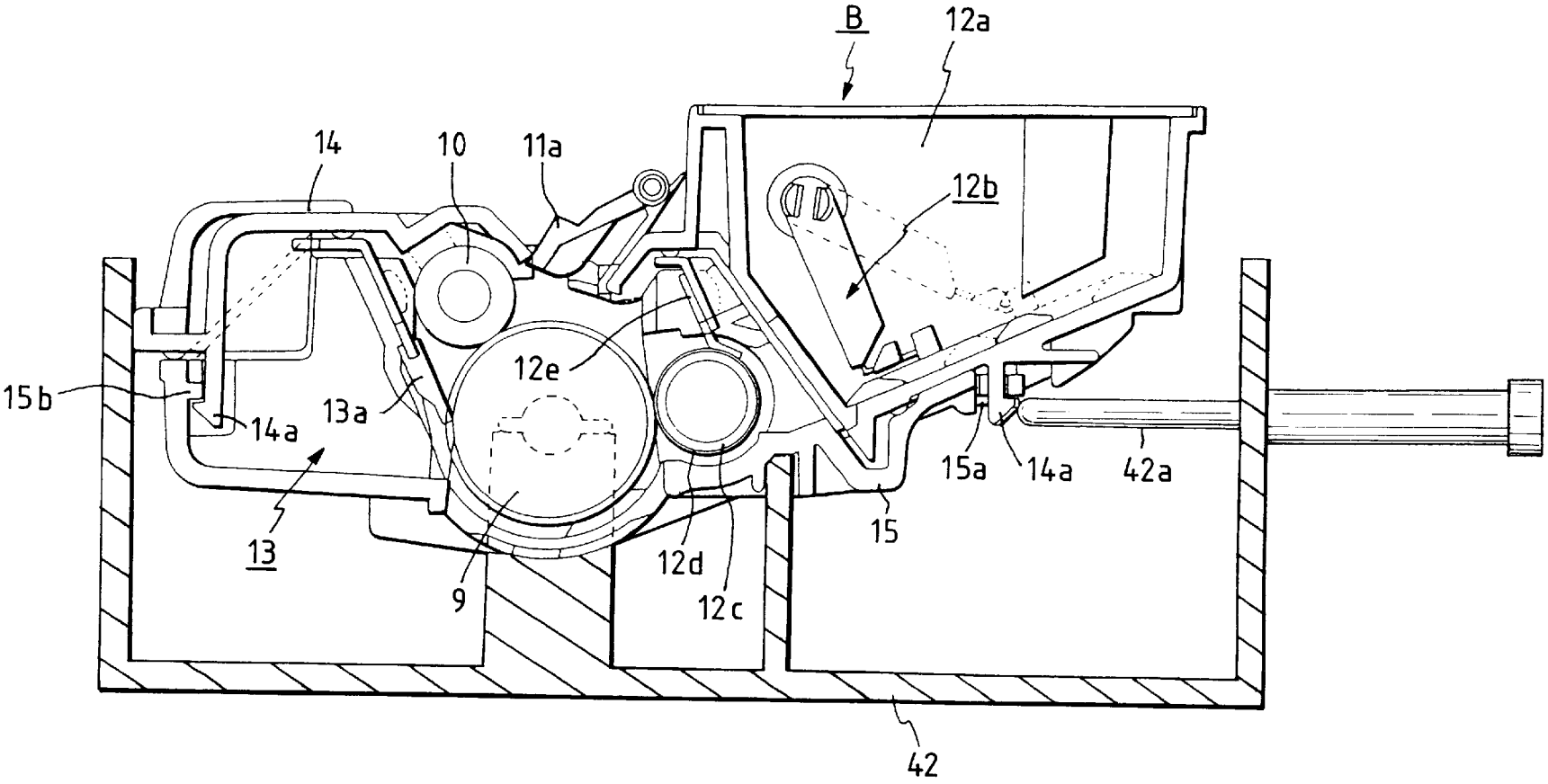
FIG. 50 is an elevational sectional view showing a condition that the upper frame and the lower frame are released.

More particularly, by releasing the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b* (FIGS. 4, 8 and 9) which interconnect the upper and lower frames 14, 15, the upper and lower frames 14, 15 can easily be disassembled from each other. Such disassembling operation can easily be performed, for example, by resting the used-up process cartridge B on a disassembling tool 42 and by pushing the locking pawl 14*a* by means of a pusher rod 42*a*, as shown in FIG. 50. Even when the disassembling tool is not used, the process cartridge can be disassembled by pushing the locking pawls 14*a*, 14*c*, 15*c*.

After the upper frame 14 and the lower frame 15 are disconnected from each other as mentioned above (FIGS. 8 and 9), the frames are cleaned by removing the waste toner adhered to or remaining in the cartridge by an air blow technique. In this case, a relatively large amount of waste toner is adhered to the photosensitive drum 9, developing sleeve 12*d* and/or cleaning means 13 since they are directly contacted with the toner. On the other hand, the waste toner is not or almost not adhered to the charger roller 10 since it is not directly contacted with the toner. Accordingly, the charger roller 10 can be cleaned more easily than the photosensitive drum 9, developing sleeve 12*d* and the like. In this regard, according to the illustrated embodiment, since the charger roller 10 is mounted on the upper frame 14 rather than the lower frame 15 on which the photosensitive drum 9, developing sleeve 12*d* and cleaning means 13 are mounted, the upper frame 14 separated from the lower frame 15 can easily be cleaned.

Figure 39B:
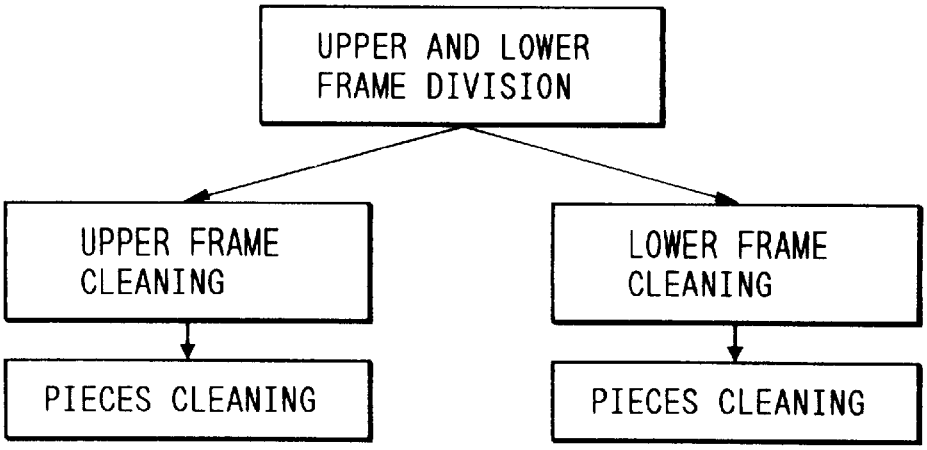
FIG. 39B is a flow chart showing the disassembling and cleaning procedure for the process cartridge.

In the disassembling and cleaning line as shown in FIG. 39B, first of all, the upper and lower frames 14, 15 are separated from each other as mentioned above. Then, the upper frame 14 and the lower frame 15 are disassembled and cleaned independently. Thereafter, as to the upper frame 14, the charger roller 10 is separated from the upper frame and is cleaned; and as to the lower frame 15, the photosensitive drum 9, developing sleeve 12*d*, developing blade 12*e*, cleaning blade 13*a* and the like are separated from the lower frame and are cleaned. Thus, the disassembling and cleaning line is very simple.

After the toner is cleared, as shown in FIG. 9, the opening 12*a*1 is sealed by a new cover film 28 again, and new toner is supplied into the toner reservoir 12*a* through the toner filling opening 12*a*3 formed in the side surface of the toner reservoir 12*a*, and then the filling opening 12*a*3 is closed by the lid 12*a*2. Then, the upper frame 14 and the lower frame 15 are interconnected again by achieving the connections between the locking pawls 14*a* and the locking openings 15*a*, the locking pawls 14*a* and the locking projection 15*b*, the locking pawl 14*c* and the locking opening 15*d*, and the locking pawl 15*c* and the locking opening 14*b*, thus assembling a process cartridge again in a usable condition.

Incidentally, when the upper and lower frames 14, 15 are interconnected, although the locking pawls 14*a* and the locking openings 15*a*, the locking pawls 14*a* and the locking projection 15*b* and the like are interlocked, when the same process cartridge is frequently re-cycled, it is feared that the locking forces between the locking pawls and the locking openings become weaker. To cope with this, in the illustrated embodiment, threaded holes are formed in the frames in the vicinity of four corners thereof. That is to say, through threaded holes are formed in the fitting recesses 14*d* and the fitting projections 14*e* of the upper frame 14 (FIG. 8) and in the fitting projections 15*e* (to be fitted into the recesses 14*d*) and the fitting recesses 15*f* (to be fitted onto the projections 14*e*) of the lower frame 15, respectively. Thus, even when the locking force due to the locking pawls become weaker, after the upper and lower frames 14, 15 are interconnected and the fitting projections and fitting recesses are interfitted, by screwing screws in the mated threaded holes, the upper and lower frames 14, 15 can be firmly interconnected.

Image forming Operation

Next, the image forming operation effected by the image forming system A within which the process cartridge B is mounted will be explained.

First of all, the original 2 is rested on the original glass support la shown in FIG. 1. Then, when the copy start button A3 is depressed, the light source 1*c*1 is turned ON and the original glass support 1*a* is reciprocally shifted on the image forming system in the left and right directions in FIG. 1 to read the information written on the original optically. In registration with the reading of the original, the sheet supply roller 5*a* and the pair of register rollers 5*c*1, 5*c*2 are rotated to feed the recording medium 4 to the image forming station. The photosensitive drum 9 is rotated in the direction d in FIG. 1 in registration of the feeding timing of the paired regist rollers 5*c*1, 5*c*2, and is uniformly charged by the charger means 10. Then, the light image read by the reading means 1 is illuminated onto the photosensitive drum 9 via the exposure means 11, thereby forming the latent image on the photosensitive drum 9.

At the same time when the latent image is formed, the developing means 12 of the process cartridge B is activated to drive the toner feed mechanism 12*b*, thereby feeding out the toner from the toner reservoir 12*a* toward the developing sleeve 12*d* and forming the toner layer on the rotating developing sleeve 12*d*. Then, by applying to the developing sleeve 12*d* a voltage having the same charging polarity and same potential as that of the photosensitive drum 9, the latent image on the photosensitive drum 9 is visualized as the toner image. In the illustrated embodiment, the voltage of about 1.2 KVVpp, 1590 Hz (rectangular wave) is applied to the developing sleeve 12*d*. The recording medium 4 is fed between the photosensitive drum 9 and the transfer roller 6. By applying to the transfer roller 6 a voltage having the polarity opposite to that of the toner, the toner image on the photosensitive drum 9 is transferred onto the recording medium 4. In the illustrated embodiment, the transfer roller 6 is made of foam EPDM having the volume resistance of about $10^9$ Ωcm and has an outer diameter of about 20 mm, and the voltage of −3.5 KV is applied to the transfer roller as the transfer voltage.

After the toner image is transferred to the recording medium, the photosensitive drum 9 continues to rotate in the direction d. Meanwhile, the residual toner remaining on the photosensitive drum 9 is removed by the cleaning blade 13*a*, and the removed toner is collected into the waste toner reservoir 13*c* via the squeegee sheet 13*b*. On the other hand, the recording medium 4 on which the toner image was transferred is sent, by the convey belt 5*d*, to the fixing means 7 where the toner image is permanently fixed to the recording medium 4 with heat and pressure. Then, the recording medium is ejected by the pair of ejector rollers 5*f*1, 5*f*2. In this way, the information on the original is recorded on the recording medium.

Next, other embodiments will be explained.

Figure 53:
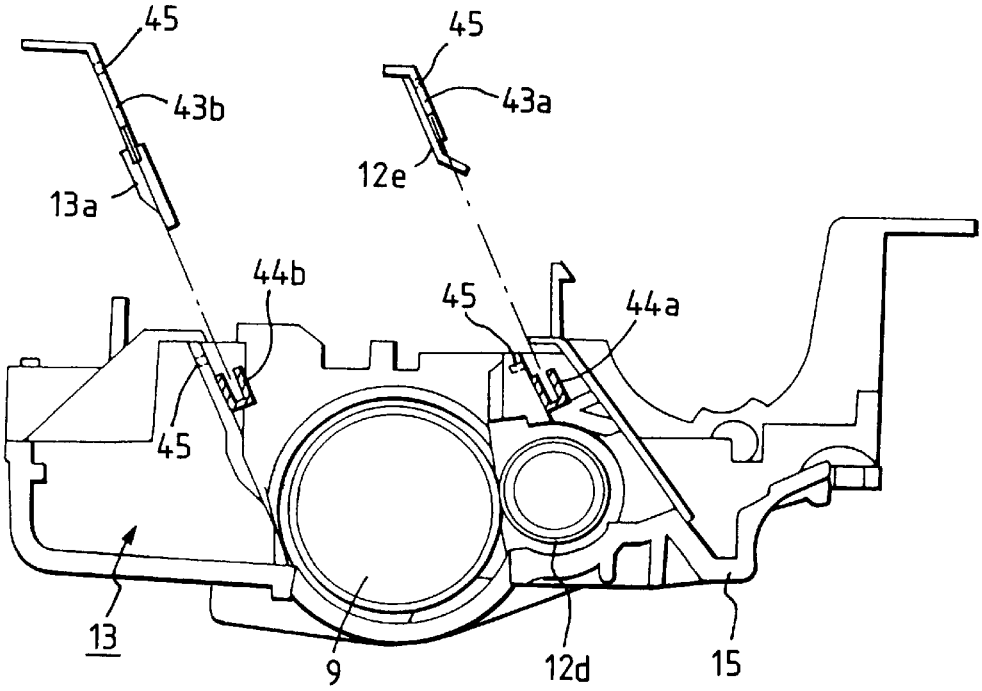
FIG. 53 is an elevational view showing an arrangement wherein the developing blade and the cleaning blade can be attached to the interior of the image forming system by pins.

In the above-mentioned first embodiment, an example wherein the developing blade 12*e* and the cleaning blade 13*a* are attached to the frame by pins 24*a*, 24*b* was explained alternatively, as shown in FIG. 53, the developing blade 12*e* and the cleaning blade 13*a* are attached to the lower frame 15 by forcibly inserting fitting projections 43*a*, 43*b* formed on both longitudinal ends of the developing blade 12*e* and the cleaning blade 13*e* into corresponding fitting recesses 44*a*, 44*b* formed in the body 16 of the image forming system. Pin holes 45 for receiving the pins for attaching the blades 12*e*, 13*a* may be formed in the vicinity of the fitting projections 43*a*, 43*b*, and corresponding pin holes 45 may be formed in the body 16 of the image forming system (Incidentally, in place of the fitting projections 43*a*, 43*b*, half punches or circular bosses may be used).

With this arrangement, when the fitting connections between the blades 12*e*, 13*a* and the lower frame are loosened by the repeated recycling of the process cartridge B, the blades 12*e*, 13*a* can be firmly attached to the lower frame by pins.

Figure 54:
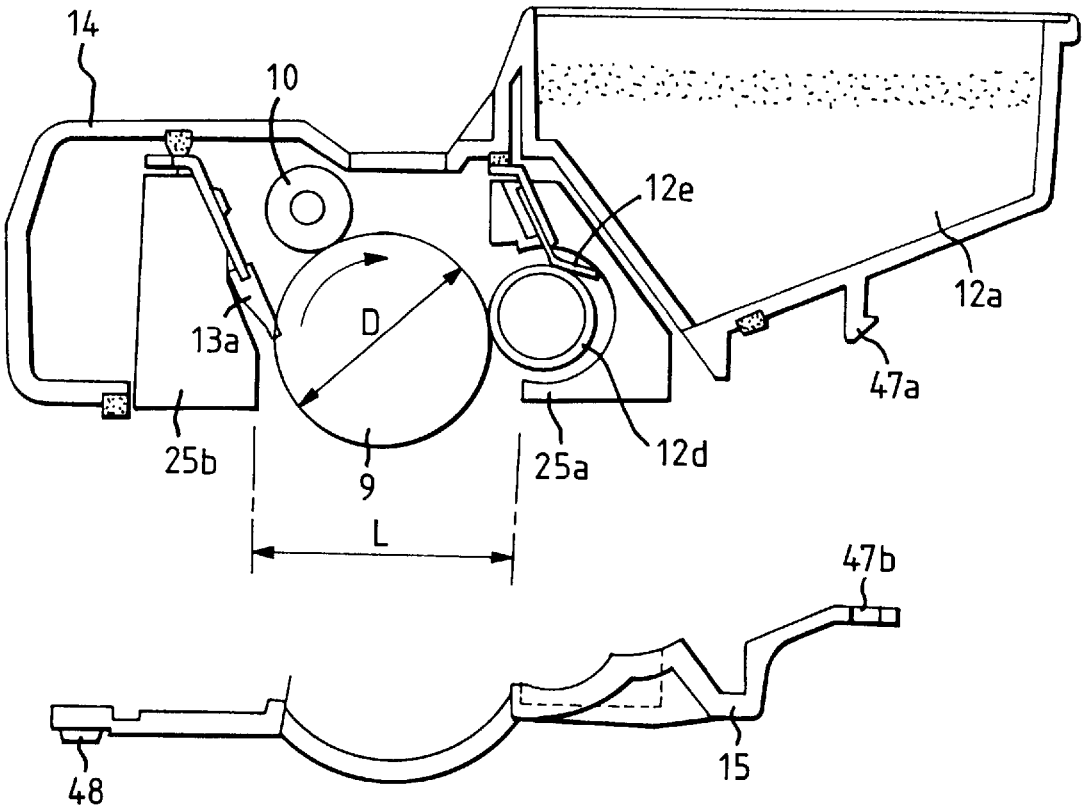
FIG. 54 an elevational view showing a condition of final assembly of the photosensitive drum, according to another embodiment.

Further, in the first embodiment, as shown in FIG. 29, an example that the outer diameter D of the photosensitive drum 9 is smaller than the distance L between the drum guide members 25*a*, 25*b* to permit the final attachment of the photosensitive drum 9 to the lower frame 15 was explained. As shown in FIG. 54, even when the photosensitive drum 9 is incorporated into the upper frame 14, the outer diameter D of the photosensitive drum 9 may be smaller than the distance L between the drum guide members 25*a*, 25*b* so that the photosensitive drum can be lastly incorporated into the upper frame, thereby preventing damage to the surface of the photosensitive drum 9, as in the first embodiment. Incidentally, in FIG. 54, elements or parts having the same function as those in the first embodiment are designated by the same reference numerals. Further, the upper and lower frames 14, 15 are interconnected by interlocking locking projections 47*a* and locking openings 47*b* and by securing them by pins 48.

Figure 55:
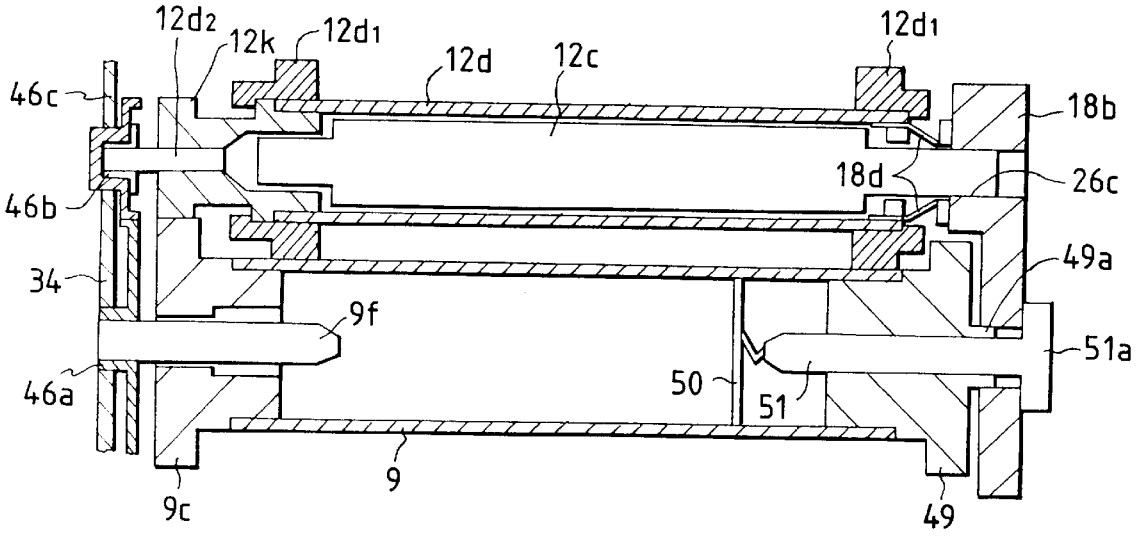
FIG. 55 is an elevational sectional view of bearing members for supporting the photosensitive drum and the developing sleeve, according to another embodiment.

Further, as shown in FIG. 35, in the first embodiment, while the photosensitive drum 9 and the developing sleeve 12*d* were supported by the bearing member 26, when the flange gear 9*c* is provided at one end of the photosensitive drum 9 and the transfer roller gear 49 is provided at the other end of the photosensitive drum, a structure as shown in FIG. 55 may be adopted. Incidentally, also in FIG. 55, elements having the same function as those in the first embodiment are designated by the same reference numerals.

More particularly, in FIG. 55, the flange gear 9*c* and the transfer roller gear 49 are secured to both ends of the photosensitive drum 9 by adhesive, press-fit or the like, respectively, and the positioning of the drum is effected by rotatably supporting a central boss 49*a* of the transfer roller gear 49 by the bearing portion 33*a* of the bearing member 26. In this case, in order to earth the photosensitive drum 9, a drum earthing plate 50 having a central L-shaped contact portion is secured to and contacted with the inner surface of the drum, and a drum earthing shaft 51 passing through a central bore in the transfer roller gear 49 is always contacted with the drum earthing plate 50. The drum earthing shaft 51 is made of conductive metal such as stainless steel, and the drum earthing plate 50 is also made of conductive metal such as bronze phosphate, stainless steel or the like. When the process cartridge B is mounted within the image forming system A, a head 51*a* of the drum earthing shaft 51 is supported by the bearing member 26. In this case, the head 51*a* of the drum earthing shaft 51 is contacted with the drum earthing contact pin of the image forming system, thereby achieving the earthing of the photosensitive drum. Also in this case, as in the first embodiment, the positional accuracy between the photosensitive drum 9 and the developing sleeve 12*d* can be improved by using the single bearing member 26.

Further, the process cartridge B according to the present invention can be used to not only form a mono-color image as mentioned above, but also to form a multi-color image (two color image, three color image or full-color image) by providing a plurality of developing means 12. Furthermore, the developing method may be of known two-component magnetic brush developing type, cascade developing type, touch-down developing type or cloud developing type. In addition, in the first embodiment, while the charger means was of the so-called contact-charging type, for example, other conventional charging technique wherein three walls are formed by tangsten wires and metallic shields made of aluminium are provided on the three walls, and positive or negative ions generated by applying a high voltage to the tangsten wires are shifted onto the surface of the photosensitive drum 9, thereby uniformly charging the surface of the photosensitive drum 9 may be adopted.

Incidentally, the contact-charging may be, for example, of blade (charging blade) type, pad type, block type, rod type or wire type, as well as the aforementioned roller type. Further, the cleaning means for removing the residual toner remaining on the photosensitive drum 9 may be of fur brush type or magnetic brush type, as well as blade type.

Furthermore, the process cartridge B comprises an image bearing member (for example, an electrophotographic photosensitive member) and at least one process means. Therefore, as well as the above-mentioned construction, the process cartridge may incorporate integrally therein the image bearing member and the charger means as a unit which can be removably mounted within the image forming system; or may incorporate integrally therein the image bearing member and the developing means as a unit which can be removably mounted within the image forming system; or may incorporate integrally therein the image bearing member and the cleaning means as a unit which can be removably mounted within the image forming system; or may incorporate integrally therein the image bearing member and two or more process means as a unit which can be removably mounted within the image forming system. That is to say, the process cartridge incorporates integrally therein the charger means, developing means or cleaning means and the electrophotographic photosensitive member as a unit which can be removably mounted within the image forming system; or incorporates integrally therein at least one of the charger means, developing means and cleaning means, and the clectrophotographic photosensitive member as a unit which can be removably mounted within the image forming system; or incorporates integrally therein the developing means and the electrophotographic photosensitive member as a unit which can be removably mounted within the image forming system.

Further, in the illustrated embodiment, while the image forming system was the electrophotographic copying machine, the present invention is not limited to the copying machine, but may be adapted to other various image forming system such as a laser beam printer, a facsimile, a word processor and the like.

Figure 56:
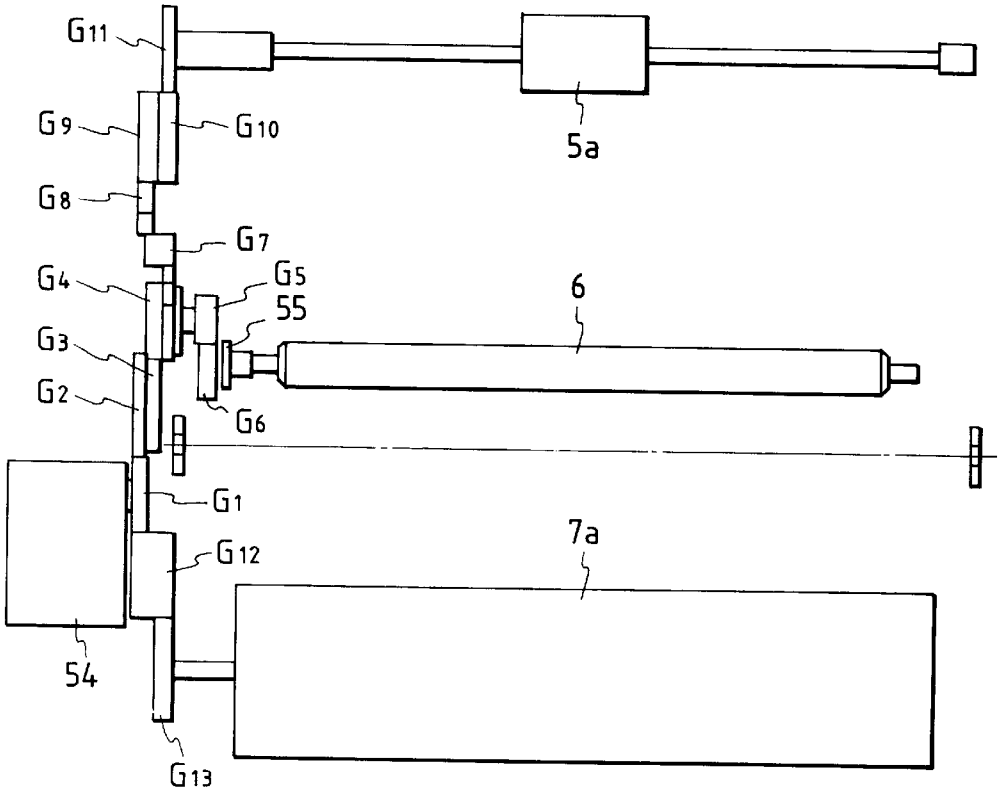
FIG. 56 is a schematic view of a transmission mechanism for transmitting a driving force from a drive motor of the image forming system to various elements.

Now, the above-mentioned driving force transmission to the photosensitive drum 9 will be further explained with more detail. As shown in FIG. 56, the driving force is transmitted from the drive motor 54 attached to the body 16 of the image forming system to a drive gear G6 via a gear train G1–G5, and from the drive gear G6 to the flange gear 9*c* meshed with the drive gear, thereby rotating the photosensitive drum 9. Further, the driving force of the drive motor 54 is transmitted from the gear G4 to a gear train G7–G11, thereby rotating the sheet supply roller 5*a*. Furthermore, the driving force of the drive motor 54 is transmitted from the gear G1 to the driving roller 7*a* of the fixing means 7 via gears G12, G13.

Figure 57:
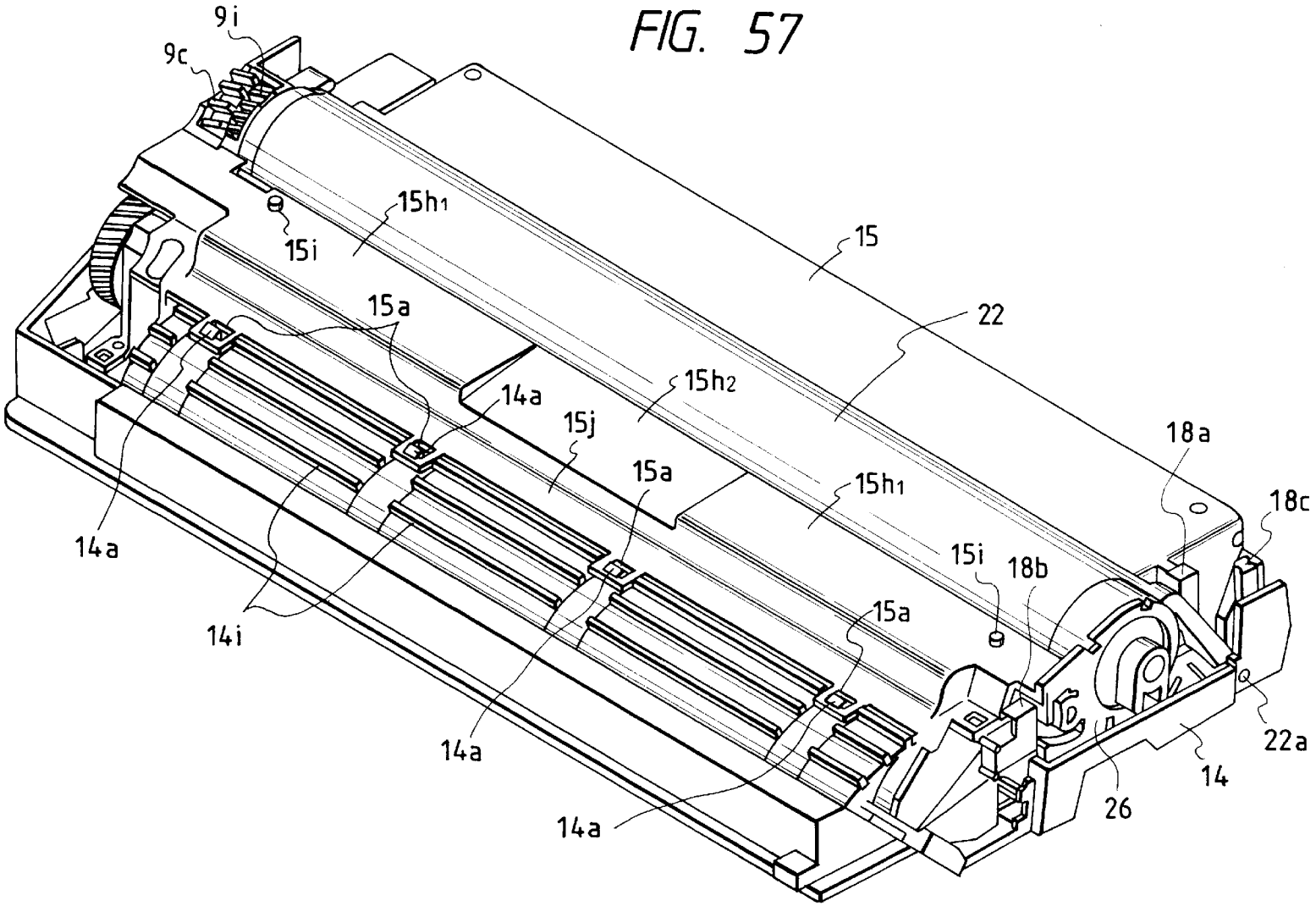
FIGS. 57 and 58 are perspective views showing a condition that the flange gear of the photosensitive drum and a gear integral with the flange gear are protruded from the lower frame.
Figure 58:
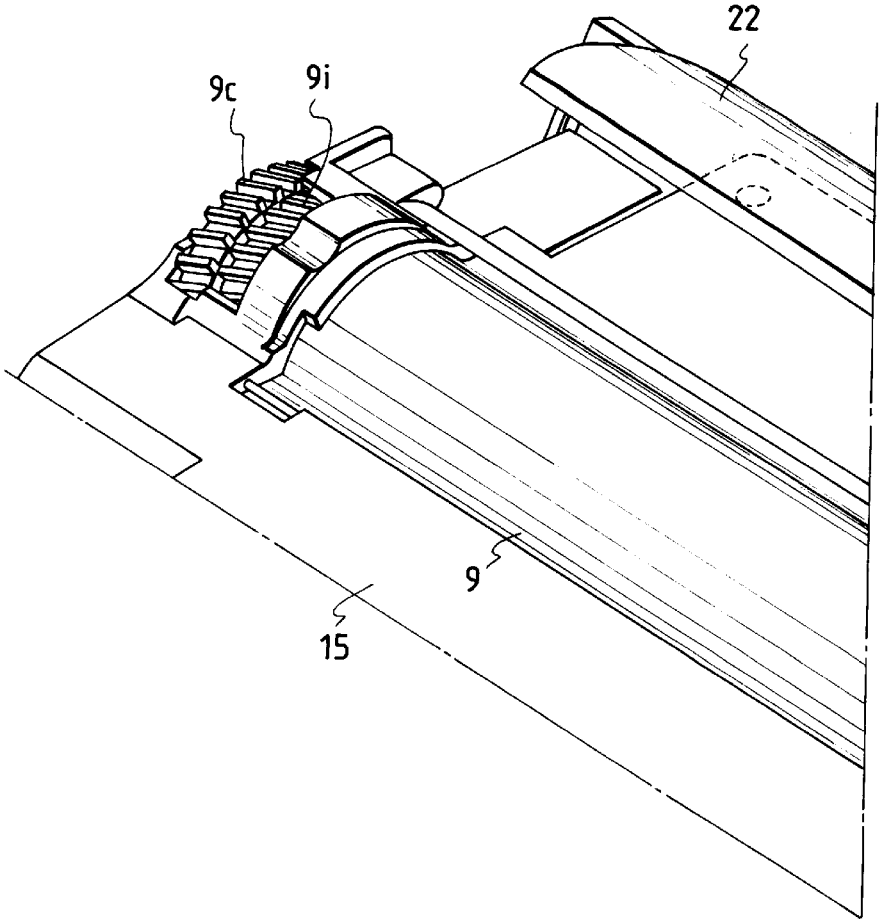
Figure 59:
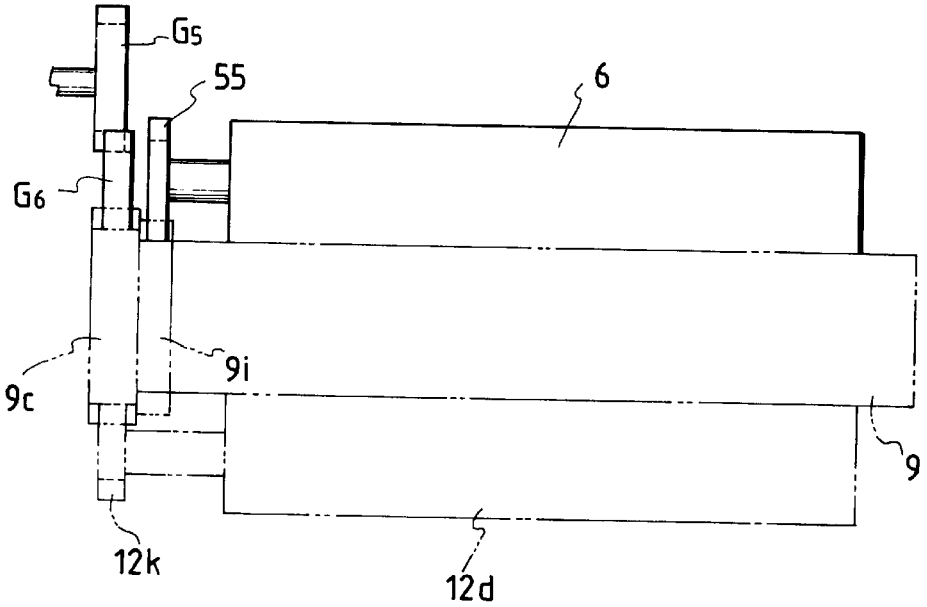
FIG. 59 is a view showing a gear train for transmitting a driving force from the drive gear of the image forming system to the photosensitive drum and the transfer roller.

Further, as shown in FIGS. 57 and 58, the flange gear (first gear) 9*c* and the gear (second gear) 9*i* are integrally formed and portions of the gears 9*c*, 9*i* are exposed from an opening 15*g* formed in the lower frame 15. When the process cartridge B is mounted within the image forming system A, as shown in FIG. 59, the drive gear G6 is meshed with the flange gear 9*c* of the photosensitive drum 9 and the gear 9*i* integral with the gear 9*c* is meshed with the gear 55 of the transfer roller 6. Incidentally, in FIG. 59, the parts of the image forming system are shown by the solid line, and the parts of the process cartridge are shown by the phantom line.

Figure 60A:
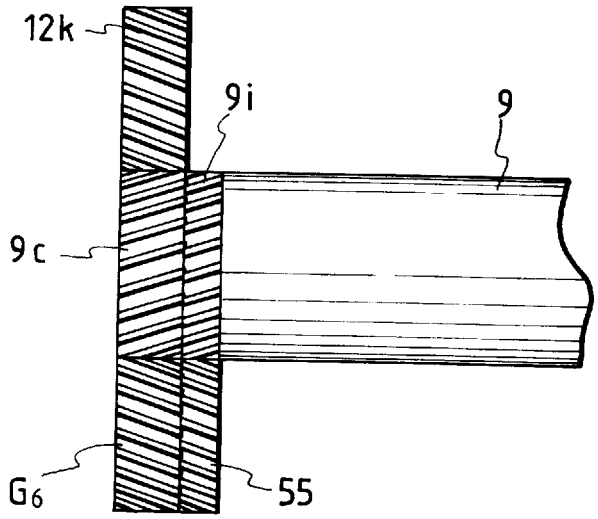
FIGS. 60A and 60B are views showing different drive transmitting mechanisms to developing sleeves, wherein magnetic toner is used and non-magnetic toner is used.
Figure 60B:
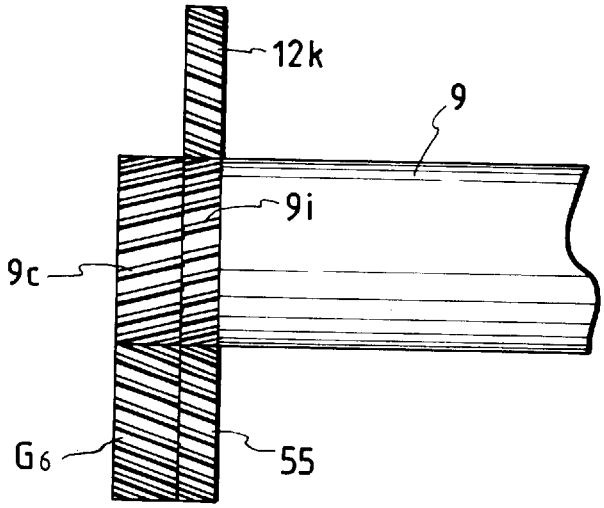

The number of teeth of the gear 9*c* is different from that of the gear 9*i*, so that the rotational speed of the developing sleeve 12*d* when the black image forming cartridge containing the magnetic toner is used is differentiated from the rotational speed of the developing sleeve when the color image forming cartridge containing the non-magnetic toner is used. That is to say, when the black image forming cartridge containing the magnetic toner is mounted within the image forming system, as shown in FIG. 60A, the flange gear 9*c* is meshed with the sleeve gear 12*k* of the developing sleeve 12*d*. On the other hand, when the color image forming cartridge containing the non-magnetic toner is mounted within the image forming system, as shown in FIG. 60B, the gear 9*i* is meshed with the sleeve gear 12*k* of the developing sleeve 12*d* to rotate the developing sleeve.

As mentioned above, since the gear 9*c* has the greater diameter and wider width than those of the gear 9*i* and has the number of teeth greater than that of the gear 9*i*, even when the greater load is applied to the gear 9*c*, the gear 9*c* can surely receive the driving force to rotate the photosensitive drum 9 surely and transmits the greater driving force to the developing sleeve 12*d* for the magnetic toner, thereby surely rotating the developing sleeve 12*d*.

Now, the construction of the squeegee or dip sheet and the cleaning device shown in FIGS. 23 to 27 in the first embodiment will be further fully explained hereinbelow with reference to the accompanying drawings.

Figure 61:
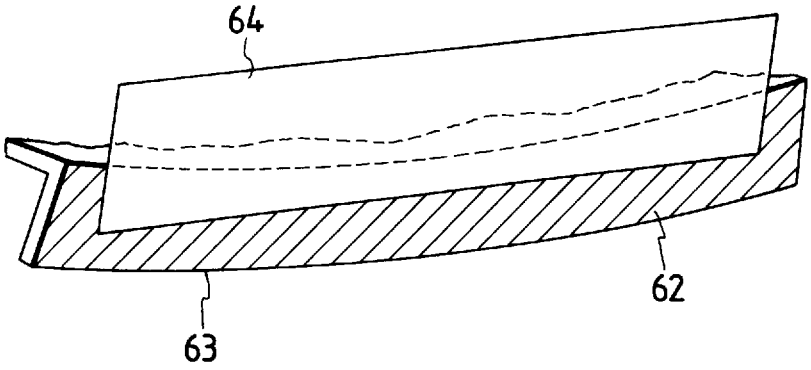
FIGS. 61 and 62 are a perspective view showing a squeegee or dip sheet sticking method according to another embodiment of the present invention.
Figure 62:
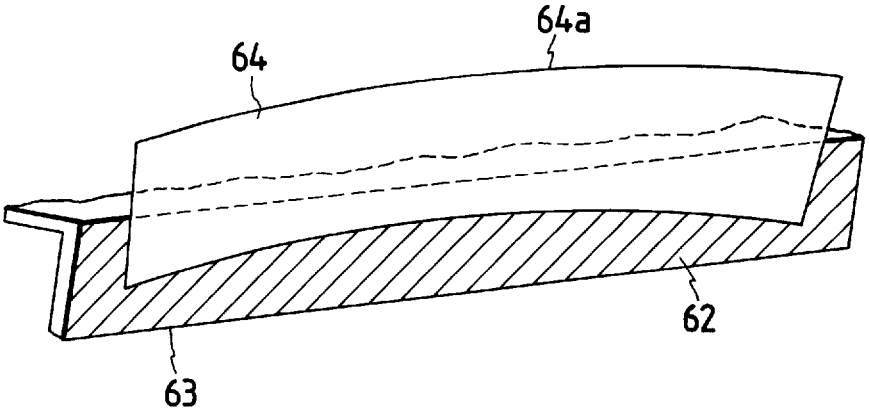

An attachment method for a squeegee sheet is shown in FIGS. 61 and 62.

First of all, as shown in FIG. 61, an attachment surface 62 of a cleaning container 61 made of resin material (for example, HIPS (high-impact polysthyrol) or the like) is curved in such a manner that a lower surface 63 of the attachment surface becomes convex downwardly. Then, a squeegee sheet 64 is stuck to the curved attachment surface 62 by an adhesive. After the adhesive is dried, the curvature of the attachment surface 62 is released, thereby applying an outwardly directing tension force to a free edge 64*a* of the squeegee sheet 64.

Figure 63:
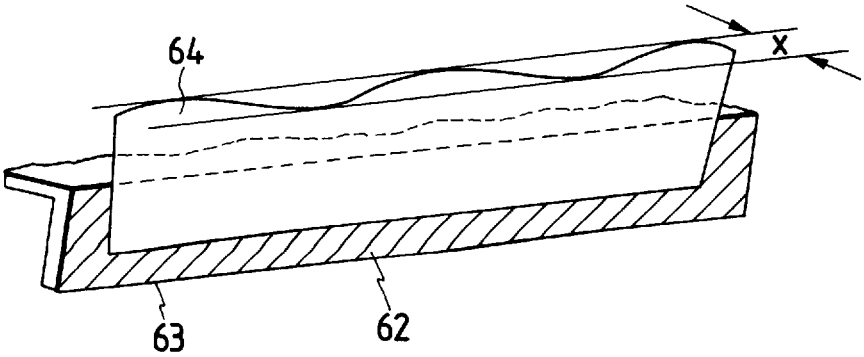
FIG. 63 is a perspective view showing the undulation of the squeegee sheet.

By sticking or adhering the squeegee sheet in this way, the undulation x in the squeegee sheet as shown in FIG. 63 can be prevented.

Figure 64:
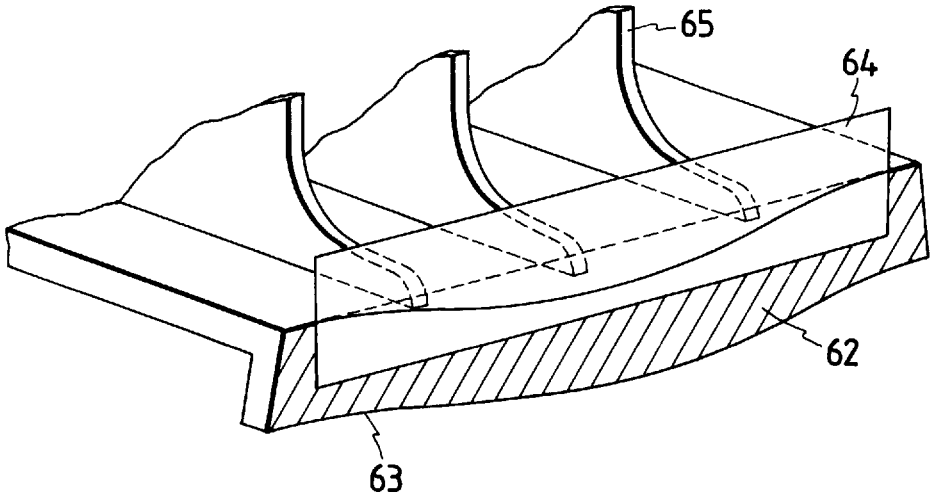
FIGS. 64 and 65 are a perspective view showing a squeegee sheet sticking method according to a further embodiment of the present invention.
Figure 65:
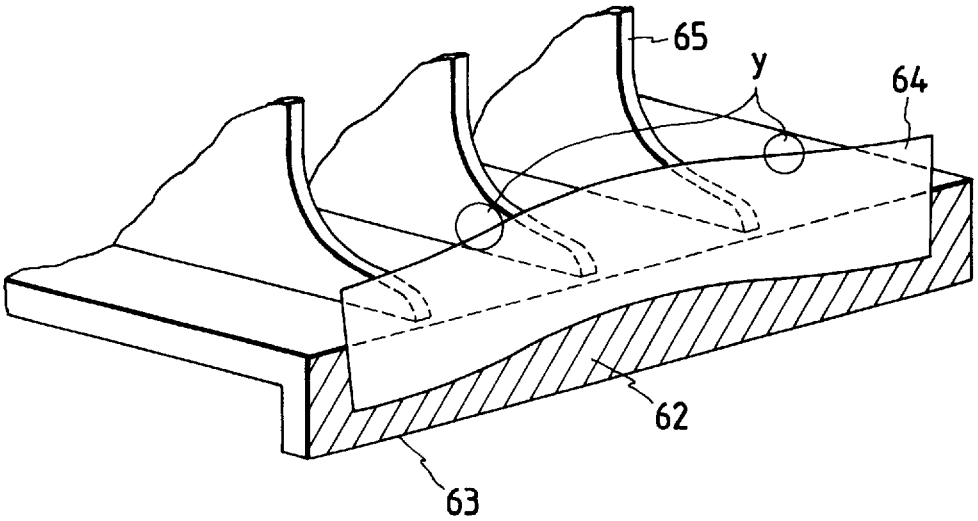

FIGS. 64 and 65 show a squeegee sheet sticking method according to another embodiment, wherein a cleaning container is divided into a plurality of compartments by partition walls 65 which act as ribs serving not only to prevent the offset of the toner but also to increase the rigidity of the cleaning device. However, when the rigidity of the attachment surface is great as in this embodiment, it is feared that the attachment surface will not be smoothly curved, thus generating poorly tensioned portions y in the squeegee sheet.

Figure 66:
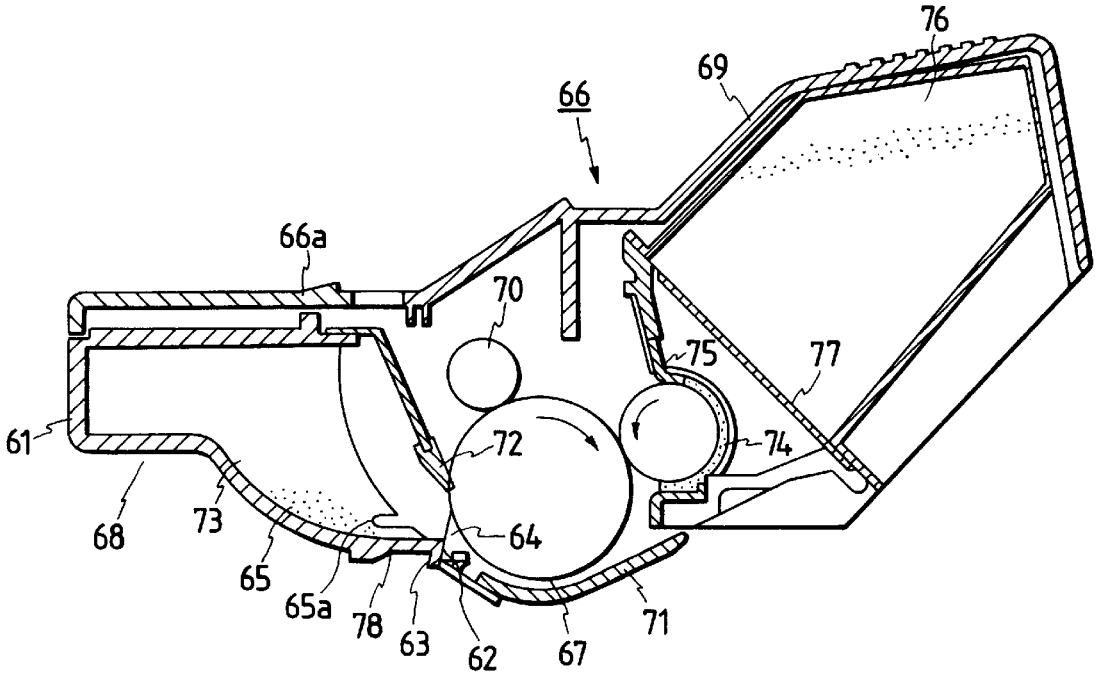
FIG. 66 is an elevational sectional view of a process cartridge having a cleaning device according to another embodiment of the present invention.

Next, a more preferable embodiment wherein the sufficient rigidity of a cleaning device can be obtained and an attachment surface for a squeegee sheet can be smoothly curved will be explained. FIG. 66 is an elevational sectional view of a process cartridge integrally including a cleaning device and mountable within an image forming system.

The process cartridge 66 has a cartridge container 66a within which a photosensitive drum (image bearing member) 67, and a process means (i.e., a cleaning device 68, a developing device 69 and a primary charger 70) arranged around the photosensitive drum are disposed, and the cartridge container can be removably supported within a body of the image forming system. When the service life of the photosensitive drum 67 or the developing device 69 is expired or toner (developer) in the developing device 69 is used up, the whole process cartridge is exchanged by a new one, thus facilitating the maintenance. Incidentally, the reference numeral 71 denotes a protection cover which closes to protect the photosensitive drum 67 when the process cartridge is dismounted from the image forming system.

The cleaning device 68 comprises a process means including a cleaning blade 72 for removing the residual toner from the photosensitive drum 67, a squeegee sheet 64 for preventing the removed toner from leaking outside and the like, and a waste toner containing portion 73 for collecting the removed toner therein.

Further, the developing device 69 comprises a process means including a developing sleeve 74 rotated in a predetermined direction and adapted to supply the toner held thereon toward the photosensitive drum 67, a developing blade 75 for regulating a thickness of a toner layer on the developing sleeve 74 and the like, and a toner containing portion 76 for holding the toner therein and for supplying the toner toward the developing sleeve 74.

That is to say, when image light L is illuminated on the photosensitive drum 67 which is uniformly charged by the primary charger 70, an electrostatic latent image is formed on the photosensitive drum 67. During the rotation of the photosensitive drum 67, the electrostatic latent image is directed to the developing device 69, where the latent image is visualized with the toner as a toner image. The toner image is transferred onto a transfer sheet by a transfer charger (not shown). After the transferring operation, the residual toner remaining on the photosensitive drum 67 is removed by the cleaning blade 72 slidingly contacting with the drum 67, thereby preparing for the next image formation. Incidentally, the waste toner removed by the cleaning blade 72 is collected in the waste toner containing portion 73 of the cleaning device 68 by the squeegee sheet 64 slidingly contacting with the photosensitive drum 67. Incidentally, the reference numeral 77 denotes a sealing member for the toner containing portion 76. This sealing member 77 is peeled off from the toner containing portion 76 before the process cartridge is mounted within the image forming system so that the toner in the toner containing portion 76 can be supplied to the developing sleeve 74.

Further, as in the embodiment shown in FIGS. 64 and 65, a plurality of reinforcing ribs 65 are arranged in the waste toner container at an appropriate interval along the longitudinal direction of the container, and serve to increase the rigidity of the container and serve as partition walls for preventing the waste toner leak due to the offset of the toner when the container is inclined and the toner leak due to the poor collection of the waste toner when the waste toner is handled in the offset condition. Further, in the illustrated embodiment, a thickness of the cleaning container 61 made of resin near the attachment surface 62 is thinner than that of other portions of the container (for example, in the illustrated embodiment, the basic thickness is 2.5 mm, whereas, the thickness near the attachment surface 62 is 2.0 mm).

Figure 67:
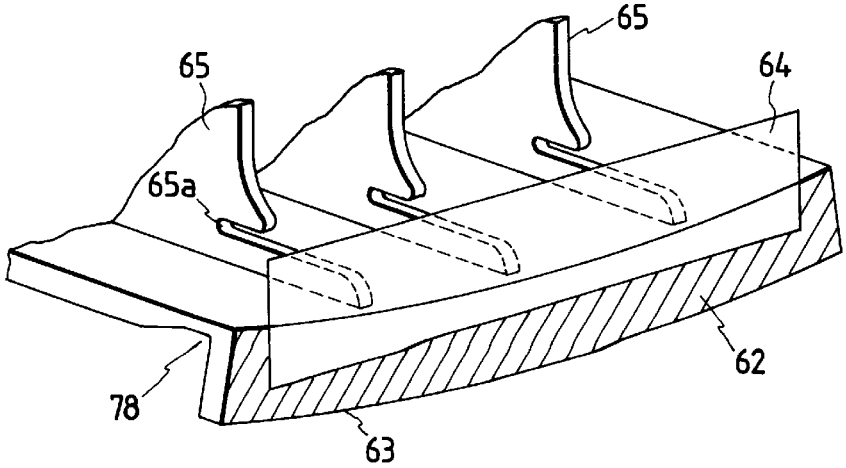
FIGS. 67 and 68 are a perspective view showing a squeegee sheet sticking method for sticking a squeegee sheet of the cleaning device of FIG. 66.
Figure 68:
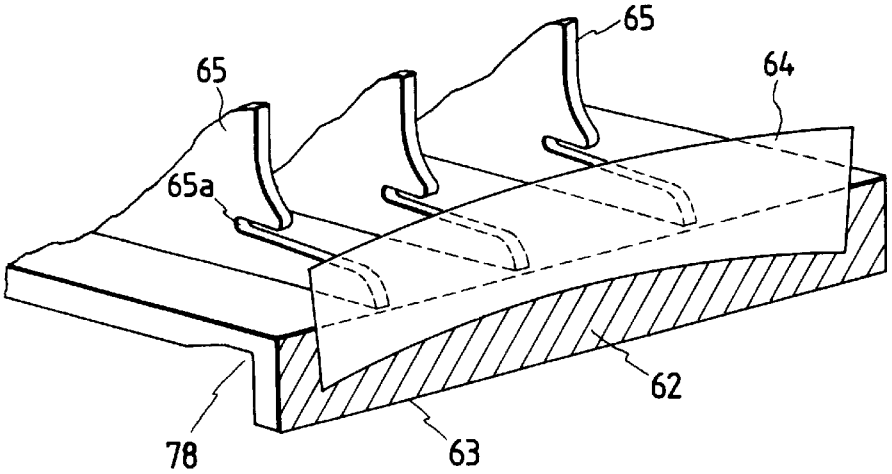

Accordingly, the sufficient rigidity of the cleaning device 68 can be obtained, and the attachment surface 62 for the squeegee sheet can easily be curved smoothly as shown in FIG. 67. Further, the ribs 65 have notches 65*a* in a confronting relation to the squeegee sheet 64.

Also with this arrangement, the attachment surface 62 for the squeegee sheet can easily be curved smoothly in an arcuate state.

Then, the squeegee sheet 64 is stuck to the attachment surface 62 to become smoothly curved as shown in FIG. 67, and, thereafter, when the curvature of the attachment surface is released, the squeegee sheet can be subjected to the uniform tension along the longitudinal direction thereof, thereby preventing the local undulation in the squeegee sheet.

A further embodiment will be explained. In embodiments described hereinbelow, a hook is formed on the cleaning container 61 in the vicinity of the attachment surface 62 in order to easily curve the attachment surface 62 smoothly.

Figure 69:
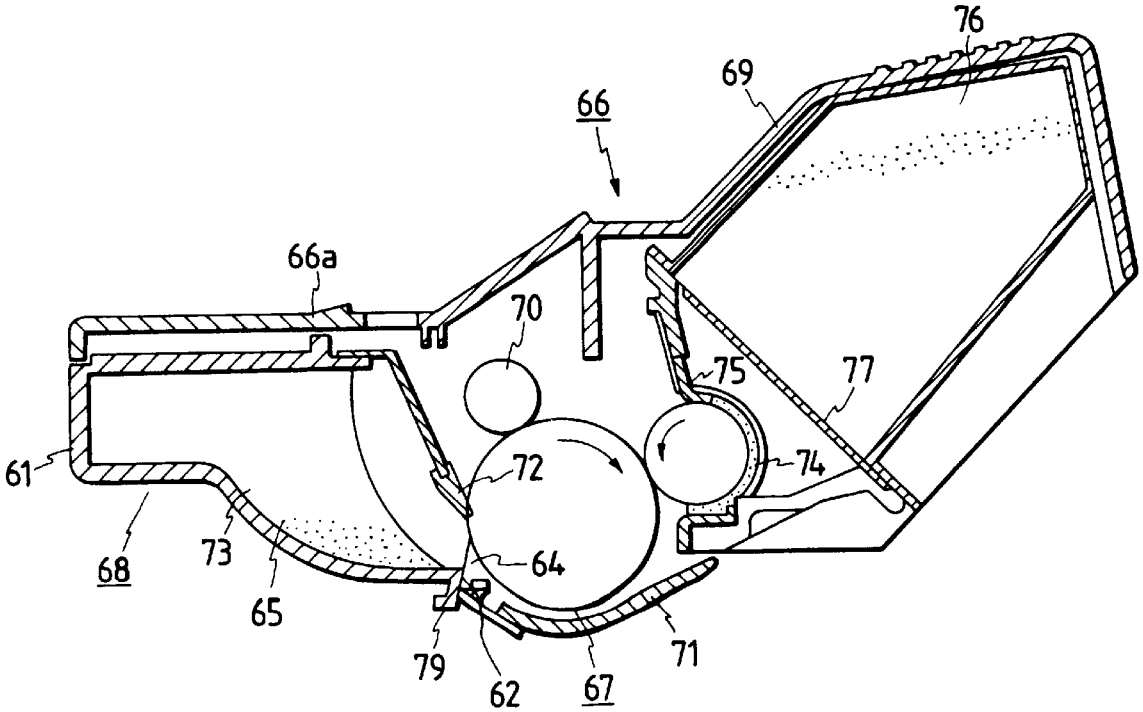
FIG. 69 is an elevational sectional view of a process cartridge according to a further embodiment of the present invention.

FIG. 69 is an elevational sectional view of a process cartridge wherein a hook 79 is formed in the vicinity of the attachment surface 62 of the cleaning container 61.

Figure 70:
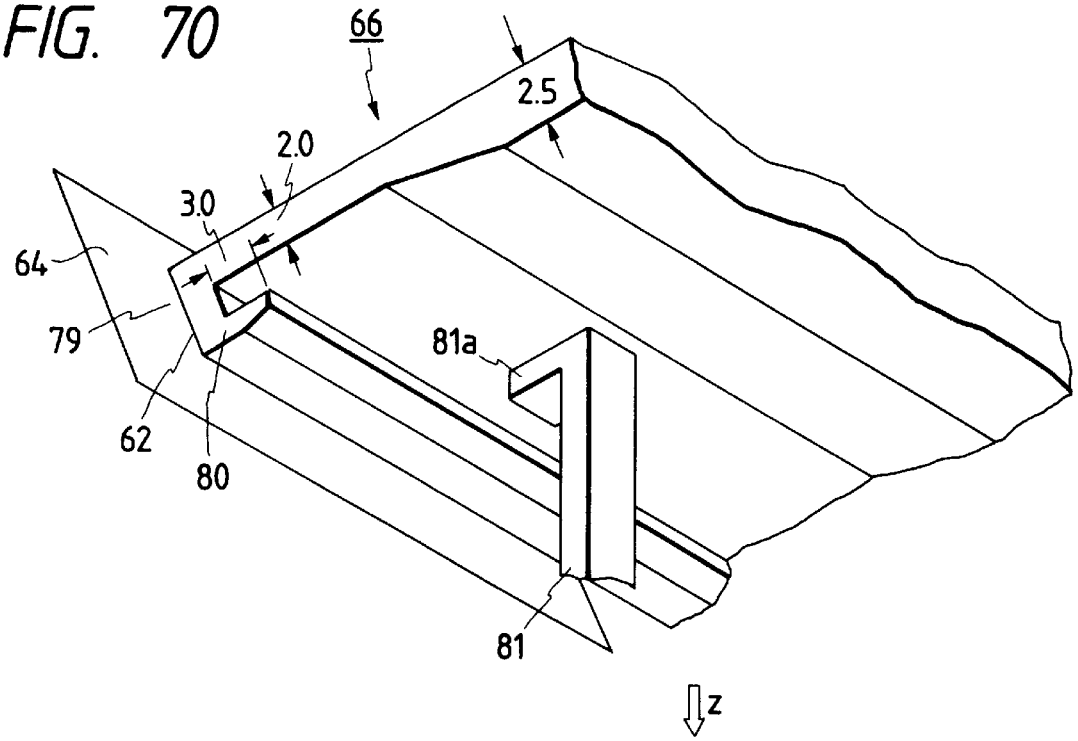
FIG. 70 is an enlarged perspective view of a hooked portion of the process cartridge.

FIG. 70 is an enlarged perspective view of the hook 79 of the process cartridge 66 shown in FIG. 69. As shown, a lower rib 80 protruding inwardly from the attachment surface 62 (for the squeegee sheet 64) perpendicular to the latter is formed through the whole length of the cleaning container 61 to form the hook 79 (a width of the lower rib 80 is about 3.0 mm). As shown in FIG. 70, in a condition that the process cartridge 66 is fixed by a tool (not shown), an engaging portion 81*a* of a pulling tool 81 is engaged by the hook 79 and the pulling tool is pulled by a tensile machine (not shown) in a direction shown by the arrow z. Incidentally, in this embodiment, three pulling tools 81 are engaged by the hook 79 at three points. More particularly, the hook 79 is deformed by about 0.5 mm at a central portion by the central pulling tool 81 and by about 0.3 mm at both sides by the side pulling tools 81 so that the squeegee sheet attachment surface 62 is smoothly curved. In a condition that the attachment surface 62 is curved in this way, the squeegee sheet 64 is stuck to the attachment surface 62 by an adhesive (FIG. 61). After the adhesive is cured, the pulling tools 81 are returned to the original positions. As a result, as shown in FIG. 62, the squeegee sheet 64 is subjected to a longitudinal tension force to curve at its free edge 64*a*, whereby the squeegee sheet 64 is stuck to the attachment surface 62 without any undulation.

Figure 71:
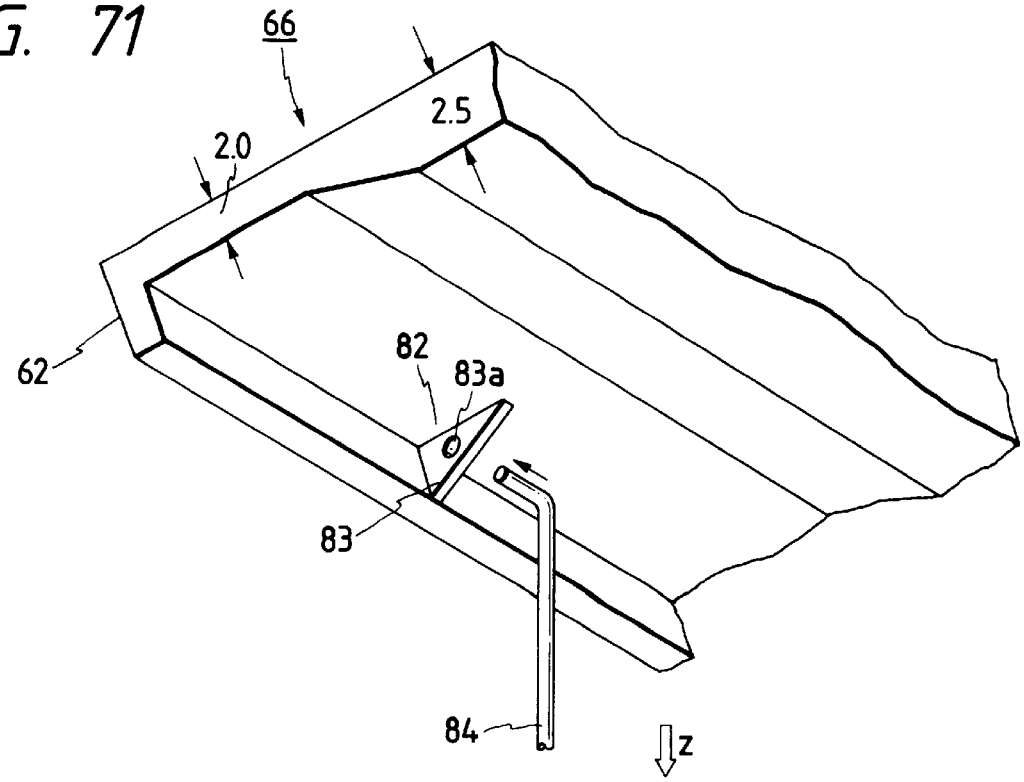
FIG. 71 is an enlarged perspective view of a hooked portion of the process cartridge according to another embodiment.

A further embodiment will be described with reference to FIG. 71. In this embodiment, a triangular rib 83 serving as a hook 82 is formed on a back surface of the attachment surface 62, and the attachment surface is pulled in the direction by a cylindrical pulling tool 84 engaged by a hole 83*a* of the rib 83, as in the aforementioned embodiment. According to this embodiment, the pulling tool 84 can be engaged by the hook 82 more surely.

Figure 72:
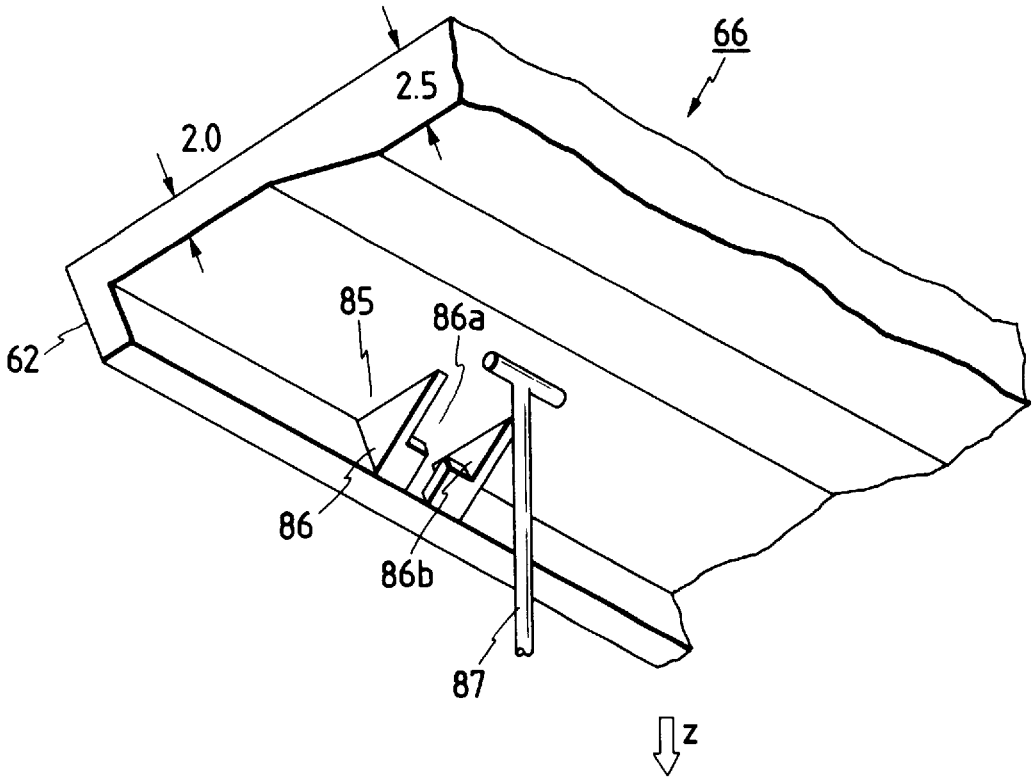
FIG. 72 is an enlarged perspective view of a hooked portion of the process cartridge according to a further embodiment.

A still further embodiment will be described with reference to FIG. 72. In this embodiment, a box-shaped rib 86 serving as a hook 85 is formed on a back surface of the attachment surface 62. The rib 86 comprises two opposed triangular plates each having a notch 86*a* and spaced apart from each other by a gap 86*b*. A T-shaped pulling tool 87 is inserted into the gap 86*b*, and then the pulling tool 87 is pulled in the direction z. According to this embodiment, the pulling tool can be easily engaged by the hook 85, and the engagement is maintained more surely.

According to the embodiments as mentioned above, it is possible to easily curve the squeegee sheet attachment surface. By sticking the squeegee sheet to the curved attachment surface and then by releasing the curvature of the attachment surface, it is possible eliminate the undulation in the squeegee sheet when it is stuck.

Next, an electrophotographic copying machine serving as an example of an image forming system within which the process cartridge 66 having the above-mentioned cleaning device is mounted will be explained with reference to FIG. 73. Incidentally, in FIG. 73, the process cartridge is shown schematically.

Figure 73:
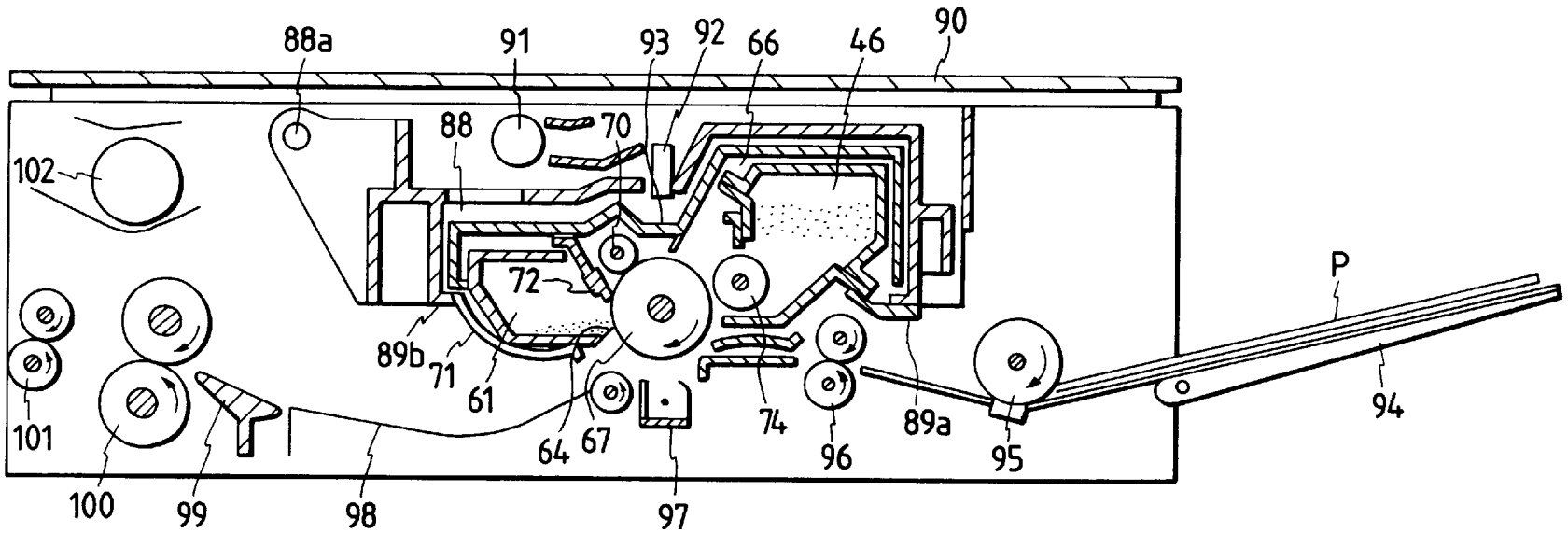
FIG. 73 is an elevational sectional view of an image forming system within which the above-mentioned process cartridge is removably mounted.

In FIG. 73, an upper frame 88 on which the process cartridge 66 is mounted is pivotally supported by the image forming system via a pivot pin 88*a* for an opening/closing movement. When the upper frame 88 is opened, the process cartridge can be mounted. The process cartridge 66 is held on the upper frame 88 by guides 89*a*, 89*b*.

By the way, an original rested on an original support plate 90 is illuminated by a lamp 91, and a light image reflected from the original is focused on a photosensitive drum 67 via a lens 92. Incidentally, the reference numeral 93 denotes an exposure opening formed in the frame of the process cartridge 66. Recording sheets P are stacked on a stacking plate 94. The recording sheet P fed out from the stacking plate 94 by a sheet supply roller 95 is sent to the photosensitive drum 67 by a pair of regist, or registration, rollers 96 in registration with the movement of the photosensitive drum. The toner image formed on the photosensitive drum 67 is transferred onto the recording sheet P by a transfer charger 97. Incidentally, the reference numeral 98, 99 denotes convey guides; 100 denotes a fixing roller; 101 denotes a pair of ejector rollers; and 102 denotes an exhaust fan.

Now, the cleaning shown in FIGS. 23 to 27 in the first embodiment wherein the tension force is applied to the squeegee sheet will be further fully explained hereinbelow with reference to the accompanying drawings.

Figure 74:
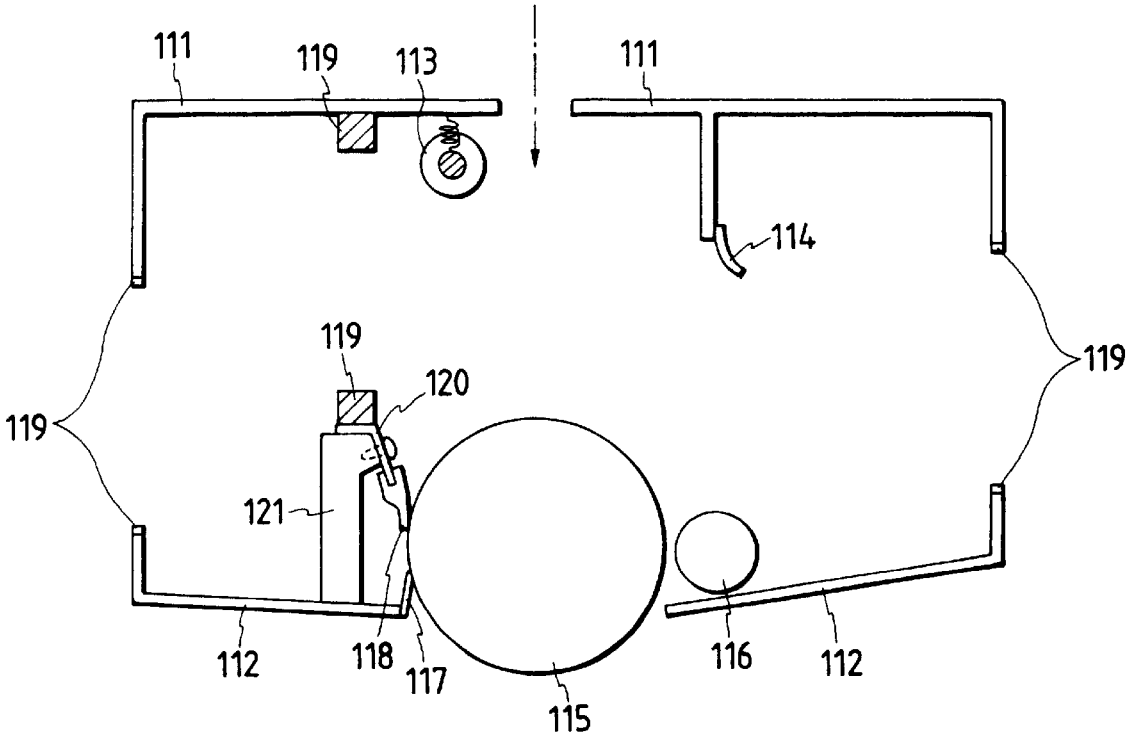
FIGS. 74 and 75 are schematic elevational sectional views of a process cartridge having a cleaning device of the present invention.
Figure 75:
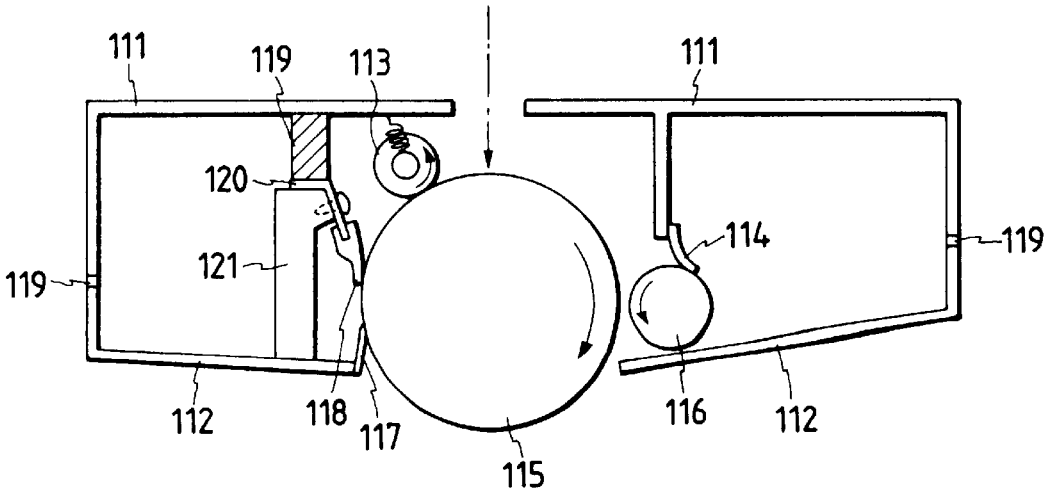

FIGS. 74 and 75 are schematic elevational views showing an example of the construction of a process cartridge including a cleaning device of the present invention. The process cartridge comprises an image bearing member, and a process means including a charger means and a developing device, as well as a cleaning means, which are integrally held by upper and lower separable frames.

In FIGS. 74 and 75, a charger roller 113 serving as the charger means supported in a spring-bias fashion, and an elastic blade 114 of the developing device are disposed in an upper frame 111; whereas, an image bearing member 115, a developing sleeve 116 of the developing device, and a squeegee sheet 117 and a cleaning blade 118 of the cleaning device are disposed in a lower frame 112. Further, seals 119 made of foam polyurethane for preventing the leakage of the toner are mounted on the interfaces of the upper and lower frames 111, 112.

Figure 76:
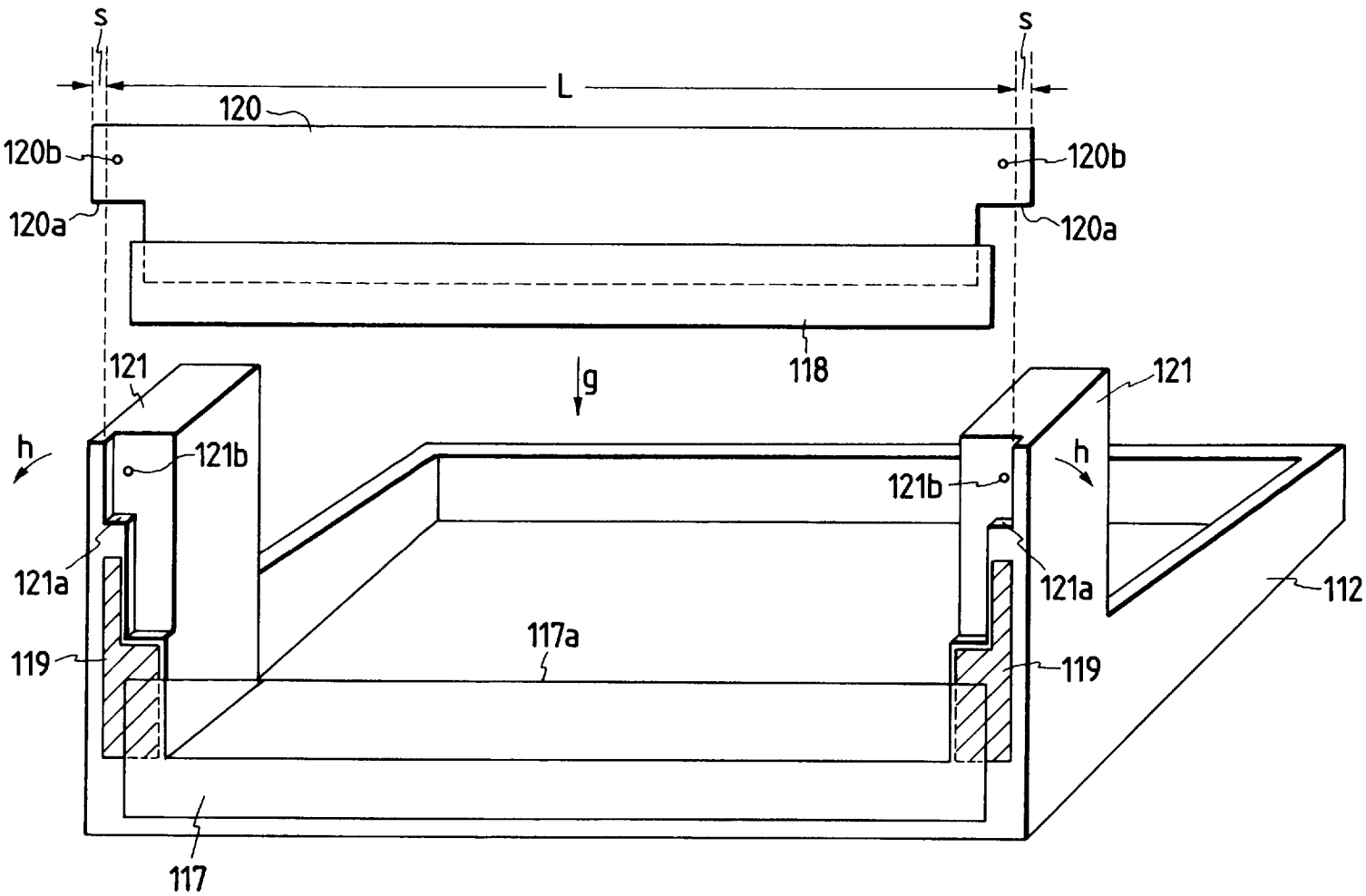
FIG. 76 is an enlarged perspective view of a portion of the cleaning device of the process cartridge.

FIG. 76 is an enlarged view showing the cleaning device in the process cartridge, the construction of which will be described hereinbelow.

As mentioned above, the squeegee sheet 117 and the cleaning blade 118 of the cleaning device are disposed in the lower frame 112 of the process cartridge. As shown, the squeegee sheet 117 is stuck to a lower end of the lower frame 112 by an adhesive such as a both-sided adhesive tape and the seals 119 for preventing the leakage of toner are arranged on both ends of the squeegee sheet. Further, the cleaning blade 118 is integrally formed with a blade supporting member 120 which is secured to support portions 121 formed on both ends of the lower frame 112. Incidentally, a contacting position between the cleaning blade 118 and the image bearing member is regulated by abutting lower end portions 120*a* of the blade supporting member 120 against lower end portions 121*a* of the support portions 121.

In an embodiment according to the present invention, after the squeegee sheet 117 is stuck to the lower end of the lower frame 112, the support portions 121 formed on both lateral ends of the lower frame 112 are deformed outwardly in the longitudinal direction of the frame, thereby applying the tension to an upper edge portion 117*a* of the squeegee sheet 117.

To this end, in the illustrated embodiment, a length of the blade supporting member 120 supporting the cleaning blade 118 is greater than a distance between the support portions 121 formed on both lateral ends of the lower frame 112. As shown in FIG. 76, when the distance between the support portions 121 is L, the length of the blade supporting member 120 becomes L+s (in case where only one side is widened) or L+2 s (in case where both sides are widened) (Incidentally, s is about 0.5–1.0 mm).

Accordingly, when the blade supporting member 120 with which the cleaning blade 118 is integrally formed is attached to the support portions 121 formed on both lateral ends of the lower frame 112 by shifting the supporting member 120 in a direction shown by the arrow g, the support portions 121 are deformed outwardly in the longitudinal direction (shown by arrows h), thus applying the tension to the upper edge portion 117*a* of the squeegee sheet 117.

In this case, threaded holes 120*b* formed in both ends of the blade supporting member 120 and threaded holes 121*b* formed in both support portions 121 must be positioned in consideration of the deformed amount of the support portions 121. Further, not only in this embodiment, but also in embodiments described later, it is necessary to previously widen the length of the cleaning blade 118 in consideration of the deformed amount of the support portions 121.

Next, other embodiments of a cleaning device will be explained with reference to FIGS. 77 to 83.

Figure 77:
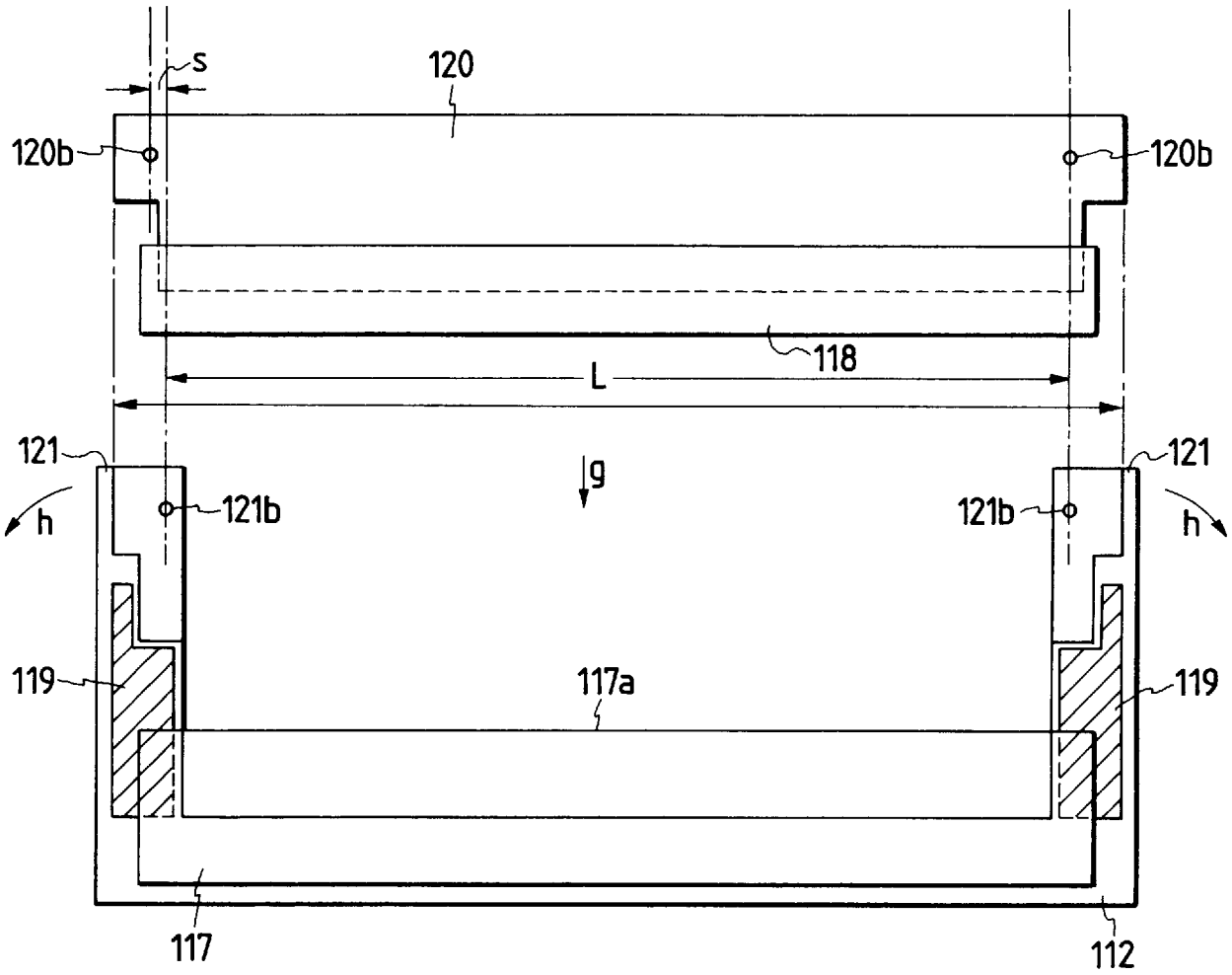
FIG. 77 is an enlarged front elevational view of a portion of the cleaning device of the process cartridge.

FIG. 77 is an enlarged front elevational view of a cleaning device according to a further embodiment of the present invention. Similar to the cleaning device as shown in FIG. 76, also in this cleaning device, the tension is applied to the upper edge portion 117*a* of the squeegee sheet 117 by deforming the support portions 121 formed on both lateral ends of the lower frame 112 outwardly in the longitudinal direction. To this end, in this embodiment, although the length of the blade supporting member 120 is the same as the distance between the support portions 121, the position of the threaded hole 120*b* formed in the member 120 and the position of the threaded hole 121*b* formed in the support portion are differentiated. As shown, a distance between the threaded holes 121*b* of the support portions 121 is L; whereas, a distance between the threaded holes 120*b* of the supporting member 120 is (L+s) (s=about 1.0–2.0 mm). Thus, when the blade supporting member 120 is secured to the support portions 121 by screws through the aligned threaded holes, the support portions 121 are deformed in directions h. Also in this case, the same technical advantage as that of the previous cleaning device can be obtained.

Figure 78:
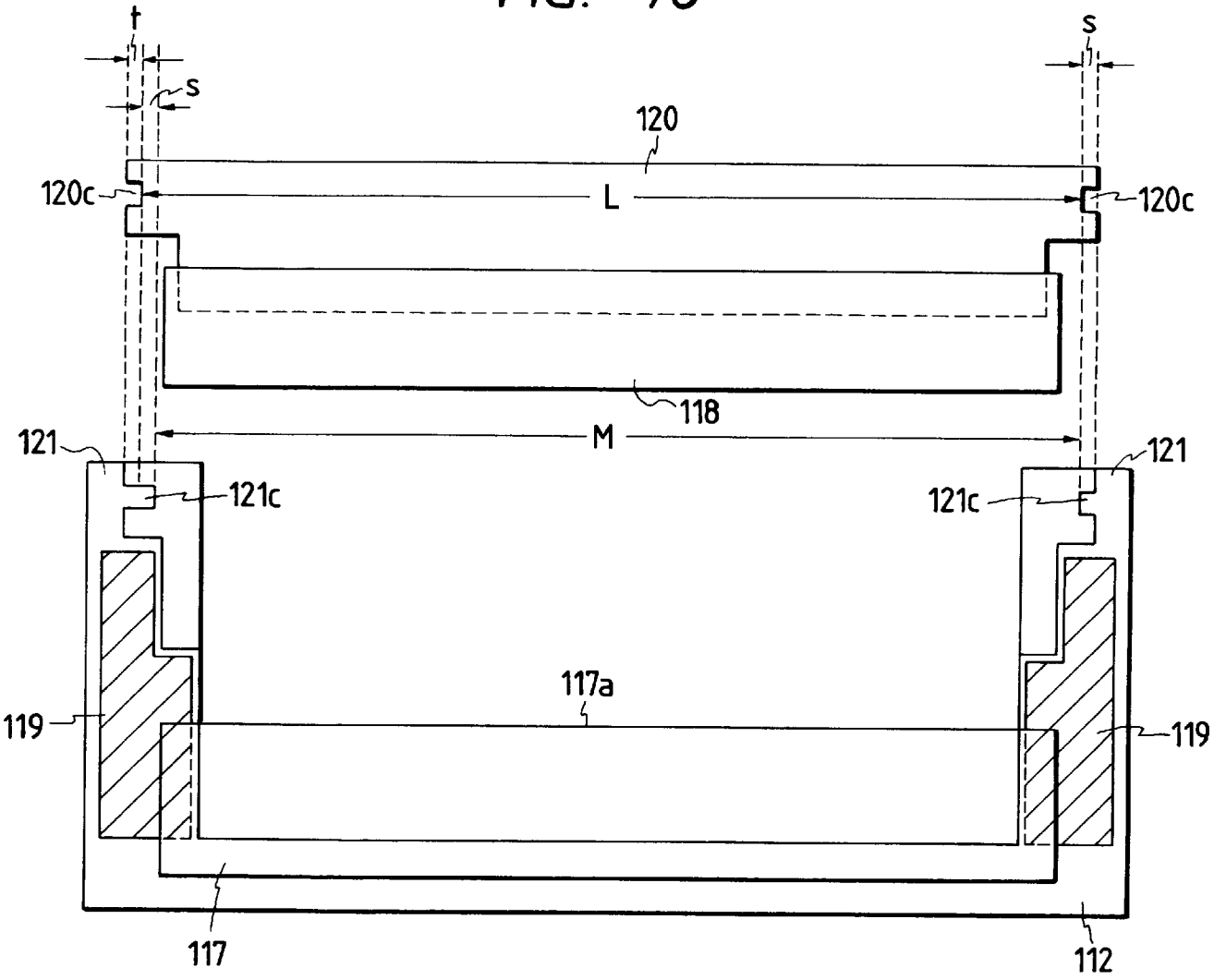
FIG. 78 is an enlarged front elevational view of a portion of the cleaning device according to a further embodiment.

FIG. 78 is an enlarged front elevational view of a cleaning device according to a still further embodiment. Similar to the cleaning device as shown in FIG. 76, also in this cleaning device, the tension is applied to the upper edge portion 117*a* of the squeegee sheet 117 by deforming the support portions 121 formed on both lateral ends of the lower frame 112 outwardly in the longitudinal direction. To this end, in this embodiment, positioning projections 121*c* are formed on inner surfaces of the support portions 121 and positioning recesses 120*c* for receiving the positioning projections 121*c* are formed in both lateral ends of the blade supporting member 120. When a distance between the positioning recesses 120*c* is L, a distance between the positioning projections is selected to have a value M which is smaller than L by s (s=about 1.0–2.0 mm). Thus, when the positioning projections 121*c* of the support portions 121 are fitted into the positioning recesses 120*c* of the blade supporting member 120, the support portions 121 are deformed in the directions h, thus applying the tension to the upper edge portion 117*a* of the squeegee sheet 117.

Alternatively, when a depth t of either positioning recess 120*c* or both positioning recesses is smaller by s, the same technical effect can be obtained.

Incidentally, in the cleaning devices shown in FIGS. 76 to 78, the support portions 121 formed on both lateral ends of the lower frame 112 are deformed outwardly in the longitudinal direction by the blade supporting member 120 supporting the cleaning blade 118, thereby preventing the occurrence of the undulation in the upper edge portion 117*a* of the squeegee sheet 117 stuck to the lower end of the lower frame 112.

Figure 79A:
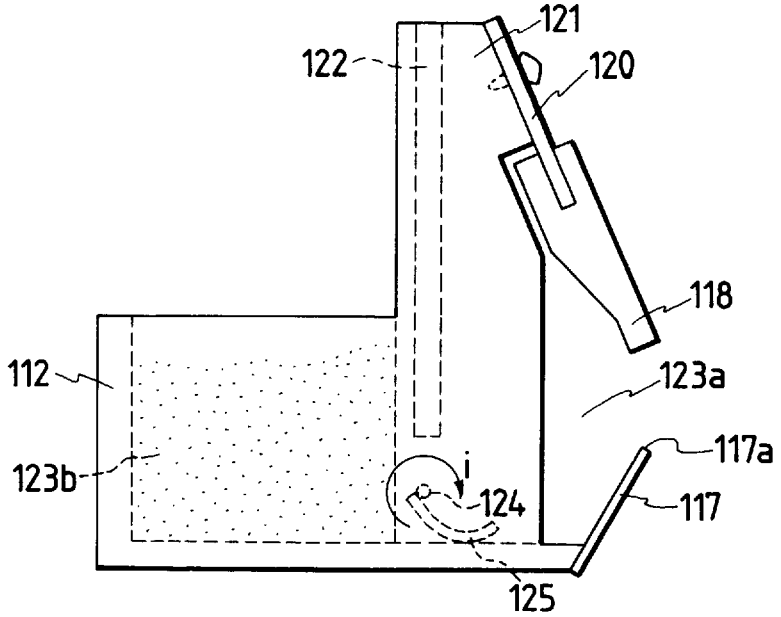
FIGS. 79A and 79B are an enlarged side view and a front elevational view of a portion of the cleaning device according to a still further embodiment, respectively.
Figure 79B:
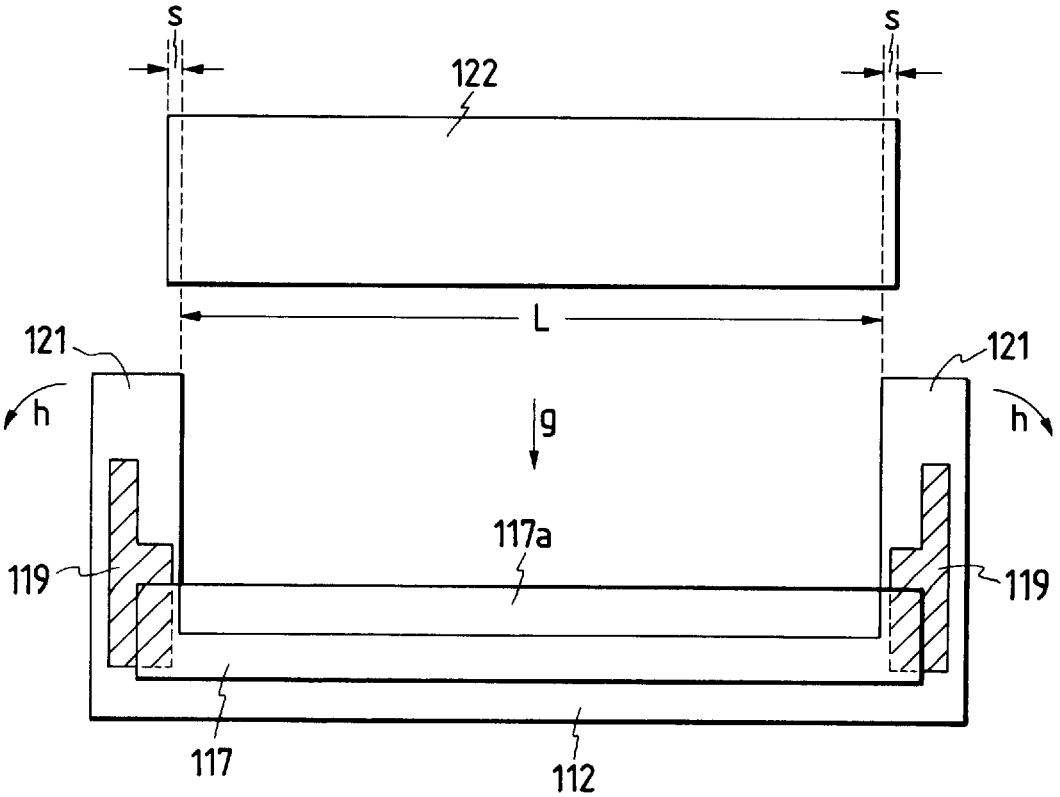

FIG. 79A is an enlarged side view of a cleaning device in the process cartridge according to a further embodiment, and FIG. 79B is an enlarged front elevational view of the cleaning device. In this embodiment, the interior of the cleaning device is divided into a waste toner receiving portion 123*a* and a waste toner containing portion 123*b* by a partition wall 122. Accordingly, the waste toner caught by the squeegee sheet 117 is collected on the squeegee sheet 117 and in an area of the waste toner receiving portion 123*a* near the cleaning blade 118, and thereafter, is sent to the waste toner containing portion 123*b* by a toner pick-up member 125 rotated around an axis 124 in a direction shown by the arrow i in FIG. 79A. Incidentally, the toner pick-up member 125 is a sheet member made of PET or the like and extends along the whole length of the cleaning device, and is rotated synchronously with the rotation of the image bearing member.

In this embodiment, the support portions 121 formed on both lateral ends of the lower frame 112 are deformed outwardly in the longitudinal direction by the partition wall 122, thereby applying the tension to the upper edge portion 117*a* of the squeegee sheet 117 stuck to the lower end of the lower frame 112. That is to say, the longitudinal length of the partition wall is selected to have a value greater than the distance L between the support portions 121 by s or 2 s (s=0.5–1.0 mm). Then, by inserting the partition wall 122 between the support portions 121, the support portions 121 are deformed in the directions h, thereby applying the tension to the upper edge portion 117*a* of the squeegee sheet 117 sticked to the lower end of the lower frame 112.

If only the insertion of the partition wall 122 between the support portions 121 is insufficient, guide grooves may be formed in the inner surfaces of the support portions, thereby fitting the partition wall into the support portions 121.

Figure 80:
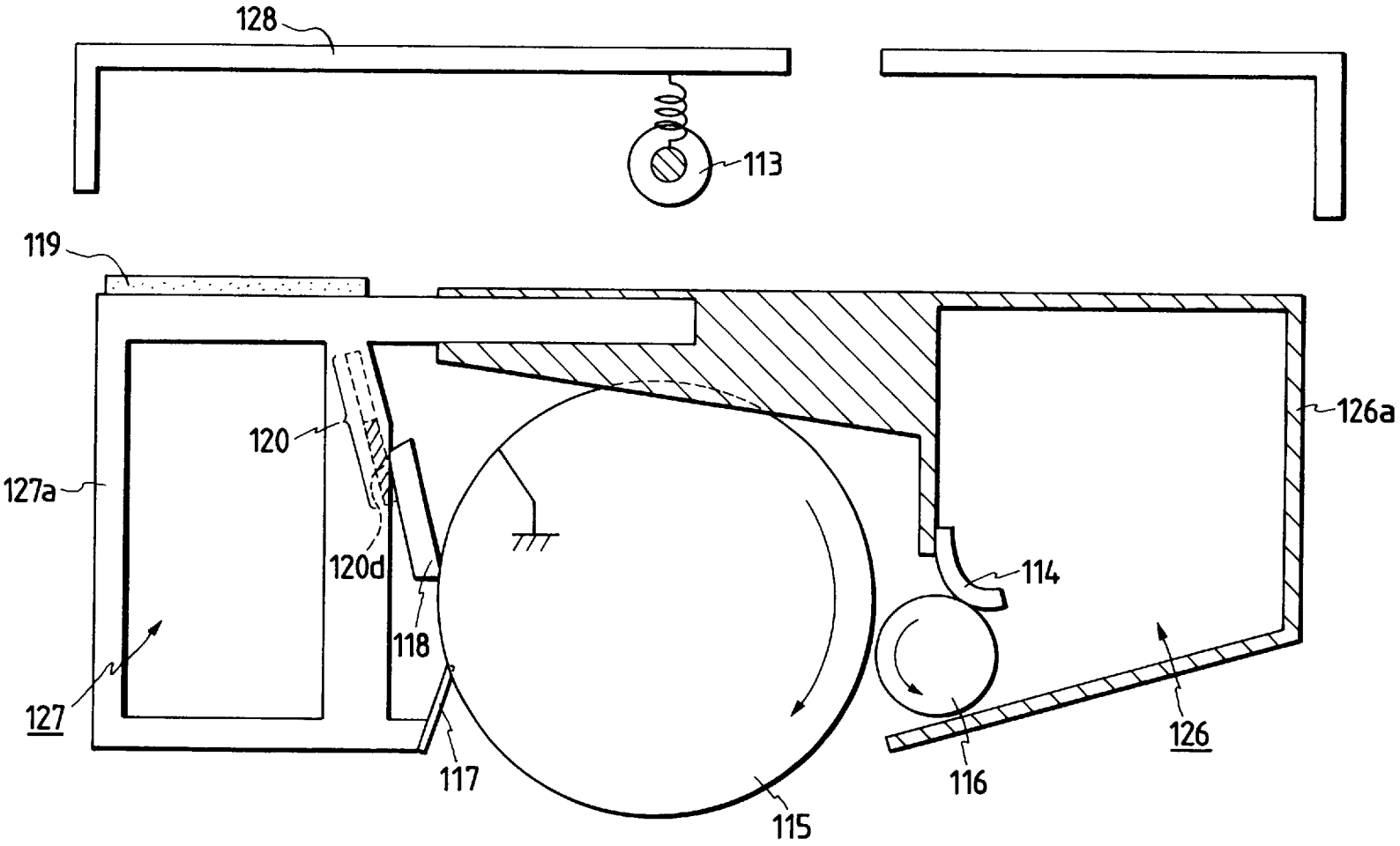
FIG. 80 is a schematic elevational sectional view of a process cartridge wherein a frame for a developing device and a frame for a cleaning device can be divided from each other.
Figure 81:
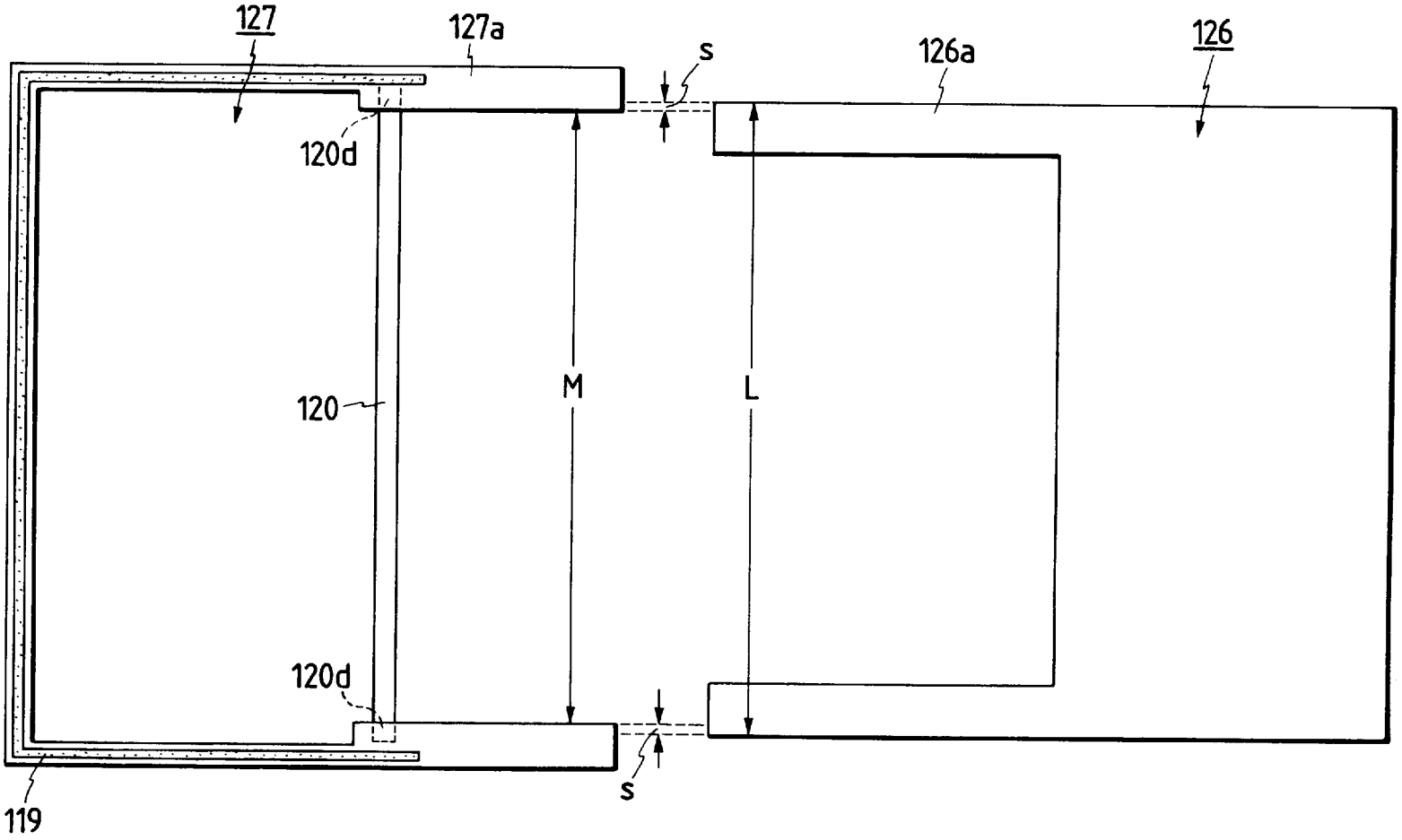
FIG. 81 is a top view of the frame for the developing device and the frame for the cleaning device in a condition that a cover is not attached.

A process cartridge shown in FIGS. 80 and 81 is of the type wherein a frame 126*a* containing a developing device 126 can from a frame 127*a* rated from a frame 127*a* containing a cleaning device 127. An upper side of the cleaning device is closed by covering the frames by a cover 128 after the frames 126*a*, 127*a* are interconnected. Incidentally, in this embodiment, the developing device 126 is formed as a single unit having a closed top.

In the above-mentioned process cartridge, an image bearing member 115 is supported by the frame 127*a* containing the cleaning device 127, and projections 120*d* (shown by a hatched area) formed on both lateral ends of the blade supporting member 120 (shown by the phantom line) supporting the cleaning blade 117 are fitted into the frame 127*a*. Thus, in this embodiment, the blade supporting member 120 is not secured by the screws. Further, a seal 119 for preventing the leakage of toner is arranged on the interface (against the cover 128) of the frame 127*a* containing the cleaning device 127. Incidentally, a charger roller 113 serving as a charger device is mounted on the cover 128. Further, the squeegee sheet 117 is stuck to a lower end of the frame 127*a* containing the cleaning device 127 by an adhesive such as a both-sided adhesive tape.

FIG. 81 is a top view of the frame 126*a* containing the developing device 126 and the frame 127*a* containing the cleaning device 127 when the cover 128 is not attached. When the frames are assembled as a process cartridge, the abutment portion of the frame 126*a* containing the developing device 126 is fitted into the abutment portion of the frame 127*a* containing the cleaning device 127. As shown, in the illustrated embodiment, a longitudinal outer width L of the abutment portion of the frame 126*a* is greater than a longitudinal inner width M of the abutment portion of the frame 127*a* by s or 2 s (s=1.0–3.0 mm). Thus, by assembling the frames 126*a*, 127*a* together, the frame 127*a* containing the cleaning device 127 is deformed, thereby applying the tension to the upper edge portion 117*a* of the squeegee sheet 117 stuck to the lower end of the frame 127*a*.

Incidentally, in the illustrated embodiment, as mentioned above, since the blade supporting member 120 is of a slide fitting type and is not secured by the screws, it is possible to deform the frame 127*a* containing the cleaning device 127. Further, it is so designed that both the frame 126*a* containing the developing device 126 and the frame 127*a* containing the cleaning device 127 are very rigid so that only the abutment portions are not deformed.

Figure 82A:
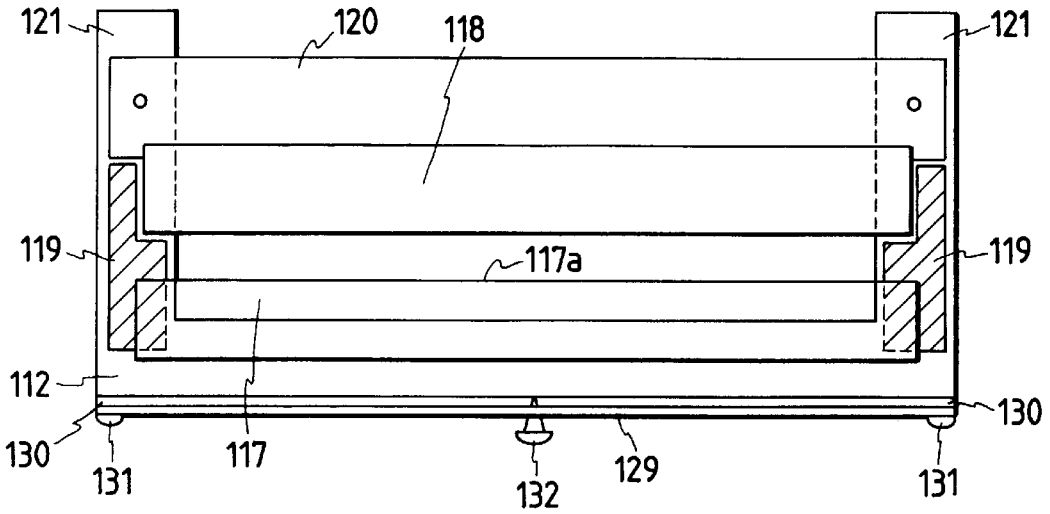
FIG. 82A is an enlarged front elevational view of a portion of a cleaning device of a process cartridge before a tension force is applied.
Figure 82B:
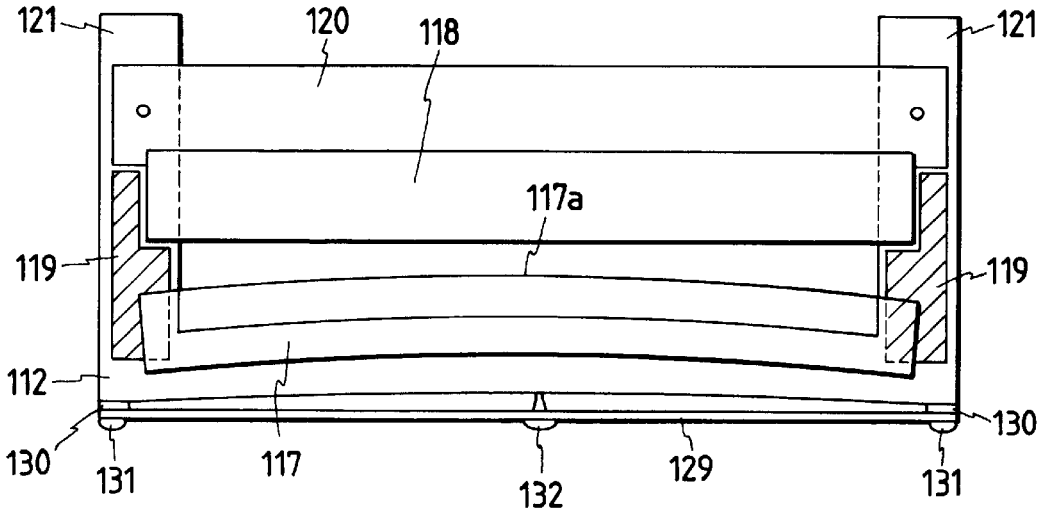
FIG. 82B is an enlarged front elevational view of the portion of the cleaning device of the process cartridge after the tension force is applied.

FIG. 82A is an enlarged front elevational view of a cleaning device before the tension is applied, and FIG. 82B is an enlarged front elevational view of the cleaning device after the tension is applied. In this embodiment, there is provided a means for applying the tension to the upper edge portion 117*a* of the squeegee sheet 117 and for adjusting the tension. More particularly, a metallic plate 129 having the greater rigidity than that of the lower frame 112 is secured to a lower surface of the lower frame 112 by screws 131 and has a central adjusting screw 132. Accordingly, after the squeegee sheet 117 is stuck to the lower end of the lower frame 112 and the required parts such as the cleaning blade 118 are attached to the frame, by rotating the central screw 132, the lower frame 112 is deformed as shown in FIG. 82B, thus applying the tension to the upper edge portion 117*a* of the squeegee sheet 117, thereby preventing the occurrence of the undulation. Further, by adjusting the penetrating amount of the central screw 132, it is possible to adjust the deformed amount of the lower frame 112 and accordingly the magnitude of the tension applied to the upper edge portion 117*a* of the squeegee sheet 117.

Figure 83A:
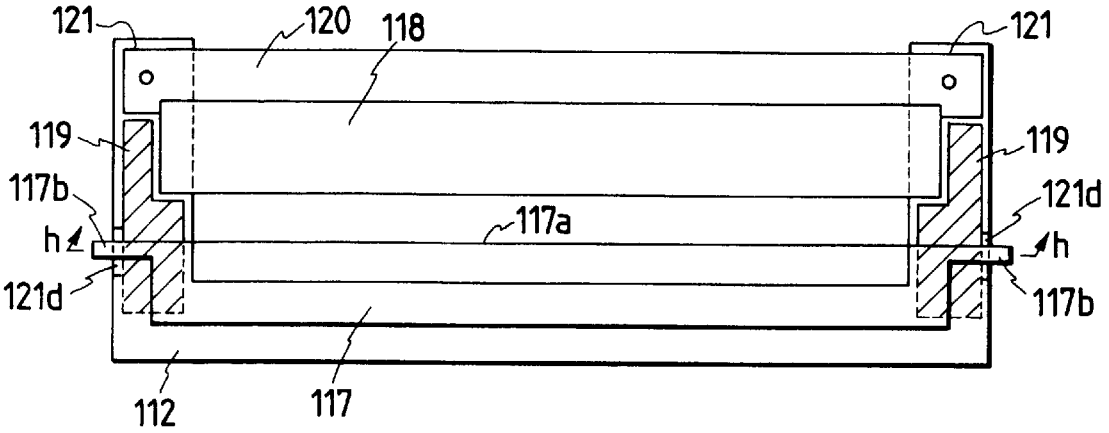
FIG. 83A is an enlarged front elevational view of a portion of a cleaning device of a process cartridge.
Figure 83B:
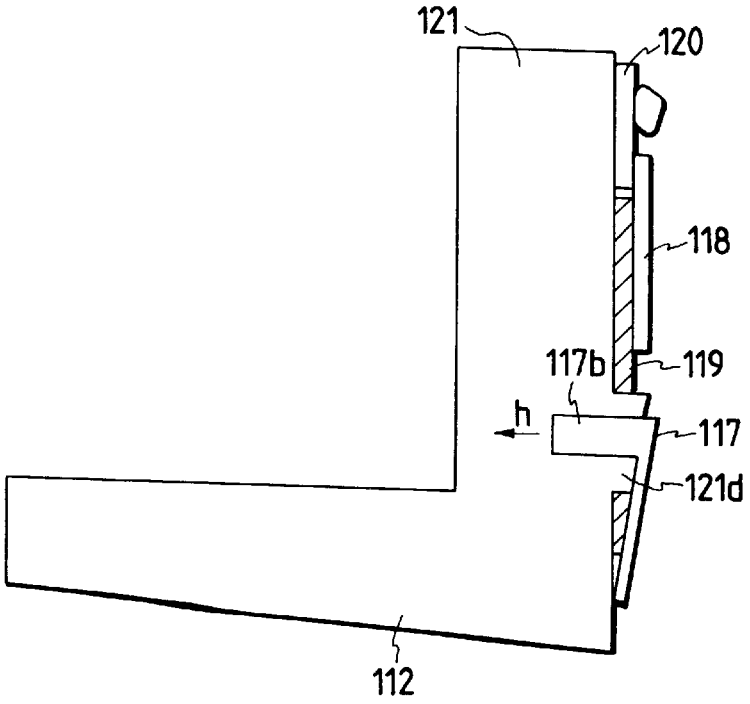
FIG. 83B is a side view thereof.

FIG. 83A is an enlarged front elevational view of a cleaning device in the process cartridge according to a further embodiment, and FIG. 83B is an enlarged side view of the cleaning device. In this embodiment, an upper edge portion 117*a* of the squeegee sheet 117 is longer than a base of the squeegee sheet by which the squeegee sheet is stuck to the lower frame. As shown, the squeegee sheet 117 is provided with pulling tongues 117*b* formed on both lateral ends of the upper edge portion 117*a* of the squeegee sheet. Thus, after the squeegee sheet 117 is stuck to the lower end of the lower frame 112, the pulling tongues 117*b* are pulled in directions shown by the arrows h in FIG. 83, and then are adhered to lateral surfaces of the support portions 121, thereby applying the tension to the upper edge portion 117*a* of the squeegee sheet 117, thus preventing the occurrence of the undulation. Further, in order to prevent the upper edge portion 117*a* of the squeegee sheet 117 from separating from the surface of the image bearing member 115 when the pulling tongues 117*b* are pulled, ridges 121*d* are formed on the support portions 121 at an area where the pulling tongues are abutted against the support portions, thereby ensuring the contact between the upper edge portion 117*a* and the image bearing member 115.

While the cleaning devices mentioned above were applied to the process cartridges, such cleaning devices are not limited to the application to process cartridges, but can be applied to any image forming system so long as the squeegee sheet is stuck to a frame.

Next, further embodiments of a cleaning device having a squeegee sheet as shown in FIGS. 23 to 27 in the first embodiment will be further fully explained hereinbelow with reference to the accompanying drawings.

Figure 84:
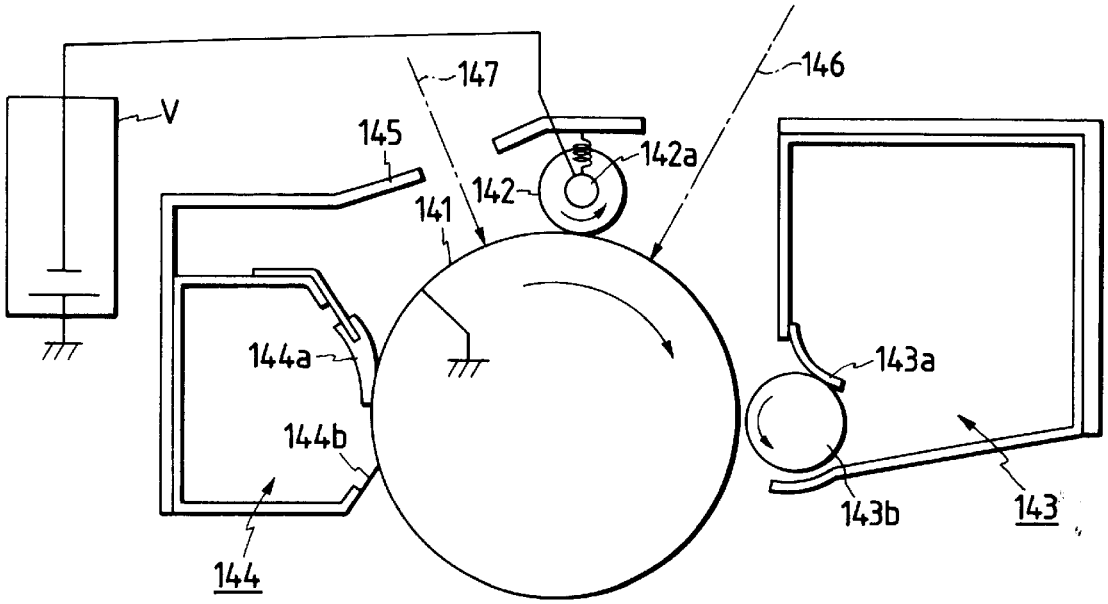
FIG. 84 is a schematic constructural view showing a construction of a process cartridge of the present invention.
Figure 85:
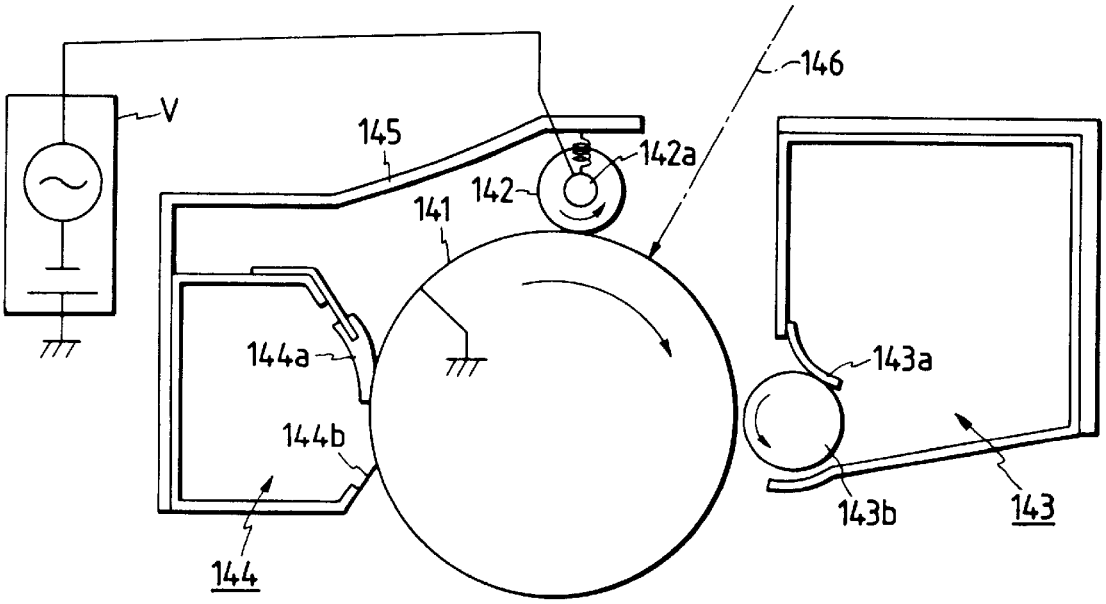
FIG. 85 is a schematic constructural view showing a construction of a process cartridge according to one embodiment.

FIGS. 84 and 85 are schematic constructural views of process cartridges to which the present invention is applied. Briefly explaining the process cartridge, the process cartridge incorporates therein an image bearing member 141, a charger device 142, a developing device 143 and a cleaning device 144 within a frame 145 to form a compact unit which can be removably mounted within an image forming system. Incidentally, the reference numeral 146 denotes an exposure opening.

The developing device 143 comprises a developing sleeve 143*a* rotated in a direction shown by the arrow to feed the toner, and an elastic blade 143*b* for regulating a thickness of a toner layer around the developing sleeve 143*a*, and, the cleaning device 144 comprises a cleaning blade 144*a* for removing the toner from the image bearing member 141, and a squeegee sheet 144*b* for receiving the removed toner. Incidentally, the construction of the cleaning device 144, particularly the squeegee sheet 144*b* will be described later.

The charger device 142 may comprise a charger roller of a contact type which can charge the image bearing member by applying a low voltage to it and which does not generate ozone. The charger roller 142 as shown in FIG. 84 includes a metal core 142*a* to which only the DC voltage (about 1.2 kV) is applied from a power source V. Thus, since there is no action for averaging or levelling the potential on the image bearing member 141 after the transferring operation, a pre-exposure opening 147 is provided to illuminate the image bearing member with light, thereby levelling the potential on the image bearing member 141. On the other hand, to the charger roller 142 as shown in FIG. 85, the DC and AC voltages are applied from the power source V. Thus, there is an action for levelling the potential on the image bearing member 141 after the transferring operation, and any pre-exposure opening 147 is not required.

Figure 86:
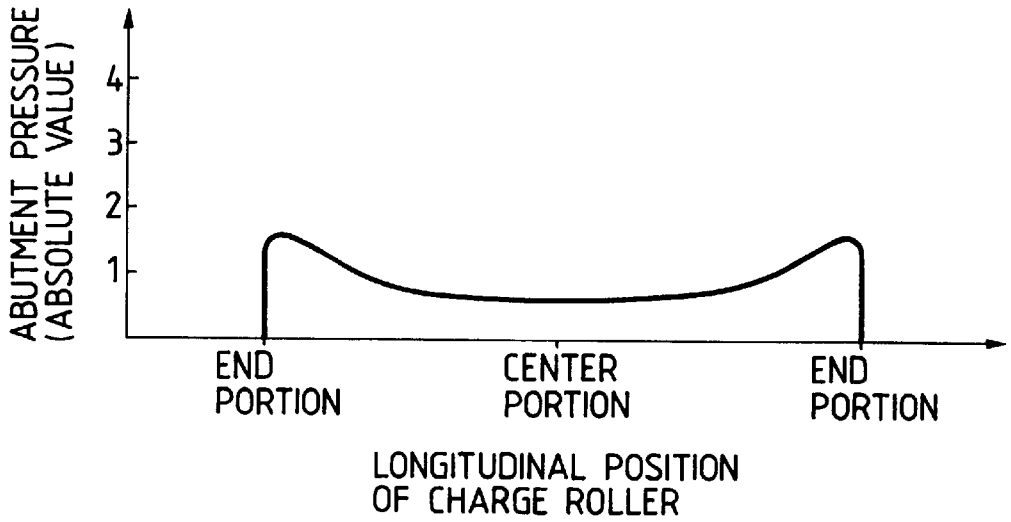
FIG. 86 is a graph showing an urging force or abutment pressure of a charger roller of a contact type with respect to longitudinal positions of an image bearing member.

Further, both ends of the metallic core 142*a* of the charger roller 142 are spring-biased by springs to urge the charger roller against the image bearing member 141 so that the charger roller is driven by the rotational movement of the image bearing member 141. The total urging force (abutment pressure) of the charger roller 142 against the image bearing member 141 is selected to have a value of about 500–1000 grams so as not to cause poor charging. Accordingly, when the abutment pressure of the charger roller 142 against thee image bearing member 141 is measured with respect to the longitudinal direction thereof, as shown in FIG. 86, in case of the total abutment pressure of 500 grams, the urging force is remarkably increased at both end portions of the charger roller supported by the springs and is greater than that at the central position by twice or more. Although depending upon the hardness of the rubber of the charger roller 142 and the biasing forces of the springs, this tendency will be further noticeable when the total pressure is increased, for example, to 1000 grams and to 1500 grams, so that the urging force at both ends is further emphasized to become greater than that at the central position by three times, four times or more.

As a result, a small amount of toner that has escaped from the cleaning blade 144*a* is squeezed on the image bearing member 141 by the strong urging force of the charger roller 142, thus adhering onto the surface of the image bearing member 141 at both of its end portions. Further, as shown in FIG. 85, when the DC and AC voltages are applied to the charger roller 142, since the charger roller 142 is vibrated, the toner is further squeezed by the stronger force, thus contaminating the surface of the image bearing member 141 noticeably.

The inventors conducted various tests and found that the above drawback was caused not only by the urging force of the charger roller 142 against the image bearing member 141, but also by the urging force of the squeegee sheet 144*b* contacting with the image bearing member 141. Further, it was found that, if the urging force of the squeegee sheet 144*b* was too great, the surface of the image bearing member 141 was damaged, with the result that the adhesion of the toner to both end portions of the image bearing member 141 was promoted.

Thus, according to the present invention, it is so designed that the urging force of the squeegee sheet 144*b* is smaller at both of its longitudinal end positions than at a central position thereof. Further a detailed explanation will be done with reference to FIGS. 87 to 94.

Figure 87:
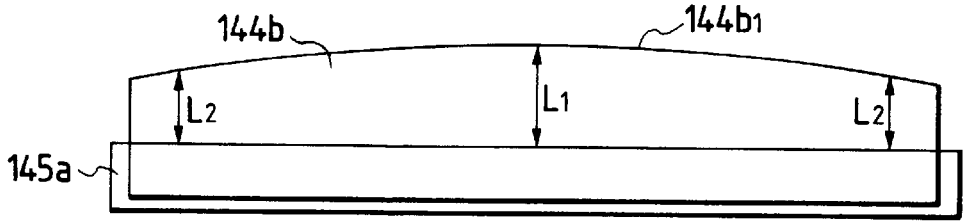
FIG. 87 is a view showing a squeegee sheet such that a thickness of a central portion thereof is wider than a thickness of the end portions.

As shown in FIG. 87, the squeegee sheet 144*b* to which the present invention is applied is stuck to an attachment surface 145*a* of the frame 145 of the process cartridge, and an upper edge 144*b*1 of the squeegee sheet which are to be abutted against the image bearing member 141 is smoothly curved to have a central height L1 higher than both end heights L2. And, a penetrating amount δ of the squeegee sheet 144*b* onto the image bearing member is selected so as to be greater at a central position of the sheet than at both longitudinal end portions thereof. With this arrangement, the urging force of the squeegee sheet 144*b* against the image bearing member 141 can be smaller at both longitudinal end positions of the sheet than at the central position thereof.

Figure 88A:
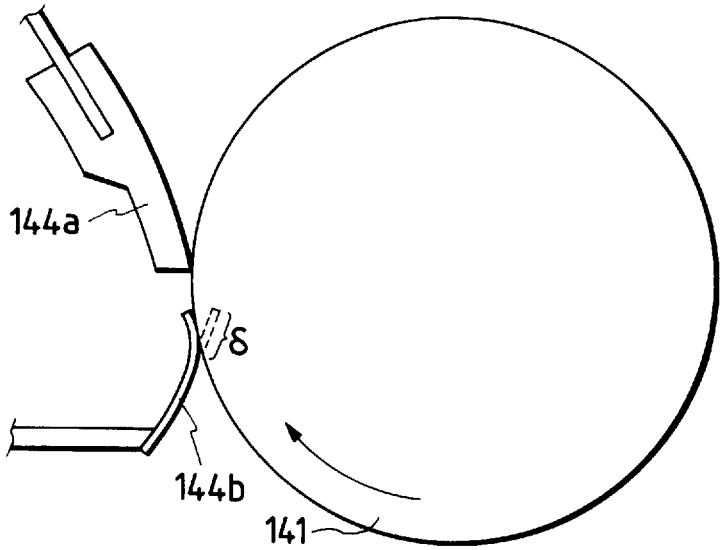
FIGS. 88A and 88B are views for explaining a penetrating amount of a squeegee sheet.
Figure 88B:
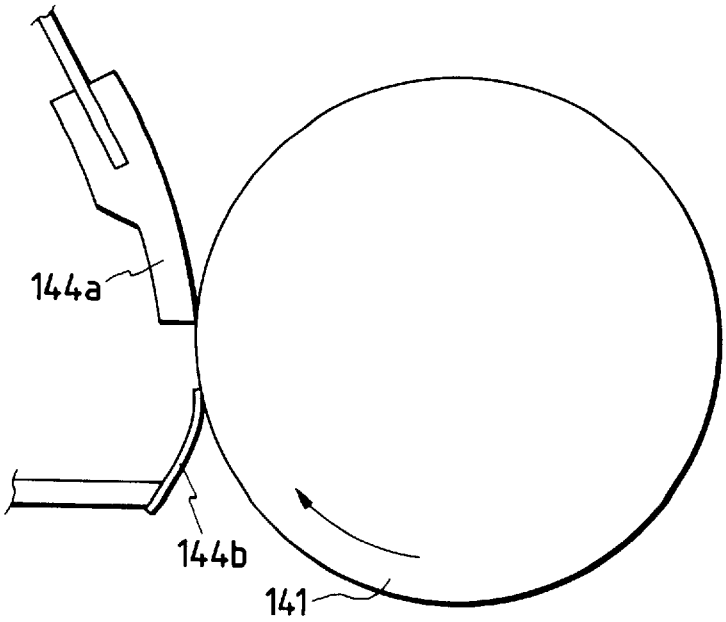

Now, the penetrating amount δ of the squeegee sheet 144*b* will be explained with reference to FIG. 88. The penetrating amount δ means an amount that the non-deformed squeegee sheet 144*b* (shown by the phantom line) (before the image bearing member 141 is mounted) is penetrated onto the image bearing member 141 after the latter is mounted. Generally, the penetrating amount δ of the squeegee sheet 144*b* is selected to be about 1.0–3.0 mm. When the penetrating amount δ is 3.0 mm, as shown in FIG. 88A, the squeegee sheet 144*b* is abutted against the image bearing member through its substantial portion; whereas, when the penetrating amount δ is 1.0 mm, as shown in FIG. 88B, the squeegee sheet is abutted against the image bearing member via a free edge thereof.

In the illustrated embodiment, the penetrating amount δ of the squeegee sheet 144*b* is so selected to have a value of about 1.5 mm at its central position and about 0.5 mm at both of its longitudinal end positions. Now, such selected values will be explained.

As mentioned above, generally, the penetrating amount δ of the squeegee sheet is set to 1.0–3.0 mm, and a lower limit thereof is 1.0 mm. Now, when the penetrating amount was set to 0.5 mm smaller than the lower limit (1.0 mm) uniformly along the whole length of the squeegee sheet, the images were transferred on the recording sheets in such a setting condition. As a result, it was found that the toner was dropped through the central portion of the squeegee sheet after about 1000 sheets were copied. However, in this case, the toner was not dropped through end portions of the squeegee sheet. Accordingly, the lower limit of the penetrating amount δ was selected to 1.0 mm to prevent the dropping of the toner even after about 1000 sheets were copied. However, as apparent from the above result, even when the penetrating amount δ of the squeegee sheet is set to 0.5 mm, the toner is not dropped through the end portions of the squeegee sheet. This shows the fact that the lower limit of the penetrating amount δ differs between the central portion and end portions of the squeegee sheet. This can be understood in consideration of the image distribution on the copied sheet.

That is to say, generally, in the copied sheets, both lateral end portions of the copied sheets are almost blank and have fewer images. To the contrary, images usually always exist in the central portions of the copied sheets. Thus, the image distribution differs between the central portions and end portions in the copied sheets. Accordingly, the amount of toner received by the end portions of the squeegee sheet is remarkably smaller than that received by the central portion of the squeegee sheet. Therefore, at the longitudinal end portions of the squeegee sheet, it is not feared that a large amount of toner is trapped on the edge portion of the sheet and is dropped due to the vibration of the image bearing member at the starting thereof, and/or a large amount of toner removed by the cleaning blade is dropped onto the squeegee sheet and overflows from the end portions of the squeegee sheet. For these reasons, the lower limit of the penetrating amount δ is selected to be 1.0 mm at the central portion of the squeegee sheet and 0.5 mm at both end portions thereof.

Now, the penetrating amount δ of the squeegee sheet in this embodiment was set to 1.5 mm at the central portion and 0.5 mm at both end portions, and the images were copied on 3000 sheets in this condition under a room temperature and humidity (23° C., 65%). As a result, it was found that there was no dropping of the toner, the toner was not adhered on the both lateral end portions of the image bearing member, and good images could be obtained.

Figure 89:
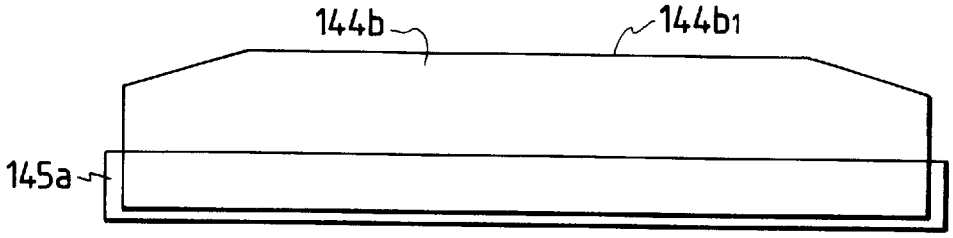
FIG. 89 is a view showing a squeegee sheet such that a thickness of a central portion thereof is wider than a thickness of the end portions.

FIG. 89 shows an alteration of a squeegee sheet. A squeegee sheet 144*b* as shown has an upper edge portion 144*b*1 including obliquely cut upper end portions corresponding to areas where the urging force of the charger roller 142 is remarkably increased, thereby reducing the urging force of the squeegee sheet at those end portions. Further, the penetrating amount δ of the squeegee sheet other than the cut end portions is set to 2.0 mm, so that the dropping of the toner can be surely prevented. In this way, by forming the upper edge 144*b*1 of the squeegee sheet 144 by straight lines, the productivity of the squeegee sheet is improved, thus always providing the identical squeegee sheets.

Incidentally, the present invention is not limited to the cleaning device of the process cartridge, but can be applied to a cleaning device for an image forming system. This is similarly adopted to embodiments described hereinbelow.

Figure 90A:
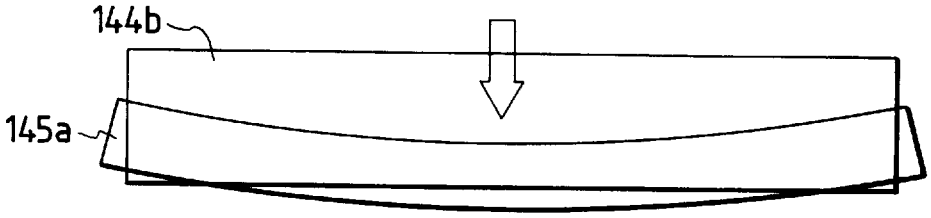
FIG. 90A is a view showing a squeegee sheet such that a thickness of a central portion thereof is wider than a thickness of the end portions before a tension is applied.
Figure 90B:
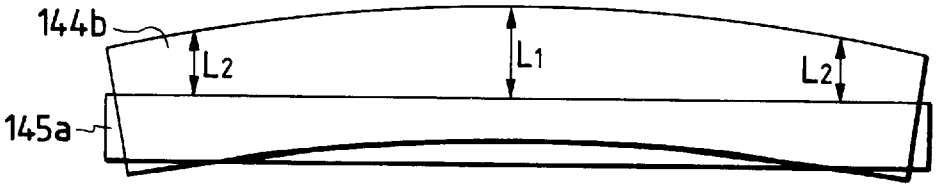
FIG. 90B is a view showing the squeegee sheet such that the thickness of the central portion thereof is wider than a thickness of the end portions after the tension is applied.
Figure 91A:
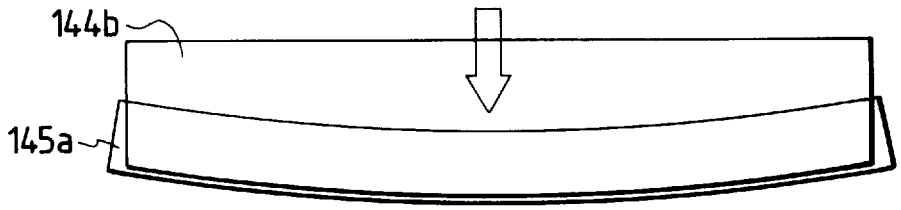
FIG. 91A is a view showing a squeegee sheet such that a thickness of a central portion thereof is wider than a thickness of the end portions before a tension is applied.
Figure 91B:
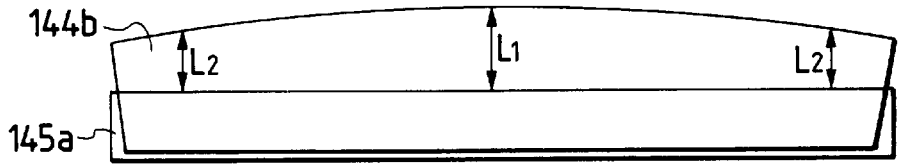
FIG. 91B is a view showing the squeegee sheet such that the thickness of the central portion thereof is wider than a thickness of the end portions after the tension is applied, according to another embodiment.

FIGS. 90 and 91 show other embodiments. In the embodiment of FIG. 90, a squeegee sheet 144*b* having the uniform width or height is used. First of all, as shown in FIG. 90A, the squeegee sheet 144*b* is stuck to a temporarily deformed attachment surface 145, and then, as shown in FIG. 90B, by releasing the curvature of the attachment surface 145, a protruded height of the squeegee sheet is differentiated between the central portion and longitudinal end portions (L1>L2). With this arrangement, it is possible to reduce the urging force of the squeegee sheet at the end portions thereof below that at the central portion. Further, by sticking the squeegee sheet 144*b* to the temporarily deformed attachment surface 145*a*, when the curvature of the attachment surface is released, the tension force directed outwardly in the longitudinal direction is applied to the squeegee sheet 144*b*, thus preventing the occurrence of the undulation in the squeegee sheet 144*b*. This is particularly effective when using a thin squeegee sheet having a thickness of about 38 μm (easily deformable) to always provide good toner receiving ability. Incidentally, generally, a squeegee sheet having a thickness of about 50 μm has been used.

However, when the squeegee sheet is stuck in the manner as mentioned above, an attachment area for the squeegee sheet is decreased at a central portion of the attachment surface 145*a*. In this case, if it is tried to obtain the attachment area as great as possible, the lower edge 144*b*2 of the squeegee sheet 144*b* is often protruded from the attachment surface 145*a* as shown in FIG. 90B. The attachment area is important; if the adequate attachment area cannot be obtained, the stuck squeegee sheet is peeled from the attachment surface (particularly, the peeling of the sheet is promoted under the high temperature and high humidity condition), and the adhesion force of the adhesive such as the both-sided adhesive tape is weakened, thus causing the premature peeling of the sheet.

Figure 92:
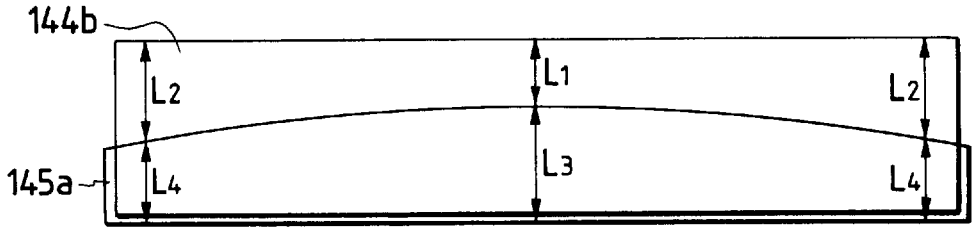
FIG. 92 is a view showing a squeegee sheet such that a thickness of a central portion thereof is wider than a thickness of the end portions according to a further embodiment.

Thus, even when the squeegee sheet 144*b* is stuck in the above-mentioned method, in order to ensure the adequate attachment area, as shown in FIG. 92, the squeegee sheet is shaped to conform to the deformed attachment surface 145*a*. With this arrangement, it is possible to reduce the urging force of the squeegee sheet (L1>L2) while adequately utilizing the attachment area. Further, it is possible to prevent the occurrence of the undulation in the sheet, to always maintain the toner receiving ability and to prevent the adhesion of toner to the end portions of the image bearing member.

Figure 93:
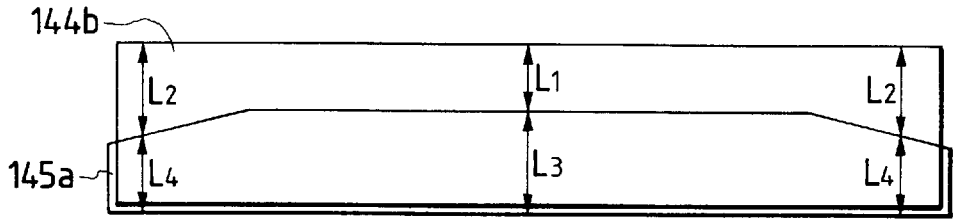
FIG. 93 is a view showing a squeegee sheet such that a thickness of a central portion thereof is wider than a thickness of the end portions according to a still further embodiment.

FIGS. 92 and 93 show still further embodiments. In these embodiments, the width of the attachment surface 145*a* differs between its central portion and both end portions. As shown in FIG. 92, the attachment surface 145*a* is so designed that the width L4 at both of its end portions is smaller than the width L3 at its central portion. With this arrangement, when the squeegee sheet 144*b* having the uniform width along its length is stuck to the attachment surface, the protruded height of the squeegee sheet 144*b* is differentiated so that it is longer at both of its end portions (L2) than that at the central portion (L1), thereby reducing the urging force of the squeegee sheet at both of its end portions. Accordingly, in this embodiment, since the squeegee sheet having the uniform width is used, the productivity is improved. Further, since the attachment surface 145*a* is convex at its central portion, the toner at the central portion of the squeegee sheet, where a large amount of toner is apt to be trapped due to the greater image distribution percentage, flows naturally toward the both end portions, thereby utilizing the capacity of the cleaning device effectively.

As mentioned above, since the width of the attachment surface 145*a* at the both end portions (L4) may be smaller than that at the central portion (L3), in an embodiment shown in FIG. 93, the end portion of the attachment surface 145*a* are obliquely and straightly cut at their upper surfaces. Further, only the attachment surface 145*a* is shaped as shown in FIG. 93, it is possible to reduce the urging force of the squeegee sheet 144*b* at both of its end portions lower than that at its central portion (L1<L2).

Figure 94:
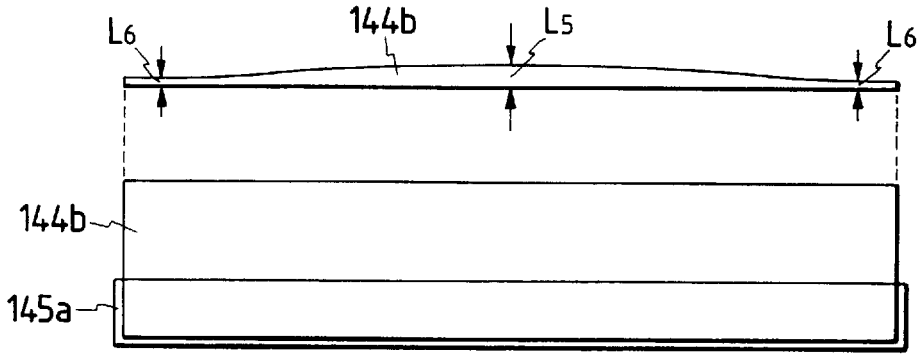
FIG. 94 is a view showing a squeegee sheet that a thickness of a central portion thereof is wider than a thickness of the end portions according to another embodiment.

FIG. 94 shows the other embodiment. In this embodiment, a thickness of the squeegee sheet 144*b* is differentiated so that the thickness at its central portion (L5) is greater than those at both end portions (L6). With this arrangement, it is possible to reduce the urging force of the squeegee sheet 144*b* at its both end portions. Accordingly, in this embodiment, since the penetrating amount δ of the squeegee sheet 144*b* may not be reduced at its both end portions, the penetrating amount δ is uniformly set to 1.5 mm. As a result, it is possible to reduce the urging force of the squeegee sheet 144*b* while establishing the adequate toner receiving ability.

As mentioned above, in the squeegee sheets, cleaning devices, process cartridges and image forming systems according to the aforementioned embodiments, since the squeegee sheet is shaped (the same as the shape of the deformed attachment surface) to widen at its central portion (at the side of the attachment surface) in the longitudinal direction, it is possible to prevent the poor attachment of the squeegee sheet.

Further, in the squeegee sheet sticking method according to the aforementioned embodiments, since the tension is applied to the squeegee sheet by releasing the curvature of the attachment surface after the squeegee sheet is stuck to the pre-deformed attachment surface, it is possible to prevent the occurrence of the undulation in the squeegee sheet when the latter is attached to the cleaning container. Further, in the cleaning devices and the process cartridges including the above cleaning devices, since the notches are formed in the partition wall formed in the cleaning container and the thickness near the attachment surface of the cleaning container is smaller than the other, it is possible to easily curve the attachment surface without reducing the rigidity of the cleaner.

Further, in the cleaning device according to the aforementioned embodiment, since the tension is applied to the squeegee sheet by applying the outwardly directing forces to the frame after the squeegee sheet is attached to the frame, it is possible to prevent the occurrence of the undulation in the squeegee sheet.

Furthermore, in the cleaning devices according to the aforementioned embodiments, since the urging force of the squeegee sheet against the image bearing member is reduced at both of its end portions below that at its central portion, it is possible to reduce or prevent the adhesion of toner to both end portions of the image bearing member.

According to the present invention, by increasing the width of the squeegee sheet at its central portion, it is possible to provide a squeegee sheet, a cleaning device, a process cartridge and an image forming system, which can prevent the poor attachment of the squeegee sheet. Further, according to the present invention, it is possible to easily deform the attachment surface and to stick the squeegee sheet to the cleaning container without any undulation. Furthermore, it is possible to smoothly curve the attachment surface while maintaining the rigidity of the cleaner.

Further, according to the present invention, since the tension is applied to the squeegee sheet by applying the outwardly directing forces to the frame after the squeegee sheet is attached to the frame, it is possible to prevent the occurrence of the undulation in the squeegee sheet and to receive all of the toner removed by the cleaning blade. Therefore, good images can always be obtained.

What is claimed is:

1. A toner-guiding sheet for use with an electrophotographic image forming system for guiding toner removed from an electrophotographic photosensitive drum by a cleaning member to a toner-receiving unit, said sheet being attached to an attachment surface at one end portion, the end portion having two lateral edges and a central portion extending further than the lateral edges.

2. A sheet according to claim 1, wherein said attachment surface is curved.

3. A process cartridge removably mounted onto an electrophotographic image forming system, said process cartridge comprising:

an electrophotographic photosensitive member;

cleaning means for removing toner from said electrophotographic photosensitive member; and a toner-guiding sheet, having a widened central portion, for guiding the toner removed from said electrophotographic photosensitive member by said cleaning means to a receiving portion, said toner-guiding sheet being attached to an attachment surface at one end portion, the end portion having two lateral edges and the central portion extending further than the lateral edges.

4. An electrophotographic image forming system to which a process cartridge is removably mounted for forming an image on a recording sheet, said electrophotographic image forming system comprising:

mounting means for removably mounting a process cartridge which includes an electrophotographic photosensitive member, cleaning means for removing toner from the electrophotographic photosensitive member, and a toner guiding sheet, having a central portion widened relative to longitudinal end portions thereof, for receiving the toner removed from the electrophotographic photosensitive member by the cleaning means, said sheet being attached along an attachment portion thereof to an attachment surface; and feeding means for feeding a recording sheet.

5. An electrophotographic image forming system according to claim 4, wherein said electrophotographic image forming system is an electrophotographic copying machine.

6. An electrophotographic image forming system according to claim 4, wherein said electrophotographic image forming system is a laser beam printer.

7. An electrophotographic image forming system according to claim 4, wherein said electrophotographic image forming system is a facsimile.

8. A method for sticking a sheet to a cleaning container, comprising the steps of:

sticking a sheet to an attachment surface of a cleaning container in a condition that the attachment surface is previously deformed in a curved condition; and applying a tension force to the sheet in a longitudinal direction of the sheet by releasing the curved condition of the attachment surface.

9. A cleaning device comprising:

a cleaning container made of resin for containing matter removed from a body to be cleaned, said cleaning container having a wall with an attachment surface on a portion of said wall; and a sheet stuck to said cleaning container on the attachment surface, wherein the wall of said cleaning container is thinner at a position near the attachment surface than at a position away from the attachment surface, to facilitate bending of the attachment surface during application of said sheet to the attachment surface.

10. A cleaning device according to claim 9, wherein said body to be cleaned comprises a photosensitive member, and said cleaning device is assembled with said photosensitive member and is removable with respect to an electrophotographic image forming system.

11. A cleaning device for removing an adhered matter from a body to be cleaned, said cleaning device comprising:

a cleaning container for containing the adhered matter removed from the body to be cleaned;

a partition member for dividing said cleaning container into a plurality of compartments in a longitudinal direction of said cleaning container; and a sheet stuck to said cleaning container;

wherein a notch is formed in said partition member at a side of said sheet.

12. A cleaning device according to claim 11, wherein said body to be cleaned comprises a photosensitive member, and said cleaning device is assembled with said photosensitive member and is removable with respect to an electrophotographic image forming system.

13. A cleaning device for removing an adhered matter from a body to be cleaned, said cleaning device comprising:

cleaning means for removing the adhered matter from the body to be cleaned;

a cleaning container for containing the adhered matter removed by said cleaning means from the body to be cleaned;

a sheet, provided on said cleaning container, for directing the adhered matter removed by said cleaning means from the body to be cleaned to said cleaning container; and hook means, provided on said cleaning container in a vicinity of said sheet, for applying tension to said sheet.

14. A cleaning device according to claim 13, wherein said hook means comprises a rib extending perpendicular to an attachment surface of said cleaning container to which said sheet is stuck.

15. A cleaning device according to claim 13, wherein said hook means comprises a rib provided on a back surface of an attachment surface of said cleaning container to which said sheet is stuck.

16. A process cartridge mountable to an electrophotographic image forming system, said process cartridge comprising;

an electrophotographic photosensitive member;

cleaning means for removing toner from said electrophotographic photosensitive member;

a cleaning container for containing the toner removed from said electrophotographic photosensitive member by said cleaning means;

a sheet, provided on said cleaning container, for directing the toner removed by said cleaning means from said electrophotographic photosensitive member to said cleaning container, hook means, provided on said cleaning container in a vicinity of said sheet, for applying tension to said sheet; and a frame for integrally supporting said electrophotographic photosensitive member, said cleaning means, and said cleaning container.

17. A process cartridge according to claim 16, further comprising process means which includes charger means, developing means, and said cleaning means.

18. A process cartridge according to claim 16, wherein said hook means comprises a rib formed normal to a surface of said cleaning container.

19. A process cartridge according to claim 16, wherein said hook means comprises a rib formed on a corner portion of a rear side of a surface of said cleaning container.

20. A process cartridge according to claim 16, wherein a force for bending a surface of said cleaning container is applied by hooking a tool with said hook means, while attaching said sheet to the surface of said cleaning container.

21. A process cartridge according to claim 16, wherein a surface of said cleaning container comprises an attaching surface for attaching said sheet, and said hook means is provided near the attaching surface.

22. A process cartridge according to claim 16, further comprising charge means for charging the electrophotographic photosensitive member.

23. A process cartridge according to claim 16, further comprising developing means for developing a latent image formed on an electrophotographic photosensitive member.

24. A cleaning device for removing toner from an electrophotographic photosensitive member, said cleaning device comprising:

cleaning means for removing the toner from the electrophotographic photosensitive member;

a frame; and a sheet for receiving the toner removed from the electrophotographic photosensitive member by said cleaning means, said sheet being attached to said frame by an adhesive in a condition where a tension force is applied to said sheet, wherein the tension force is released after said sheet is attached to said frame by the adhesive, and wherein the tension force is applied to said sheet by a part of the cleaning device.

25. A cleaning device according to claim 24, wherein said part includes said cleaning means.

26. A cleaning device according to claim 24, wherein said part comprises a partition member for dividing a waste toner containing portion provided in said cleaning device.

27. A cleaning device for removing toner from an electrophotographic photosensitive member, said cleaning device comprising:

cleaning means for removing the toner from the electrophotographic photosensitive member;

a frame; and a sheet for receiving the toner removed from the electrophotographic photosensitive member by said cleaning means, said sheet being attached to said frame by an adhesive in a condition where a tension force is applied to said sheet, wherein the tension force is released after said sheet is attached to said frame by the adhesive, and wherein the tension force is applied to said sheet by a part of a developing device.

28. A cleaning device according to claim 27, wherein said part comprises a frame of said developing device.

29. A cleaning device for removing toner from an electrophotographic photosensitive member, said cleaning device comprising:

cleaning means for removing the toner from the electrophotographic photosensitive member;

a frame; and a sheet for receiving the toner removed from the electrophotographic photosensitive member by said cleaning means, said sheet being attached to said frame by an adhesive in a condition where a tension force is applied to said sheet, wherein the tension force is released after said sheet is attached to said frame by the adhesive; and tension adjusting means for adjusting the tension force applied to said sheet.

30. A cleaning device for removing toner from an electrophotographic photosensitive member, said cleaning device comprising:

cleaning means for removing the toner from the electrophotographic photosensitive member;

a frame; and a toner-guiding sheet for use with an electrophotographic image forming system for guiding the toner removed from an electrophotographic photosensitive member to a toner-receiving unit, said toner-guiding sheet being attached to a frame at one end portion, the end portion having two lateral edges and a central portion extending further than the lateral edges, wherein said cleaning device is integrally assembled with the electrophotographic photosensitive member to form a process cartridge, which is removably mounted onto the electrophotographic image forming system.

31. An electrophotographic image forming system for recording an image on a recording medium, said electrophotographic image forming system comprising:

an electrophotographic photosensitive member;

a cleaning device including cleaning means for removing toner from said electrophotographic photosensitive member, a frame and a sheet for receiving the toner removed from said electrophotographic photosensitive member by said cleaning means, and wherein an urging force of said sheet against said electrophotographic photosensitive member is smaller at each of plural end portions of said sheet than at a central portion of said sheet in a longitudinal direction of said sheet, said sheet being attached to an attachment surface at a side portion, the side portion having two lateral edges and the central portion extending further than the lateral edges; and a contact-type charger member for charging a surface of said electrophotographic photosensitive member by contacting said electrophotographic photosensitive member.

32. An electrophotographic image forming system according to claim 31, wherein a DC voltage and an AC voltage are simultaneously applied to said contact type charger member.

33. A toner-guiding sheet for use with an electrophotographic image forming system for guiding toner removed from an electrophotographic photosensitive member to a toner-receiving unit, said toner-guiding sheet being attached to an attachment surface at one end portion, the end portion having two lateral edges and a central portion extending further than the lateral edges, wherein said sheet is adhered to a cleaning container by adhesive.

34. A toner-guiding sheet for use with an electrophotographic image forming system for guiding toner removed from an electrophotographic photosensitive member to a toner-receiving unit, said toner-guiding sheet being attached to an attachment surface of an object at one end portion, the end portion having two lateral edges and a central portion extending further than the lateral edges, wherein said sheet is adhered to the attachment surface when the object is in a deformed condition, the object being released from the deformed condition to apply a tension to said sheet in a longitudinal direction thereof.

35. A cleaning apparatus for removing toner from an electrophotographic photosensitive member, comprising:

cleaning means for removing toner from the electrophotographic photosensitive member;

toner receiving means for receiving the toner removed from the electrophotographic photosensitive member by said cleaning means;

a sheet, having a width at a central portion which is larger than a width at an end portion in a longitudinal direction of said sheet, for leading the toner removed from the electrophotographic photosensitive member by said cleaning means to said toner receiving means, wherein said sheet is adhered to an attaching surface of a deformed object, which is then released from the deformed condition to apply a tension to said sheet in the longitudinal direction.

36. A process cartridge removably mounted onto a main body of an electrophotographic image forming system, said process cartridge comprising:

an electrophotographic photosensitive member;

cleaning means for removing toner from said electrophotographic photosensitive member; and a toner-guiding sheet, having a widened central portion, for guiding the toner removed from said electrophotographic photosensitive member by said cleaning means to a receiving portion, said toner-guiding sheet being attached to an attachment surface of an object at one end portion, the end portion having two lateral edges and the central portion extending further than the lateral edges, wherein said sheet is adhered to the attachment surface when the object is in a deformed condition, the object being released from the deformed condition to apply a tension to said sheet in a longitudinal direction thereof.

37. A process cartridge removably mounted onto a main body of an electrophotographic image forming system, said process cartridge comprising:

an electrophotographic photosensitive drum;

a cleaning blade abutting onto said electrophotographic photosensitive drum for removing toner therefrom;

a receiving member for receiving the toner removed from said electrophotographic photosensitive drum by said cleaning blade; and a toner-guiding sheet, having a width at a central portion which is larger than a width at an end portion in a longitudinal direction of said sheet, for receiving the toner removed from said photosensitive drum by said cleaning blade and leading the removed toner to said receiving member, said toner-guiding sheet being attached to an attachment surface at a side portion, the side portion having two lateral edges and the central portion extending further than the lateral edges.

38. A process cartridge removably mounted onto a main body of an electrophotographic image forming system, said process cartridge comprising:

an electrophotographic photosensitive drum;

a cleaning blade abutting onto the electrophotographic photosensitive drum for removing toner therefrom;

a receiving member for receiving the toner removed from said electrophotographic photosensitive drum by said cleaning blade;

a toner-guiding sheet, having a width at a central portion which is larger than a width at an end portion in a longitudinal direction of said sheet, for receiving the toner removed from said electrophotographic photosensitive drum by said cleaning blade and leading the removed toner to said receiving member, said toner-guiding sheet being attached to an attachment surface at a side portion, the side portion having two lateral edges and the central portion extending further than the lateral edges; and a charger member for charging said electrophotographic photosensitive drum.

39. An electrophotographic image forming system, to which a process cartridge is mountable, for forming an image on a recording medium, said electrophotographic image forming system comprising:

mounting means including an electrophotographic photosensitive member, cleaning means for removing toner from said electrophotographic photosensitive member, receiving means for receiving the toner removed from said electrophotographic photosensitive member by said cleaning means, and a sheet for leading the toner removed from said electrophotographic photosensitive member by said cleaning means to said receiving means, said sheet being attached to an attachment surface at one end portion, the end portion having two lateral edges and a central portion extending further than the lateral edges; and conveying means for conveying the recording medium.

40. An electrophotographic image forming system according to claim 39, wherein said electrophotographic image forming system comprises an electrophotographic copying machine.

41. An electrophotographic image forming system according to claim 39, wherein said electrophotographic image forming system comprises a laser beam printer.

42. An electrophotographic image forming system according to claim 39, wherein said electrophotographic image forming system comprises a facsimile apparatus.

43. A method for attaching a sheet for receiving toner removed from an electrophotographic photosensitive member to a frame, comprising the steps of:

adhering the sheet to an attaching surface of the frame, using an adhesive, while bending the frame; and releasing the frame from the bending condition, after the sheet is adhered to the frame by the adhesive.

44. A method according to claim 43, wherein a width of the sheet at a central portion is larger than a width of the sheet at an end portion.

45. A method according to claim 43, wherein the sheet comprises resilient material.

46. A method according to claim 43, wherein the sheet comprises plastic.

47. A method according to claim 43, wherein the sheet slightly contacts with a surface of the electrophotographic photosensitive member, for passing toner on the surface of the electrophotographic photosensitive member, and for receiving toner removed from the surface of the electrophotographic photosensitive member by a cleaning blade.

48. A method according to claim 43, wherein the frame comprises a cleaning container which comprises resin.

49. A method according to claim 43, wherein the frame comprises resin, and wherein the frame is constructed from at least the electrophotographic photosensitive member and a cleaning means to form a process cartridge mountable to a body of an electrophotographic image forming system.

50. A method according to claim 43, wherein a width of an attaching surface of the frame is larger than a width of a removing portion of the frame.

51. A method according to claim 43, wherein the frame has an engaging portion which is engaged by a tool while bending the frame.

52. A method according to claim 43, wherein the frame applies a force to a part of a container for receiving toner removed from a surface of the electrophotographic photosensitive member by a cleaning blade, the part comprising a partition member for partitioning internal space of the container upon bending the frame.

53. A method for attaching a sheet for receiving toner removed from an electrophotographic photosensitive member to a frame in an electrophotographic image forming system, said method comprising the steps of:

preparing the sheet to have a width at a central portion which is larger than a width at an end portion in a longitudinal direction of the sheet; and adhering the sheet to the frame so as to slightly contact the frame along an axial direction of the electrophotographic photosensitive member.

54. A method according to claim 53, wherein the sheet slightly contacts with a surface of the electrophotographic photosensitive member, for passing toner on the surface of the electrophotographic photosensitive member, and for receiving toner removed from the surface of the electrophotographic photosensitive member by a cleaning blade.

55. A method according to claim 53, wherein the electrophotographic image forming system comprises a facsimile apparatus.

56. A cleaning apparatus for removing attached material from an object, comprising:

cleaning means for removing material attached to the object;

a cleaning container for containing the material removed from the object by said cleaning means, said cleaning container having a surface;

a sheet, attached to the surface of said cleaning container, for receiving the removed material, and for leading the removed material to said cleaning container; and a latch portion for bending the surface of said cleaning container while attaching said sheet to the surface.

57. A cleaning apparatus according to claim 56, wherein the object to be cleaned comprises an electrophotographic photosensitive member, and wherein said cleaning means comprises a cleaning blade for removing the attached material from the electrophotographic photosensitive member.

58. A cleaning apparatus according to claim 56, wherein a force for bending the surface of said cleaning container is applied by latching a tool with said latch portion, while attaching said sheet to the surface of said cleaning container.

59. A process cartridge mountable to a body of an electrophotographic image forming system, said process cartridge comprising;

an electrophotographic photosensitive member;

cleaning means for removing toner from said electrophotographic photosensitive member;

a cleaning container for containing the toner removed from said electrophotographic photosensitive member by said cleaning means, said cleaning container having a surface;

a sheet, attached to the surface of said cleaning container, for receiving the toner removed from said electrophotographic photosensitive member by said cleaning means, and for leading the removed toner to said cleaning container;

a latch portion for bending the surface of said cleaning container while attaching said sheet to the surface.

60. A process cartridge according to claim 59, wherein said latch portion comprises a rib formed normal to the surface of said cleaning container.

61. A process cartridge according to claim 59, wherein said latch portion comprises a rib formed on a corner portion of a rear side of the surface of said cleaning container.

62. A process cartridge according to claim 59, wherein a force for bending the surface of said cleaning container is applied by latching a tool with said latch portion, while attaching said sheet to the surface of said cleaning container.

63. A process cartridge according to claim 59, wherein the surface comprises a surface for attaching said sheet, and said latch portion is provided near the surface.

64. A process cartridge according to claim 59, further comprising charge means for charging said electrophotographic photosensitive member.

65. A process cartridge according to claim 59, further comprising developing means for developing a latent image formed on said electrophotographic photosensitive member.

66. An electrophotographic image forming system, to which a process cartridge is mountable, for forming an image onto a recording medium, said electrophotographic image forming system comprising:

(a) an electrophotographic photosensitive member;

(b) mounting means for mounting the process cartridge, the process cartridge including cleaning means for removing toner from said electrophotographic photosensitive member, a cleaning container, for containing the toner removed from said electrophotographic photosensitive member by the cleaning means, a sheet, attached to a surface of the cleaning container, for receiving the toner removed from said electrophotographic photosensitive member by the cleaning means and for leading the removed toner to the cleaning container, and a latch portion, provided near the surface of the cleaning container, for bending the cleaning container while attaching the sheet to the surface; and (c) conveying means for conveying a recording medium.

67. An electrophotographic image forming system for forming an image on a recording medium, said electrophotographic image forming system comprising:

(a) an electrophotographic photosensitive member;

(b) a cleaning apparatus including cleaning means for removing toner from said electrophotographic photosensitive member, receiving means for receiving the toner removed from said electrophotographic photosensitive member by said cleaning means, a sheet, abutting said electrophotographic photosensitive member, for receiving the removed toner, and for leading the removed toner to said receiving means, said sheet being attached to an attachment surface at a side portion, the side portion having two lateral edges and a central portion extending further than the lateral edges, wherein an abutment pressure between said sheet and said electrophotographic photosensitive member is smaller at an end portion of said sheet than at the central portion of said sheet; and (c) charging means, abutting said electrophotographic photosensitive member, for charging said electrophotographic photosensitive member.

68. An electrophotographic image forming system according to claim 67, wherein said charging means comprises a charge roller.

69. An electrophotographic image forming system according to claim 67, wherein said charging means comprises a charge roller to which DC voltage and AC voltage are applied.

70. An electrophotographic image forming system according to claim 67, wherein said electrophotographic image forming system comprises an electrophotographic copying machine.

71. An electrophotographic image forming system according to claim 67, wherein said electrophotographic image forming system comprises a laser beam printer.

72. An electrophotographic image forming system according to claim 67, wherein said electrophotographic image forming system comprises a facsimile apparatus.

73. A resilient sheet for use in an electrophotographic image forming system for forming an image on a recording medium for guiding a toner removed from an electrophotographic photosensitive member by a cleaning blade toward a cleaning unit, said sheet being attached to an attachment surface at one end portion, the end portion having two lateral edges and a central portion extending further than the lateral edges, said sheet having an adhering portion to be adhered to said cleaning unit by an adhesive.

74. A sheet according to claim 73, wherein said sheet is in light contact with a surface of the photosensitive member, said sheet receiving the toner removed from the surface of the photosensitive member by the cleaning blade to guide it toward the cleaning unit.

75. A sheet according to claim 73 or 74, wherein said sheet comprises of synthetic resin.

76. A sheet according to claim 75, wherein said sheet comprises polyethylene terephthalate.

77. A sheet according to claim 75, wherein the central portion of said sheet extends further than the lateral edges by about 0.5 mm.

78. A sheet according to claim 73, wherein said sheet is adhered to the cleaning unit by the adhesive in state wherein the cleaning unit is deformed, and then the deformed state of the cleaning unit is released.

79. A resilient sheet for use in an electrophotographic image forming system including an electrophotographic photosensitive member, latent means for developing a latent image formed on the photosensitive member, transfer means for transferring the latent image on the photosensitive member onto a recording medium, cleaning means for removing any toner remaining on the photosensitive member after the transferring of the toner image by the transfer means, and a cleaning container for receiving the toner removed from the photosensitive member, wherein the cleaning means receives the removed toner and guides the removed toner toward the cleaning container, said sheet comprising:

a synthetic resin material having a larger width at a central portion than at an end portion in a longitudinal direction thereof, and having an adhering portion, which is adhered to the cleaning container by an adhesive, said sheet being in light contact with a surface of the photosensitive member to guide the toner attached to the surface of photosensitive member, said sheet being attached to an attachment surface at a side portion, the side portion having two lateral edges and the central portion extending further than the lateral edges.

80. A sheet according to claim 79, wherein said synthetic resin material comprises polyethylene terephthalate.

81. A sheet according to claim 79 or 80, wherein central portion extends further than the lateral edges by about 0.5 mm.

82. A sheet according to claim 79, wherein said sheet is adhered to the cleaning container by the adhesive in a state where the cleaning container is deformed and then the deformed state of the cleaning container is released.

83. A process cartridge removably mounted onto a main body of an electrophotographic image forming system, comprising:

an electrophotographic photosensitive member;

process means for acting on said photosensitive member;

a cartridge frame; and a resilient sheet for guiding a toner removed from said photosensitive member by a cleaning means to a toner receiving portion, said sheet being attached to an attachment surface at one end portion, the end portion having two lateral edges and a central portion extending further than the lateral edges, and having an adhering portion where it is adhered to said cartridge frame.

84. A process cartridge according to claim 83, wherein sheet is in light contact with a surface of the photosensitive member, said sheet guiding the removed toner toward the toner receiving portion.

85. A process cartridge according to claim 83 or 84, wherein said sheet comprises synthetic resin.

86. A process cartridge according to claim 85, wherein said sheet comprises polyethylene terephthalate.

87. A process cartridge according to claim 83, wherein the central portion extends further than the lateral edges by about 0.5 mm.

88. A process cartridge according to claim 83, wherein said sheet is adhered to the cartridge by an adhesive in a state where the cartridge frame is deformed, and then the deformed state of the cartridge frame is released.

89. A process cartridge according to claim 83, wherein said process means comprises cleaning means for removing any toner remaining on said photosensitive member.

90. A process cartridge according to claim 83 or 89, wherein said process means comprises charging means for charging said photosensitive member.

91. A process cartridge according to claim 83, wherein said process means comprises developing means for developing a latent image formed on said photosensitive member onto a recording medium.

92. A process cartridge removably mounted onto a main body of an electrophotographic image forming system, said process cartridge comprising:

a cartridge frame made of synthetic resin;

an electrophotographic photosensitive drum;

a cleaning blade for removing a toner remained on said photosensitive drum;

a charging roller for charging said photosensitive drum;

a developing roller for developing a latent image formed on said photosensitive drum;

a resilient sheet provided on said cartridge frame for guiding the toner removed from said photosensitive drum by said cleaning blade to a toner receiving portion formed on said cartridge frame, said resilient sheet being attached to an attachment surface at one end portion, the portion having two lateral edges and a central portion extending further than the lateral edges.

93. A process cartridge according to claim 92, wherein said sheet comprises polyethylene terephthalate.

94. A process cartridge according to claim 92 or 93, wherein the central portion extends further than the lateral edges by about 0.5 mm.

95. A process cartridge according to claim 92 or 93, wherein the sheet is adhered to the cartridge frame by an adhesive in a state where the cartridge frame is deformed, and then the deformed state of the cartridge frame is released.

96. An electrophotographic image forming system to which a process cartridge is removably mounted for forming an image on a recording sheet, said electrophotographic image forming system comprising:

mount means for removably mounting said process cartridge to said electrophotographic image forming system, said process cartridge including an electrophotographic photosensitive member, cleaning means for removing toner from said electrophotographic photosensitive member, and a toner guiding sheet, having a central portion widened relative to longitudinal end portions thereof, for guiding the toner removed from said electrophotographic photosensitive member by said cleaning means to a receiving portion, said toner guiding sheet being attached along an attachment portion thereof to an attachment surface; and convey means for conveying the recording sheet.

97. An electrophotographic image forming system onto which a process cartridge is removably mounted for forming an image onto a recording sheet, comprising:

mount means for removably mounting said process cartridge to said electrophotographic image forming system, said process cartridge including a cartridge frame made of synthetic resin, an electrophotographic photosensitive drum, cleaning blade for removing a toner remained on the photosensitive drum, charging roller for charging the photosensitive drum, developing roller for developing a latent image formed on the photosensitive drum, a resilient sheet provided on the cartridge frame for guiding the toner removed from the photosensitive drum by the cleaning blade to a toner receiving portion formed on the cartridge frame, the resilient sheet being attached to an attachment surface at one end portion, the end portion having two lateral edges and a central portion extending further than the lateral edges;

convey means for conveying the recording sheet; and transfer means for transferring a toner image formed on the photosensitive drum of said process cartridge mounted on said mount means onto the recording sheet.

98. A process cartridge removably mounted onto a main body of an image forming device, said process cartridge comprising:

an electrophotographic photosensitive member having a surface on which a latent image can be developed with toner;

a cleaning member for removing waste toner from said photosensitive member;

a waste toner reservoir; and a waste toner guide member for guiding waste toner removed from said photosensitive member towards said waste toner reservoir, said guide member including an elongated resilient strip and a mounting member, said strip being secured adjacent one longitudinal edge thereof to said mounting member, and the other longitudinal edge projecting from said mounting member so as to be in light contact with said surface of said photosensitive member, wherein said strip is held by said mounting member in tension along said other longitudinal edge of said strip such that said other longitudinal edge of said strip is convexly curved.

99. A process cartridge according to claim 98, wherein a width of said strip at a central position along a length of said strip is about 0.5 mm greater than a width of said strip at an end position of said strip.

100. A process cartridge according to claim 98 or 99, wherein said other longitudinal edge of said strip projects further from said mounting member at a central position of said strip than at an end position of said strip.

101. A process cartridge according to claim 100, wherein when said strip is in a relaxed state, said other longitudinal edge of said strip is straight, said strip being strained by said mounting member to cause said other longitudinal edge to be convexly curved.

102. A process cartridge according to claim 101, wherein said strip is made of a synthetic resin.

103. A process cartridge according to claim 102, wherein said strip is made of polyethylene terephthalate.

104. A process cartridge according to claim 98, wherein said mounting member is provided by a wall of said waste toner reservoir.

* * * * *

UNITED STATES PATENT AND TRADEMARK OFFICE

CERTIFICATE OF CORRECTION

PATENT NO. : 5,884,124
DATED : March 16, 1999
INVENTOR(S) : Toshiyuki Karakama et al.

It is certified that error appears in the above-identified patent and that said Letters Patent is hereby corrected as shown below:

Title page,
Item [54] Title: "DIP SHEET ADHERING METHOD, CLEANING DEVICE, PROCESS AND IMAGE FORMING APPARATUS" should read -- DIP SHEET, DIP SHEET ADHERING METHOD, CLEANING DEVICE, PROCESS CARTRIDGE AND IMAGE FORMING APPARATUS --.

Column 6,
Line 37, "thereon" should read -- thereon: --.

Column 9,
Line 39, " Means" should read -- means --.

Column 14,
Line 60, "following" should read -- following: --.

Column 17,
Line 35, "$\mu$m)" should read -- $\mu$m) . --.

Column 20,
Line 11, "of-the" should read -- of the --.

Column 25,
Line 17, "Incidentally," should read -- ¶Incidentally, --.
Line 36, "9," should read -- drum 9, --.

Column 33,
Line 28, "a" should read -- $\alpha$ --.

Column 35,
Line 53, "explained" should read -- explained. --.
Line 54, "alternatively," should read -- Alternatively, --.

Column 46,
Line 20, "done" should read -- given --.

UNITED STATES PATENT AND TRADEMARK OFFICE

CERTIFICATE OF CORRECTION

PATENT NO. : 5,884,124
DATED : March 16, 1999
INVENTOR(S) : Toshiyuki Karakama et al.

It is certified that error appears in the above-identified patent and that said Letters Patent is hereby corrected as shown below:

Column 51,
Line 1, "container;" should read -- container, --.

Signed and Sealed this

Nineteenth Day of March, 2002

*Attest:*

*Attesting Officer*

JAMES E. ROGAN
*Director of the United States Patent and Trademark Office*